US007103298B2

(12) United States Patent
Satoh

(10) Patent No.: US 7,103,298 B2
(45) Date of Patent: Sep. 5, 2006

(54) TONER SCATTER SUPPRESSING DEVELOPING DEVICE, IMAGE FORMATION APPARATUS AND PROCESS CARTRIDGE

(75) Inventor: Osamu Satoh, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 107 days.

(21) Appl. No.: 10/780,773

(22) Filed: Feb. 19, 2004

(65) Prior Publication Data

US 2004/0223779 A1 Nov. 11, 2004

(30) Foreign Application Priority Data

Feb. 20, 2003 (JP) ..... 2003-042950
Mar. 12, 2003 (JP) ..... 2003-066019
Sep. 19, 2003 (JP) ..... 2003-327823
Dec. 2, 2003 (JP) ..... 2003-402933

(51) Int. Cl.
*G03G 21/00* (2006.01)
*G03G 15/09* (2006.01)

(52) U.S. Cl. ..... 399/98; 399/267

(58) Field of Classification Search ..... 399/98, 399/92, 93, 99, 102, 267
See application file for complete search history.

(56) References Cited

U.S. PATENT DOCUMENTS 3,685,485 A * 8/1972 Katsuwada ..... 399/93
4,583,112 A * 4/1986 Morano et al. ..... 399/103
4,666,282 A * 5/1987 Rowe ..... 399/93
5,995,780 A * 11/1999 Wayman ..... 399/93
6,505,014 B1 1/2003 Aoki et al.
6,515,747 B1 2/2003 Satoh et al.
6,571,071 B1 5/2003 Kanoshima et al.
6,606,468 B1 * 8/2003 Yoshiki ..... 399/93
6,628,913 B1 9/2003 Matsumoto et al.
6,694,112 B1 2/2004 Sasaki et al.
6,708,015 B1 3/2004 Kurosu et al.
6,721,534 B1 4/2004 Takahashi

FOREIGN PATENT DOCUMENTS

JP 63-159887 7/1988
JP 5-66663 3/1993
JP 6-19293 1/1994
JP 10-3220 1/1998
JP 11-7191 1/1999
JP 2002-244432 8/2002
JP 2002-311711 * 10/2002

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A developing device includes a developing agent carrying member and a latent image carrying member agent. A casing having a developing agent storing space for storing developing agent has an opening whereby a portion of the surface of the developing agent carrying member faces the latent image carrying member. A restricting member is provided within the casing to restrict the amount of developing agent supplied to the developing region. A magnetic field is provided so that the developing agent forms a magnetic brush closing off the space between the surface of the developing agent carrying member and the inner wall of the casing. A gas exhaust path is provided in an upstream space of the developing region between the surface of the developing agent carrying member and the inner wall of the casing to exhaust gas generated in the upstream space.

58 Claims, 43 Drawing Sheets

TONER SCATTER SUPPRESSING DEVELOPING DEVICE, IMAGE FORMATION APPARATUS AND PROCESS CARTRIDGE

CROSS REFERRENCE TO RELATED APPLICATIONS

This application claims priority under 35 USC § 119 to Japanese Patent Application Nos. 2003-042950 filed on Feb. 20, 2003, 2003-066019 filed on Mar. 12, 2003, 2003-327823 filed on Sep. 19, 2003, and 2003-402933 filed on Dec. 2, 2003, the entire contents of which being herein incorporated by reference.

BACKGROUND

1. Field of the Invention

The present invention relates to a developing device applied to image formation apparatuses such as photocopiers, printers, and facsimile devices and the like, and to an image formation apparatus and a process cartridge comprising the same, and further relates to a configuration for adjusting the environmental atmosphere which affects charging properties of developing agent, and preventing soiling due to scattering of developing agent.

2. Discussion of Background Art

Generally, in order to prevent scattering of toner within an image formation apparatus, the interior of the developing device and the outside are isolated one from another by a casing, except for an opening whereby a portion of the surface of a developing agent carrying member is made to face a latent image carrying member. With this structure, a gap exists between the surface of the latent image carrying member and the casing, at the opening. Accordingly, there is the possibility that toner within the developing agent might scatter outside of the developing device through this gap. In the event that toner scatters outside of the developing device, recording media such as paper or the like upon which images are to be ultimately formed may be soiled due to the toner which has spread throughout the image formation apparatus, or normal actions of members and devices disposed within the image formation apparatus may be inhibited. Accordingly, suppressing scattering of toner outside of the developing device is an extremely important issue.

Such scattering of toner primarily occurs at a gap existing upstream in the direction of rotation of the developing agent carrying member (hereafter, referred to simply as "upstream side") of the developing region where the developing agent carrying member and latent image carrying member face one another, and a gap existing downstream in the direction of rotation of the developing agent carrying member (hereafter, referred to simply as "downstream side") thereof.

A developing device disclosed below is known, for example, as an arrangement for suppressing scattering of toner occurring at, of the above, the gap existing at the downstream side. With this developing device, a carrier collecting roller is provided downstream from the developing region, and the width of a first gap which is the gap between the developing agent carrying member and the carrier collecting roller is set so as to be larger than the width of a second gap which is a gap between the developing agent carrying member and the latent image carrying member. In the space encompassed by the latent image carrying member and developing agent carrying member and carrier collecting roller, air enters and exists from the three places of the first gap, the second gap, and a third gap which is a gap between the carrier collecting roller and the latent image carrying member. With this developing device, a magnetic brush is formed by the developing agent bristling on the surface of the developing agent carrying member, and passing through the first gap and the second gap accompanying the rotation of the developing agent carrying member in this state. At this time, each of the magnetic brushes act as slender and small propellers, such that air between the developing agent particles making up the magnetic brushes moves due to the magnetic brushes moving. Accordingly, a strong airflow is generated at the first gap and the second gap in the direction of rotation of the developing agent carrying member. On the other hand, at the third gap, there is little air following the rotation of either the carrier collecting roller and the latent image carrying member, so any airflow generated by the rotations thereof is weak. Accordingly, the airflow at this third gap is determined almost dependently on the airflow generated at the first gap and the second gap. Specifically, difference between the amount of the airflow which flows into the space through the second gap and the amount of the airflow which flows out through the first gap is the airflow generated at the third gap. With this developing device, the width of the first gap between the developing agent carrying member and the carrier collecting roller is set so as to be wider than the width of the second gap between the developing agent carrying member and the latent image carrying member. Accordingly, the airflow flowing out from the space through the first gap is greater than the airflow which flows into this space through the second gap, so the air pressure in this space drops, and acts to suction air in through the third gap. This means that an airflow is generated at this third gap which heads toward the space. This airflow is intended to suppress scattering of toner which occurs downstream of the developing region as discussed in Japanese Unexamined Patent Application Publication No. 10-3220.

On the other hand, for example, a developing device disclosed below is known as an arrangement for suppressing scattering of toner occurring at the gap existing at the upstream side. With this developing device, a partitioning member is provided between the developing agent carrying member and casing at the upstream side, for partitioning between these. With this developing device, rotation of the developing agent carrying member transports developing agent to the developing region, restricted to a predetermined thickness by a developing agent restricting member. The partitioning member is placed somewhere between the developing agent restricting member and the developing region. The space adjacent to the downstream side of the developing agent restricting member in the direction of rotation of the developing agent carrying member (doctor-adjacent space), and the gap existing on the upstream side, communicate through the two channel spaces of the space encompassed by the partitioning member and the casing (first channel space), and the space encompassed by the partitioning member and the developing agent carrying member (second channel space). According to the Document disclosing this arrangement, an airflow is generated at the second channel space following the surface of the developing agent carrying member in accordance with rotations of the developing agent carrying member. Developing agent is present at a high density at the gap between the developing agent restricting member and the developing agent carrying member (doctor gap), and accordingly, airflow through this doctor gap is poor. Consequently, negative pressure is generated at the doctor-adjacent space. Accordingly, air flows into the doctor-adjacent space through the first channel space, so an airflow heading toward the doctor-adjacent space from the gap at the upstream side is generated in the first channel space. Thus, toner floating at the upstream side of the developing region is transported to the doctor-adjacent space by this airflow, which intends to suppress scattering of toner from the gap at the upstream side to the outside of the developing device as discussed in Japanese Unexamined Patent Application Publication No. 63-159887.

Further, in order to prevent scattering of toner within the image formation apparatus, general developing devices have a structure wherein the inside of the developing device and the outside thereof are isolated one from another through the casing except for the opening portion where a portion of the surface of the developing agent carrying member faces the latent image carrying member. With such a construction as well, a gap exists between the surface of the latent image carrying member and the casing. Accordingly, there is the possibility that toner within the developing agent might scatter outside of the developing device through this gap. In the event that toner scatters outside of the developing device, toner spreading within the image formation apparatus may soil recording media such as paper or the like upon which images are to be ultimately formed, or normal actions of members and devices disposed within the image formation apparatus may be inhibited, for example. Accordingly, suppressing scattering of toner outside of the developing device is an extremely important issue.

Such scattering of toner primarily occurs at a gap existing upstream in the direction of rotation of the developing agent carrying member (hereafter, referred to simply as "upstream side") of the developing region where the developing agent carrying member and latent image carrying member face one another, and a gap existing downstream in the direction of rotation of the developing agent carrying member (hereafter, referred to simply as "downstream side") thereof. Of these, the gap at the upstream side can be closed off by employing a configuration wherein, for example, a sheet member attached to the end portion of the casing forming the gap comes into contact with the surface of the latent image carrying member. Accordingly, scattering of toner occurring at the gap on the upstream side can be readily suppressed. Conversely, the gap at the downstream side cannot be closed off with a sheet member using such a configuration. The reason is that generally, the latent image carrying member and the developing agent carrying member rotate such that the surfaces of each are moving in the same direction at the position of closest proximity, and a toner image adheres to the surface portion of the latent image carrying member downstream from the developing region, so scattering of toner occurring at the gap on the downstream side has conventionally been a difficult problem.

As a method for solving this problem, a developing device has been proposed wherein an electroconductive roller is provided within the developing device downstream of the developing region, with the electroconductive roller rotating in a direction such that the surfaces of the electroconductive roller and the developing agent carrying member are moving in the same direction at the position of closest proximity. According to the description in the Document disclosing this arrangement, an airflow is generated by the electroconductive roller and the developing agent carrying member rotating so as to be moving in the same direction at the position of closest proximity. Accordingly, a flow of air which passes from the space surrounded by the developing agent carrying member and latent image carrying member and electroconductive roller, through the space between the developing agent carrying member and the electroconductive roller, into the developing device, is formed. The toner scattered and floating in the space at the developing region is guided into the developing device by this flow of air, which is intended to suppress scattering of toner from occurring at the downstream side of the developing region as discussed in Japanese Unexamined Patent Application Publication No. 5-66663.

A developing device has been proposed wherein a carrier collecting roller is provided downstream of the developing region, and wherein the width of the first gap which is the gap between the developing agent carrying member and the carrier collecting roller is formed wider than the width of a second gap which is the gap between the developing agent carrying member and the latent image carrying member. This developing device has airflow generating means, for generating an airflow at a third gap which is the gap between the carrier collecting roller and the latent image carrying member, from outside of the developing device to the inside thereof. In the space surrounded by the latent image carrying member and the developing agent carrying member and the carrier collecting roller, the air enters and exits from the places of the first gap, the second gap, and the third gap. With this developing device, the developing agent bristles on the surface of the developing agent carrying member at the first gap and the second gap so as to form a magnetic brush, and passes through accompanying the rotation of the developing agent carrying member in this state. At this time, each of the magnetic brushes act as slender and small propellers, such that air between the developing agent particles making up the magnetic brushes moves due to the magnetic brushes moving. Accordingly, a strong airflow is generated at the first gap and the second gap in the direction of rotation of the developing agent carrying member. On the other hand, at the third gap, there is little air following the rotation of either the carrier collecting roller and the latent image carrying member, so any airflow generated by the rotations thereof is weak. Accordingly, the airflow at this third gap is determined almost dependently on the airflow generated at the first gap and the second gap. Specifically, difference between the amount of the airflow which flows into the space through the second gap and the amount of the airflow which flows out through the first gap is the airflow generated at the third gap. With this developing device, the width of the first gap between the developing agent carrying member and the carrier collecting roller is set so as to be wider than the width of the second gap between the developing agent carrying member and the latent image carrying member. Accordingly, the airflow flowing out from the space through the first gap is greater than the airflow which flows into this space through the second gap, so the air pressure in this space drops, and acts to suction air in through the third gap. This means that an airflow is generated at this third gap which heads toward the space. This airflow is intended to suppress scattering of toner which occurs downstream of the developing region as discussed in Japanese Unexamined Patent Application Publication No. 10-3220.

Also, a developing device has been proposed having a configuration wherein the viscous airflow downstream of the developing region acts effectively to generate an airflow heading into the developing device, comprising a filter member for venting the viscous airflow which has flowed into the developing device. According to the Document disclosing this arrangement, the viscous airflow flowing into the developing device is externally vented through the filter member, so the inner pressure within the developing device rises and becomes saturated due to the viscous airflow, thereby conversely enabling an airflow blowing out at the downstream side of the developing region to be prevented. According to this device, no airflow blowing out at the downstream side of the developing region is generated, so an airflow heading into the developing device is perpetually generated, and a stable viscous airflow (suctioning airflow) can be generated at the downstream side of the developing region, thereby enabling stable suppressing of scattering of the toner generated at the downstream side of the developing region as discussed in Japanese Unexamined Patent Application Publication No. 2002-244432.

Though this is not clear regarding the developing device described in Patent Document 3, the developing devices described in Patent Document 4 and Patent Document 5 have structures wherein external air can flow into inner space of the casing through a gap (inlet gap) formed between the downstream edge portion of an opening for exposing the developing agent carrying member and the surface of the latent image carrying member. The airflow flowing in through the inlet gap suppresses scattering of the toner outside of the developing device.

Also, with image formation apparatuses such as photocopiers or printers or facsimile apparatuses or printing apparatuses, there are configurations wherein the latent image carrying member, and of the devices used for the image formation processing, a charging device, developing device, and/or cleaning devices are stored together to form a process cartridge, which is used to transfer a visible image formed on the photosensitive member which is the latent image carrying member onto a recording sheet such as paper or the like, by means of a transfer device disposed nearby the process cartridge, thereby obtaining a copied article.

It is known that in the event of performing visual image processing for an electrostatic latent image formed on the photosensitive member which is the latent image carrying member, the charging properties of the developing agent supplied affect the image concentration and gradient reproducibility, and further it is known that charging properties are readily affected by the environmental ambient atmosphere, humidity in particular. Further, in the event that discharge products such as NOx and the like formed by discharge, which is one of the methods carried out in the charging step, accumulates on the surface of the latent image carrying member, the charging properties and photosensitivity properties deteriorate, which tends to lead to deterioration in latent image carrying and so forth.

In order to solve such inconveniences, a configuration has been proposed wherein air subjected to humidity adjustment is supplied into the developing device as discussed in Japanese Unexamined Patent Application Publication No. 6-19293.

Also, the developing agent carried by the developing sleeve within the developing device is brought into contact with the photosensitive member in the state that the portion of the developing device facing the photosensitive member which is the latent image carrying member is opened to the atmosphere, but the air near the surface of the photosensitive member and the developing sleeve following the rotation thereof due to viscosity, and create a following airflow. Accordingly, the developing agent moving within the developing device may scatter toner due to reduction of pressure at the portion opened to the atmosphere, owing to the following airflow being released.

Conventionally, configurations for preventing scattering of toner have included a configuration wherein the interior of the developing device is shielded by bringing an elastic seal or the like into contact with the position on the developing sleeve which has passed the position of supplying developing agent to the photosensitive member, and a configuration comprising an electroconductive roller which can perform electrostatic adsorption of toner scattered on the perimeter of the developing sleeve which has passed the developing position and toner which would scatter from the opening as discussed in Japanese Unexamined Patent Application Publication No. 5-66663.

On the other hand, as a configuration for preventing scattering of toner due to toner being blown out owing to increased pressure within the developing device from the following airflow generated accompanying the movement of the photosensitive member and the developing sleeve, there is a configuration wherein an exhaust unit is provided partway along the channel where the developing agent which has separated from the developing sleeve flows as discussed in Japanese Unexamined Patent Application Publication No. 2002-244432.

Also, with image formation apparatuses such as photocopiers or printers or facsimile apparatuses or printing apparatuses, visible image processing is performed by developing an electrostatic latent image formed on a photosensitive member used as a latent image carrying member with toner in a developing agent.

One-component or two-component developing agents are used with developing devices, and with either developing agent, a developing sleeve which is the carrying member for the developing agent, a developing agent stirring/mixing member, and further a layer thickness restricting member for restricting the thickness of the developing agent, are provided, and these components are disposed within a housing forming the shell of the developing device.

The developing sleeve is arranged so that a portion of the surface thereof is exposed from an opening provided to the housing, thereby bringing the developing agent on the surface thereof into contact with the photosensitive member.

Now, it is known that in the event of performing visible image processing wherein an electrostatic latent image formed on a photosensitive member is developed, the charging properties of the developing agent supplied affect the image concentration and gradient reproducibility. One of the factors causing change in the charging properties of the developing agent is the environmental ambient atmosphere, humidity in particular.

On the other hand, as for inconveniences occurring at the time of forming images, there are adverse effects of discharge products generated at the time of charging the photosensitive member. That is to say, in the event that discharge products such as NOx and the like adhere to the surface of the photosensitive member, the charging properties and photosensitivity properties are affected, leading to deterioration of the photosensitive member.

In order to solve such inconveniences, a configuration has been proposed wherein air subjected to humidity adjustment is supplied into the developing device as discussed in Japanese Unexamined Patent Application Publication No. 6-19293.

Further, the configuration of the developing device is such that a developing sleeve, a developing agent stirring/mixing member, and a layer thickness restricting member for restricting the thickness of the developing agent, are stored within a housing, with only a part of the developing sleeve exposed outwards, but the a developing sleeve and the developing agent stirring/mixing member are rotational members, and accordingly members which drag air at the surface layer portion thereof due to the rotations thereof and generate airflow. This changes the pressure within the housing, and due to a tendency to particularly become high pressure, residual toner carried on the developing sleeve following passing through the developing region configured at the portion facing the photosensitive member may scatter out from the opening of the housing, due to the increased pressure within the housing. Scattering of toner from the housing side results in inviting soiling of peripheral units, primarily the photosensitive member. Also, as a configuration for preventing scattering of toner on the developing sleeve following passing through the developing region, there is a configuration wherein the gap between the wall of the housing at the position where the developing sleeve is stored which faces the developing sleeve, and the developing sleeve, is formed greater than the gap between the wall of the housing and the photosensitive member at the position where the photosensitive member faces the wall of the housing as discussed in Japanese Unexamined Patent Application Publication No. 11-7191.

In this configuration, the toner on the developing sleeve which has passed through the developing region is readily taken into the housing using the tendency for the pressure therein to become negative, due to the increase in area occurring at the time of reaching the gap between the developing sleeve and the housing wall, which is set so as to be wider than the gap between the developing sleeve and the photosensitive member.

Further, separately from this configuration, there is a configuration wherein a carrier collecting roller is provided at a position behind the developing sleeve in the direction of movement of the photosensitive member, with the carrier collecting roller being set so as to rotate in a direction such that the portion thereof facing the developing sleeve moves in the same direction at that position, and with the gap between the carrier collecting roller and the photosensitive member at the portion facing one another being used as a gap through which air can flow as discussed in Japanese Unexamined Patent Application Publication No. 10-3220.

With this configuration, the airflow generated by rotations of the carrier collecting roller is set as the direction in which air flows through the gap where the carrier collecting roller faces the photosensitive member, by creating the tendency for the pressure to become negative at the facing gap, thereby sucking the toner which has passed through the developing region into the housing.

With the developing device disclosed in Patent Document 1, developing agent carried out the surface of the developing agent carrying member is restricted to a predetermined thickness by a developing agent restricting member due to the developing agent carrying member rotating, and thus is transported to the developing region. A fixed magnet is disposed within the developing agent carrying member at the portion from the developing agent restricting member to the developing region. Accordingly, in the space surrounded by the inner casing wall and surface of the developing agent carrying member from the developing agent restriction member to the developing region (developing agent transporting space), the developing agent bristles.

As described above, upon the developing agent on the rotating developing agent carrying member bristling, each of the magnetic brushes thereof act as propellers, such that a strong airflow is generated following the surface of the developing agent carrying member, in the direction of rotation of the developing agent carrying member. That is, a strong airflow facing the gap at the upstream side from the developing agent restricting member side is generated in the developing agent transporting space. This strong airflow causes a great amount of gas to enter into the space encompassed by the surface of the developing agent carrying member and the casing inner wall from the developing agent bristling position to the developing region (upstream space), so the pressure increases at the upstream space. Accordingly, in the event that the only way of escape from this upstream space that the gas has is the gap at the upstream side, a strong airflow is generated from the gap at the upstream side toward the outside of the developing device, and toner scattering occurs due to this airflow.

With the developing device disclosed in Patent Document 1, a gap large enough for air to flow through (gas flow space) is formed in the developing agent transporting space, between the tip of the magnetic brush formed of the bristling developing agent and the inner wall of the casing as discussed in Japanese Unexamined Patent Application Publication No. 10-3220. Also, the space adjacent to the downstream side of the developing agent restricting member in the direction of rotation of the developing agent carrying member (doctor-adjacent space) becomes negative pressure in the same way as the developing device disclosed in Patent Document 2, so the gas from the upstream space might seem to be capable of escaping to this doctor-adjacent space besides the gap at the upstream side. However, with the developing agent transporting space, the airflow heading toward the doctor-adjacent space through the gas flow channel, and the airflow heading toward the gap upstream from the magnetic brush, are flowing in mutually opposite directions. Moreover, the airflow heading toward the doctor-adjacent space is greatly inhibited by the viscous resistance of the airflow heading toward the gap at the upstream side, which has been generated by propeller-actions of the bristling developing agent. Accordingly, the gas within the upper space does not flow to the doctor-adjacent space very much, and consequently, almost all of this flows out of the developing device from the gap at the upstream side. Thus, the developing device disclosed in Patent Document 1 cannot be said to sufficiently suppress toner scattering occurring at the space at the upstream side.

On the other hand, with the developing device in Patent Document 2, negative pressure is generated at the doctor-adjacent space according to the description in this Document, stating that an airflow is generated in the first channel space, heading from the gap at the upstream side toward the doctor-adjacent space. In order to generate a strong airflow which can sufficiently suppress scattering of toner generated at the gap at the upstream side, the doctor-adjacent space needs to be under a powerful negative pressure. However, with the developing device according to this Document, the force acting to carrying the airflow out from this doctor-adjacent space is the flow generated accompanying the rotations of the developing agent carrying member in the second channel space, i.e., the surface layer airflow of the developing agent carrying member. The actions of such a surface layer airflow alone cannot yield a negative pressure necessary to sufficiently suppress scattering of the toner in the doctor-adjacent space. Accordingly, the developing device in this Document cannot generate a strong airflow at the gap at the upstream side, and cannot sufficiently suppress toner scattering.

Now, the intensity of the airflow flowing in through the inlet gap is greatly affected by the state of the airflow in the inner space of the casing. For example, in the event that part or all of the flow path of the external air flowing into the inner space of the casing from the inlet gap is closed off by the developing agent, the amount of gas flowing in through the inlet gap per time increment decreases. In such a case, the intensity of the airflow flowing through the inlet gap becomes smaller. This will be described below with reference to a specific example.

FIG. 40 is a schematic configuration diagram illustrating an example of a conventional developing device. The developing agent used in this developing device is made up of a magnetic carrier and a non-magnetic toner. The developing device 4380 has magnetic field generating means 4385 having multiple magnets disposed fixedly within a developing sleeve 4381 which is a developing agent carrying member. The developing agent, which has passed through a developing region where the developing sleeve 4381 and a photosensitive drum 4020 which is the latent image carrying member face one another passes through a channel space B between the inner wall of the casing 4384 and the developing sleeve 4381 in a state of being carried on the surface of the developing sleeve, and is returned to the inner space A of the casing. Subsequently, the developing agent is peeled off from the surface of the developing sleeve by a repelling magnetic field generated by mutually adjacent S-pole magnets 4385*a* and 4385*b*. This peeling occurs as follows. The developing agent T2 on the developing sleeve 4381 which has been transported to the region where it is affected by the repelling magnetic field is kept from integrally moving with the surface of the developing sleeve by this repelling magnetic field, and is retained as shown in the drawing. The retained developing agent T2 is pushed out by the new developing agent being consecutively sent by the rotations of the developing sleeve 4381, and finally falls off due to gravity, whereby peeling occurs. The developing agent T2 which is retained prior to peeling is in a quantitative equilibrium, due to the continuous running of the developing device 4380. In the example shown in the drawing, the channel space B is closed off by the developing agent T2 in this equilibrium state. Moreover, new developing agent is consecutively sent upon this retained developing agent T2, making for a highly dense state in which it is extremely difficult for air to pass through. In this way, the channel space B closed off by the developing agent T2 is a channel for external air to flow into the inner space A of the casing 4381 from the inlet gap C between the lower edge portion 4384*a* of the opening of the casing 4384 and the surface of the photosensitive drum 4020. Accordingly, the flow passing through this inlet gap C does not occur any more.

Also, in the event that a source for generating an airflow which would disturb the air flow, for example, exists in the inner space of the casing, the amount of gas flowing in through the inlet gap decreases per time increment, whereby the intensity of the airflow flowing through the inlet gap decreases. Describing with reference to the example of the developing device shown in FIG. 40, the developing device 4380 has two transporting screws 4382*a* and 4382*b*. The transporting screws 4382*a* and 4382*b* transporting the developing agent in mutually opposite directions, following the direction of the rotating axis of the developing sleeve 4381. Now, the developing sleeve 4381 rotates, and accordingly, a surface layer airflow generated by the viscosity of the air exists near the surface of the developing sleeve. Accordingly, in the event that the channel path B is not completely closed off by the developing agent T2, the external air which has flowed in from the inlet gap C can enter into the inner space A of the casing 4384 through the channel space B, due to the surface layer airflow. The external air which has entered the inner space A of the casing 4381 then is sent further into the inner space A by the surface layer airflow of the developing sleeve 4381. However, upon the developing agent being transported by the transporting screws 4382*a* and 4382*b*, a surface layer airflow is also generated on the surface of the developing agent being transported. The direction of flow of this surface layer airflow is a direction parallel to the rotational axis direction of the transporting screws 4382*a* and 4382*b*, i.e., a direction parallel to the rotational axis direction of the developing sleeve 4381, which is a direction orthogonal to the direction of flow of the surface layer airflow from the developing sleeve 4381. Accordingly, the airflow generated by the surface layer airflow of the developing sleeve 4381 attempting to send the external air deeper into the inner space A is disturbed by the surface layer flow of the developing agent being transported by the transporting screws 4382*a* and 4382*b*. In the event that this airflow is disturbed, the external air cannot readily be sent to the deeper part of the inner space A, meaning that the airflow within the channel space B becomes stagnant, and the magnitude of the airflow flowing in through the inlet gap C becomes small.

In this way, in the event that the airflow flowing in through the inlet gap C does not occur or the intensity of the airflow becomes small, the toner scattering suppression effects of the airflow disappear or deteriorate, causing a problem in that toner scattering cannot be sufficiently suppressed.

Examples of methods which can be conceived to solve this problem include a configuration wherein the developing agent T2 does not close off part or all of the channel space B, or removing the source of the airflow which disturbs the airflow. However, such methods require substantial changes in design of the developing device itself, or restrict the functions of the developing device.

Further, in a configuration wherein the environmental atmosphere around the photosensitive member is adjusted, particularly regarding humidity, and then introduced, exchanging air in a space where toner having a relatively low charged state is floating, in a short time without using forced exhausting means or the like, is difficult. Accordingly, using forced airflow generating means such as a pump or the like may be conceived, but this configuration increases the pressure within the developing device, and consequently invites scattering of toner.

On the other hand, in the event of providing an exhausting mechanism for preventing scattering of toner, this is relatively effective in cases wherein the airflow is simple in motion, such as in cases wherein the stirring means using a paddle or the like which become the source of the airflow within the developing device is singular, but in the event of using stirring means configured of multiple screw augers in order to deal with reduction in size which is in demand in recent years, the airflow generated by the stirring means is not simple since the direction of moving of the developing agent is orthogonal to the direction of motion of the developing sleeve, and for example, generating an airflow at the stirring means in the direction of suctioning the toner which is beginning to scatter becomes difficult, and sufficient suctioning cannot be performed since the pressure for suctioning is weak, and consequently, scattering of the toner cannot be completely suppressed.

Causes inviting increased pressure within the developing device other than the airflow generated by the stirring means, include the air viscously adhering to the developing agent. Viscously adhering air exists around the developing agent, and there is a portion where the amount of air increases along with the movement of the developing agent within the developing device which is a closed-off space except for one portion, and this leads to increased internal pressure.

FIG. 41 is a schematic diagram illustrating the configuration of a process cartridge comprising a developing device, and the internal pressure increasing phenomena described above will be described with reference to this drawing. With the developing device 4000B disposed within the process cartridge 4000A shown in FIG. 41, in the event that a developing sleeve 4000B1 rotates in the direction indicated by the arrow in the drawing, the residual toner 4000T0 on the perimeter of the developing sleeve 4000B1 which has passed the developing region where the magnetic brush is made to face the photosensitive member 4000C and to come into contact therewith, moves along with the rotations of the developing sleeve 4000B1. The residual toner 4000T0 falls off of the developing sleeve 4000B1 due to the repelling magnetic filed due to magnets 4000D1 and 4000D2 of the same polarity which are disposed within the developing sleeve 4000B1.

On the other hand, a screw member 4000E for drawing up the stirred developing agent to the developing sleeve 4000B1 is provided near the developing sleeve 4000B1, and the surface layer air which moves along with the rotations of the screw member 4000E is concentrated a the position where the toner is repelled and falls off of the developing sleeve 4000B1. Accordingly, at the position where the developing sleeve 4000B1 and the screw member 4000E face one another, the pressure increases due to the density of the air increasing owing to the surface layer air of both being collected at this position, whereby the pressure increases at the range past the developing region in the direction of rotation of the developing sleeve 4000B1. Accordingly, the toner suctioning operations, due to the negative force generated in the downstream direction of motion of the magnetic brush remaining on the developing sleeve 4000B1, are not performed suitably. Consequently, toner scattering preventive actions due to the above-described negative pressure cannot be effectively obtained.

Further, in the event of suctioning the toner past the developing region into the housing of the developing device due to the tendency for the pressure to become negative, suctioning due to negative pressure can be made in the event that all of the toner in the developing agent carried in a bristled state on the surface of the developing sleeve behaves in the same way, but in reality, the behavior in movement differs between the tip of the brush and the surface side of the developing sleeve.

FIG. 42 is a model diagram illustrating the way in which the developing agent moves, passing through the developing region, under negative pressure from the housing side. In FIG. 42, the developing agent which has passed through the developing region moves by being carried by the developing sleeve 4000B1, but there are cases wherein the developing agent at the tip of the brush is scraped off due to the shock of coming into contact with the wall face of the housing facing the developing sleeve 4000B1. The developing agent bristling on the surface of the developing sleeve generates moment in accordance with the rotations of the developing sleeve. Accordingly, the developing agent situated at the tip of the brush is subjected to greater shock at the time of coming into contact with the wall face of the housing as compared to the base side of the brush, so part of the developing agent more readily falls off at the time of being subjected to shock. The toner contained in the developing agent readily falls of and floats upon being subjected to shock in the event that the charge has weakened following passing through the developing region. Such toner may scatter outside from the housing due to the effects of the airflow which will be described alter.

The airflow at the surface of the developing sleeve at the time of the developing sleeve 4000B1 rotating is uniform at the surface of the developing sleeve, but the flow of the air following around at the tip side of the developing agent which is bristling is in a relation opposite to that so far, due to the reactive force (collision force) received upon coming into contact with the wall face of the housing. Particularly, the airflow at the time of coming into contact with the wall face of the housing is the opposite to the airflow at the developing sleeve surface side, also due to effects of the viscosity with the wall face, and the speed thereof may be instantaneously negated.

At the tip of the brush where such a phenomenon is occurring, in the event that there is a tendency for negative pressure to occur a the position that the developing agent, which has passed through the developing region by pumping due to movement of the developing agent, enters the housing, the developing agent flows backwards toward the position that the developing agent enters the housing due to the negative pressing, as shown in FIG. 43 (indicated as airflow blowing out in FIG. 43).

At the position where the developing agent enters the housing, the surrounding air (the airflow denoted by reference numeral 4000PS in FIG. 42) has a tendency to be taken in as shown in FIG. 42, using the pumping action of the developing agent carried on the developing sleeve, so the air taken in mixes with the air moving along with the developing agent reversing direction of flow on the surface of the developing sleeve 4000B1 and readily generates turbulence, so the toner convecting due to this disturbance scatters outside of the housing upon being affected by air moving along with the movement of the photosensitive member (the airflow denoted by reference numeral 4000PS1 in FIG. 42).

Consequently, part of the toner contained in the developing agent which has passed through the developing region may scatter again from the housing, leading to a situation wherein the reduction in pressure to prevent scattering may instead cause scattering of toner.

Accordingly, the present invention has been made in light of the background in which various technical problems exist, and it is a first object thereof to provide a developing device and an image formation apparatus whereby effects of suppressing scattering of toner which occurs at the upstream side of the developing region as described above can be improved.

Also, it is a second object of the present invention to provide a developing device, an image formation apparatus, and a process cartridge wherein scattering of toner which occurs at the downstream side of the developing region can be suppressed in a stable manner.

SUMMARY

Accordingly, an object of the present invention is to address and resolve the above and other problems and provide a new developing device. The above and other objects are achieved according to the present invention by providing a novel developing device comprising a developing agent carrying member which faces a latent image carrying member and rotates in a direction such that the portion thereof facing the latent image carrying member rotates in the same direction as the latent image carrying member at that position, while carrying on the surface thereof a developing agent containing magnetic particles. A casing is provided to form a developing agent storing space therein for storing developing agent and has an opening whereby a portion of the surface of the developing agent carrying member in the direction of rotation of the developing agent carrying member is made to face the latent image carrying member. A developing agent restricting member is disposed upstream of a developing region within the casing where the developing agent carrying member and the latent image carrying member face one another, such that a gap is formed between the developing agent restricting member and the developing agent carrying member, so as to restrict the amount of developing agent supplied to the developing region, whereby developing is performed by bringing the developing agent on the surface of the developing agent carrying member with the latent image carrying member at the developing region. Magnetic field generating means is provided to generate a magnetic filed such that the developing agent is made to form a magnetic brush so as to close off the space between the surface of the developing agent carrying member and the inner wall of the casing at least one time while the developing agent being carried by the surface of the developing agent carrying member is being carried from the gap to the developing region. A gas exhaust path is provided for exhausting gas, in an upstream space defined by the surface of the developing agent carrying member and the inner wall of the casing upstream in the rotational direction of the developing agent carrying member from the developing region, into the inner space of a device or member employing a structure whereby developing agent existing therein is prevented from scattering within an image formation apparatus, at a position downstream in the rotational direction of the developing agent carrying member from a brush formation position where the developing agent forms a magnetic brush due to the magnetic field generating means.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
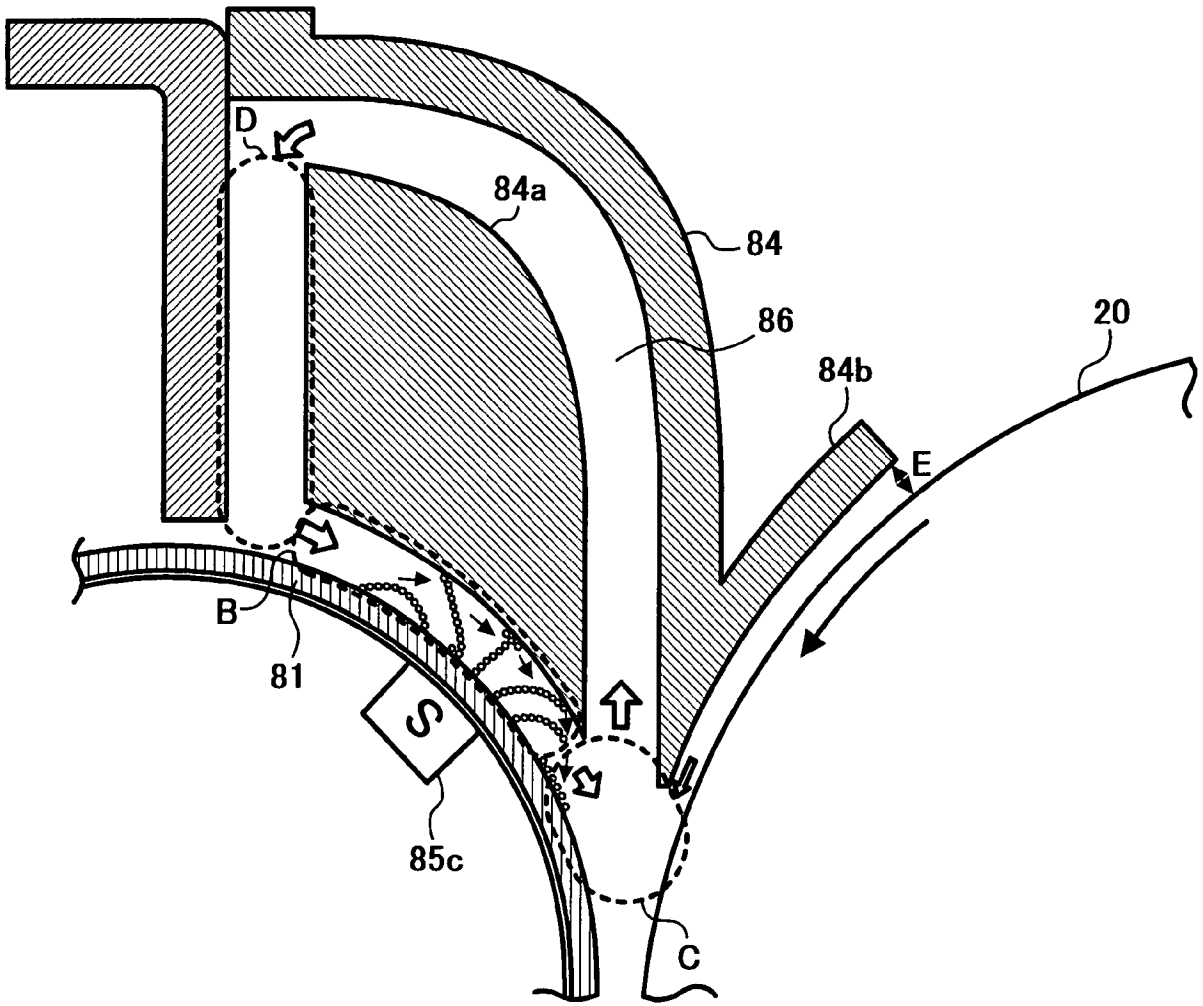
FIG. 1 is an enlarged diagram illustrating around a developing agent transporting space B in a developing device of a photocopier according to the embodiment for solving the first object.

Referring now to the drawings, wherein like reference numerals designate identical or corresponding parts throughout several views. Various embodiments employed in an electrophotography copier (hereafter referred to simply as "photocopier") serving as an image formation apparatus are now described. The photocopier according to the present invention is a so-called tandem-type color photocopier having a photosensitive drum serving as the latent image carrying member for each color, but this present invention is not restricted to this arrangement.

Figure 2:
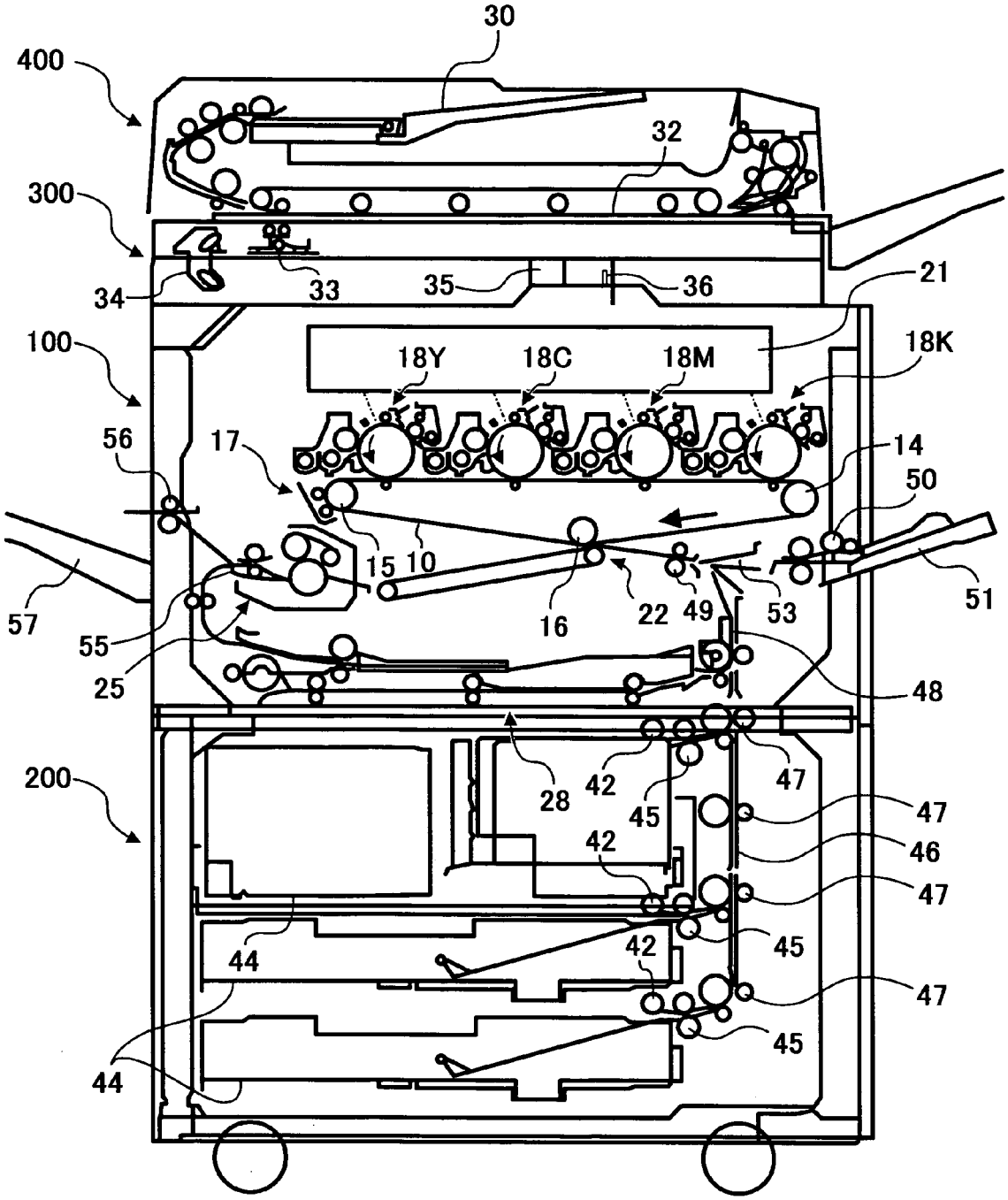
FIG. 2 is a schematic configuration diagram of the entire photocopier.

First, the embodiment for solving the first object of the present invention will be described in detail. First, the overall configuration of the photocopier according to the present embodiment will be described. FIG. 2 is a schematic configuration diagram of the entire photocopier according to the present embodiment. This photocopier is configured of a photocopier main unit 100, a sheet supplying table 200 upon which the photocopier main unit is placed, a scanner 300 attached to the top of the photocopier main unit, and an automatic document feeder (ADF) 400 attached above this scanner.

Figure 3:
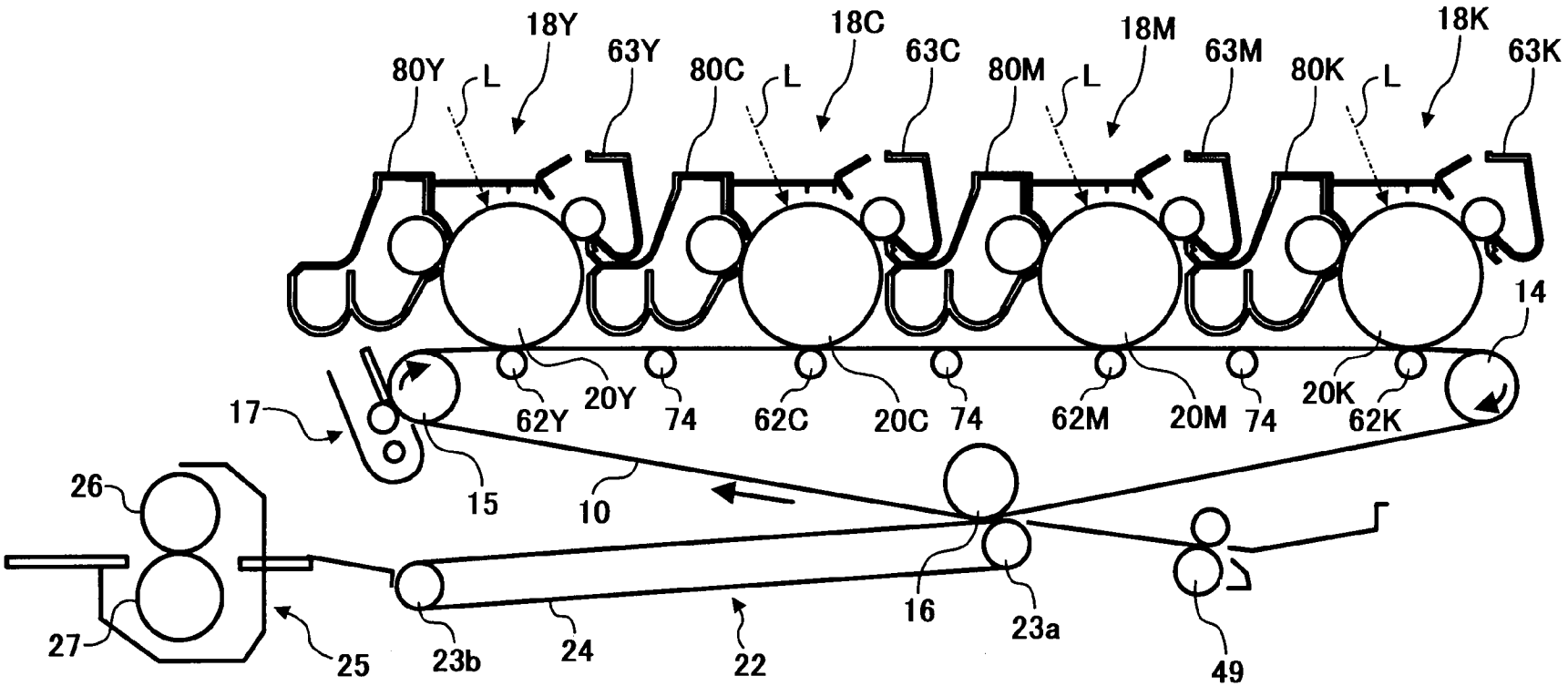
FIG. 3 is an enlarged diagram illustrating the configuration of the main unit portion of the photocopier.

FIG. 3 is an enlarged diagram illustrating the configuration of the photocopier main unit 100 portion. An intermediate transfer belt 10, which is an intermediate transfer member serving as an endless belt-shaped image carrying member, is provided to the photocopier main unit 100. This intermediate transfer belt 10 is strapped over three supporting rollers 14, 15, and 16, and is rotationally driven in the clockwise direction in FIG. 3. Of the supporting rollers, the first supporting roller 14 and the second supporting roller 15 have arrayed therebetween at the portion where the belt is hung, four image formation units 18Y, 18C, 18M, and 18K, for yellow, cyan, magenta, and black. An exposing device 21 is provided above the four image formation units 18Y, 18C, 18M, and 18K, as shown in FIG. 2. The exposing device 21 is for forming electrostatic images on the photosensitive drums 20Y, 20C, 20M, and 20K, serving as the latent image carrying member provided to each of the image formation units, based on the image information read with the scanner 300. Also, a secondary transfer device 22 is provided at a position facing the third supporting roller 16 of the supporting rollers. The secondary transfer device 22 has a configuration wherein an endless belt-shaped secondary transfer belt 24 is hung between two rollers 23*a* and 23*b*. At the time of performing secondary transfer of a toner image on the intermediate transfer belt 10 to a transfer sheet, the secondary transfer belt 24 is pressed against the intermediate transfer belt 10 portion of winding over the third supporting roller 16, thereby performing secondary transfer. Note that a configuration using a transfer roller or non-contact transfer charger, for example, may be used for the secondary transfer device 22 instead of using the secondary transfer belt 24. In the downstream side of the secondary transfer device 22 in the direction of transfer sheet transportation by the secondary transfer belt 24, a fixing device 25 for fixing the toner image transferred onto the transfer sheets is provided. The fixing device 25 has a configuration wherein a pressure roller 27 is pressed against a heating roller 26. Also, a belt cleaning device 17 is provided at a position of the intermediate transfer belt 10 facing the second supporting roller 15 of the supporting rollers. This belt cleaning device 17 is for removing the residual toner reaming on the intermediate transfer belt 10 following transferring the toner image on the intermediate transfer belt 10 onto a transfer sheet serving as a recording medium.

Next, the configuration of the image formation units 18Y, 18C, 18M, and 18K will be described. While the following description will be made using the image formation unit 18K for forming black toner images as an example, the other image formation units 18Y, 18C, and 18M have the same configuration as well.

Figure 4:
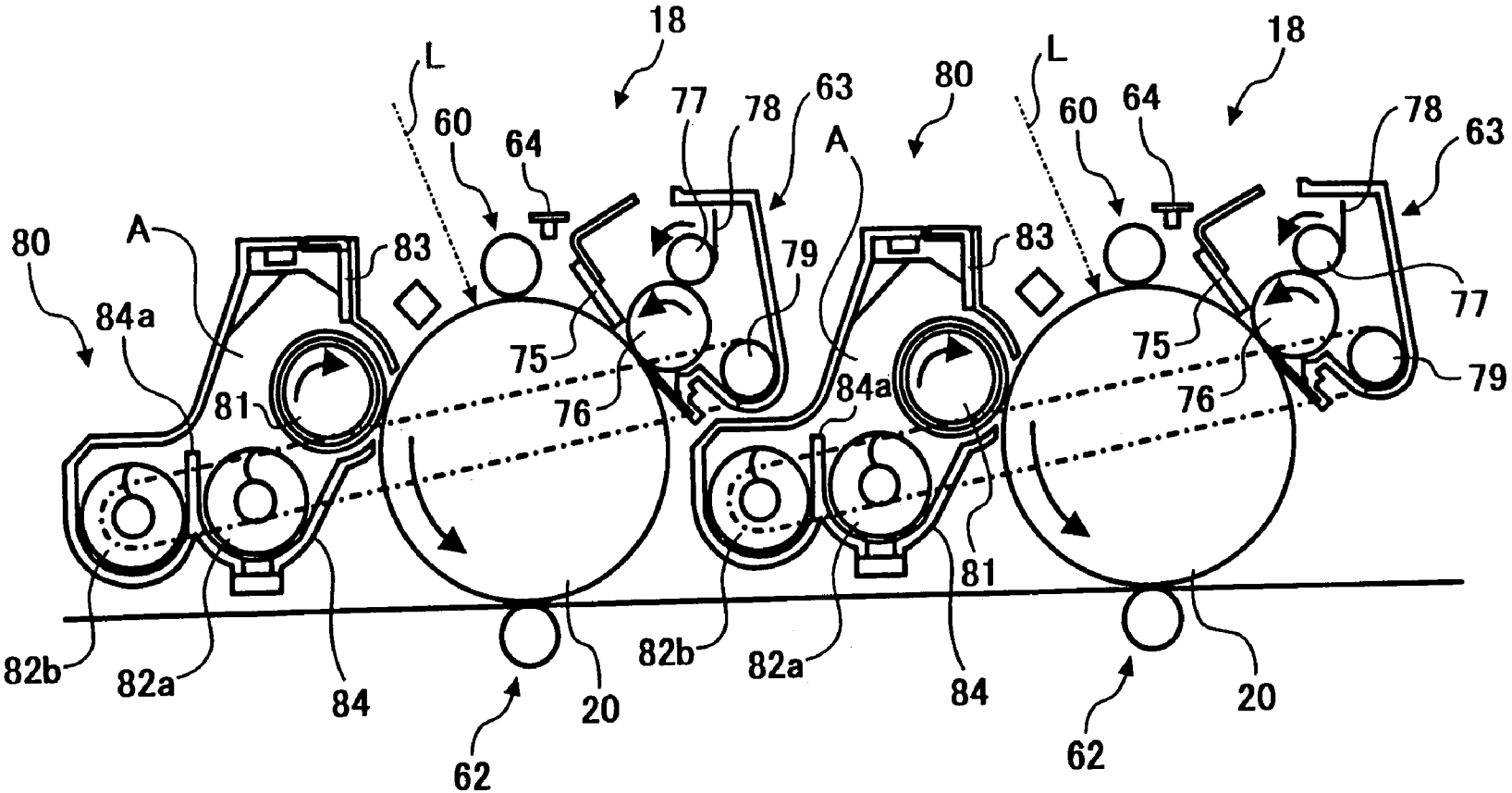
FIG. 4 is an enlarged diagram illustrating the configuration of two image formation units adjacent in the photocopier.

FIG. 4 is an enlarged diagram illustrating the configuration of two adjacent image formation units 18M and 18K. Note that in the drawing, the characters "M" and "K" indicating the different colors are omitted from the reference numerals, and the reference numerals will be abbreviated as suitable in the following description also.

The image formation unit 18 has a charging device 60, developing device 80, and photosensitive member cleaning device 63 provided around the photosensitive drum 20. Also, a primary transfer device 62 is provided at a position facing the photosensitive drum 20 across the intermediate transfer belt 10.

The charging device 60 is a contact charging type device using a charging roller, and uniformly charges the surface of the photosensitive drum 20 by applying voltage thereto. The charging device 60 may also be a non-contact charging type using a non-contact scorotron charger or the like.

Also, the developing device 80 may use a single-component developing agent, but with the present embodiment, a two-component developing agent is used which is made up of magnetic carrier and non-magnetic toner. This developing device 80 has a casing 84 having an opening whereby a portion of the surface of the developing sleeve 81 serving as the developing agent carrying member faces the photosensitive drum 20. The interior of the casing 84 has an inner space A formed as a developing agent storage space for storing the two-component developing agent (hereafter referred to simply as "developing agent"). The developing sleeve 81 carrying the developing agent on the surface thereof, and the photosensitive drum 20 rotate such that the surfaces of each are moving in the same direction at the position of closest proximity. Two transporting screws 82*a* and 82*b* serving as transporting members for transporting the developing agent in the axial direction of the rotation of the developing sleeve 81 are provided in the inner space A. The two transporting screws 82*a* and 82*b* rotate fins fixed to a rotating shaft, thereby transporting the developing agent in a direction parallel to the rotational direction of the developing sleeve 81, while stirring the developing agent. Note that the transporting screws 82*a* and 82*b* are configured so as to transport the developing agent in mutually opposite directions. A partition 84*a* formed integrally with the casing 84 is formed between the two transporting screws 82*a* and 82*b* such that they communicate with each other at the end portions in the direction of the rotating axis of the developing sleeve. Accordingly, moving paths are formed at the end portions of the transporting screws 82*a* and 82*b*, whereby developing agent which has been transported to the transportation ending end portion of one of the transporting screws 82*a* and 82*b* is moved to the transportation starting end portion of the other of the transporting screws 82*a* and 82*b*. Accordingly, upon the developing agent being transported to the transportation ending end portion by the transporting screws 82*a* and 82*b*, the developing agent is moved to the side of the other of the transporting screws 82*a* and 82*b* through the moving path, and then transported in the opposite direction, so that the developing agent circulates through the inner space A. The configuration and operations of the developing device 80 will be described in detail later.

Also, the primary transfer device 62 uses a primary transfer roller, and is disposed so as to press against the photosensitive drum 20 across the intermediate transfer belt 10. The primary transfer device 62 may be an electroconductive brush-shaped device or a non-contact corona charger or the like, instead of the roller shaped device.

Also, the photosensitive member cleaning device 63 has a cleaning blade 75 formed of polyurethane rubber for example, disposed such that the tip is pressed against the photosensitive drum 20. Also, with the present embodiment, an electroconductive fur brush 76 which comes into contact with the photosensitive drum 20 is also used, in order to improve the cleaning capabilities. A bias is applied to this fur brush 76 from a metal electric field roller 77, with the tip of a scraper 78 pressed against the electric field roller 77. The toner removed from the photosensitive drum 20 by the cleaning blade 75 and fur brush 76 is stored within the photosensitive member cleaning device 63. Subsequently, this is shunted to one side of the photosensitive member cleaning device 63 by a recovery screw 79, returned to the developing device 80 via an unshown toner recycling device, and is reused.

Also, a discharge device 64 is configured of a discharge lamp, and irradiates light to initialize the surface potential of the photosensitive drum 20.

With an image formation unit 18 having the above-described configuration, the surface of the photosensitive drum 20 is uniformly charged by the charging device 60 as the photosensitive drum 20 rotates. Next, a writing light L is irradiated from an exposing device 21 by a laser beam LED or the like, based on image information read by the scanner 300, thereby forming an electrostatic latent image on the photosensitive drum 20 Subsequently, the electrostatic latent image is visualized by the developing device 80, and a toner image is formed. This toner image is subjected to primary transfer onto the intermediate transfer belt 10 by the primary transfer device 62. Any transfer-residual toner remaining on the surface of the photosensitive drum 20 following the primary transfer is removed by the photosensitive member cleaning device 63, following which the surface of the photosensitive drum 20 is discharged by the discharge device 64, and prepared for subsequent image formation.

Next, the operations of the photocopier according to the present embodiment will be described.

In the event of making a copy of an original document using the photocopier having the above-described configuration, first, the document is set on the document table 30 of the Automatic Document Feeder 400 shown in FIG. 2. Or, the Automatic Document Feeder 400 is opened and the document is set on contact glass 32 of the scanner 300, the Automatic Document Feeder 400 is closed, and the document is pressed thereby. Subsequently, upon the user pressing an unshown start switch, the document is transported to the contact glass 32 in the event that the document has been set on the Automatic Document Feeder 400. The scanner 300 is driven, and a first running member 33 and a second running member 34 begin running. Accordingly, light from the first running member 33 is reflected off of the document on the contact glass 32, the reflected light therefrom is reflected by a mirror on the second running member 34, and is guided to a reading sensor 36 via an imaging lens 35. Thus, the image information of the document is read.

Also, upon the user pressing the start switch, an unshown driving motor starts, and one of the supporting rollers 14, 15, and 16 is rotationally driven, so that the intermediate transfer belt 10 is rotationally driven. At the same time, the photosensitive drums 20Y, 20C, 20M, and 20K of the image formation units 18Y, 18C, 18M, and 18K begin rotating. The details of the driving mechanism for the photosensitive drums 20Y, 20C, 20M, and 20K will be described later. Subsequently, writing light L is irradiated from the exposing device 21 onto each of the photosensitive drums 20Y, 20C, 20M, and 20K of the image formation units 18Y, 18C, 18M, and 18K, based on the image information which has been read with the reading sensor 36 of the scanner 300. Accordingly, electrostatic latent images are formed on each of the photosensitive drums 20Y, 20C, 20M, and 20K, which are visualized by the developing devices 80Y, 80C, 80M, and 80K. Thus, yellow, cyan, magenta, and black toner images are formed on the photosensitive drums 20Y, 20C, 20M, and 20K, respectively. The toner images of each color formed thus are each subjected to sequential primary transfer onto the intermediate transfer belt 10 by the primary transfer devices 62Y, 62C, 62M, and 62K. Accordingly, a synthesized toner image, wherein toner images of each color are overlaid, is formed on the intermediate transfer belt 10. Note that the transfer residual toner remaining on the intermediate transfer belt 10 following the secondary transfer is removed by a belt cleaning device 17.

Also, upon the user pressing the start switch, a sheet feeding roller 42 of the sheet supplying table 200 corresponding to the transfer sheet which the user has selected is fed out of one of the sheet supply cassettes 44. The transfer sheet which has been fed out is separated from other sheets so as to become one sheet by a separating roller 45 and enters a sheet supply path 46, and is transported by a transporting roller 47 to a sheet feeding path 48 within the photocopier main unit 100. The transfer sheet thus transported is stopped by abutting against a resist roller 49. In the event of using a transfer sheet not set in a sheet supplying cassette 44, the transfer sheet set on a hand feed tray 51 is fed by a sheet feeding roller 50, which is then transported through a hand feed sheet path 53. In the same way, the sheet is stopped by abutting against the resist roller 49.

The resist roller 49 starts rotating at the timing of the synthesized toner image formed on the intermediate transfer belt 10 as described above being transported to the secondary transfer portion facing the secondary transfer belt 24 of the secondary transfer device 22. Now, the resist roller 49 is generally often grounded, but a bias may be applied for removing paper powder from the transfer sheets. The transfer sheet fed out by the resist roller 49 is fed between the intermediate transfer belt 10 and the secondary transfer belt 24, and the synthesized toner image on the intermediate transfer belt 10 is subjected to secondary transfer onto the transfer sheet by the secondary transfer device 22. Subsequently, the transfer sheet is transported to the fixing device 25 still attached to the secondary transfer belt 24, subjected to application of heat and pressure at the fixing device 25, whereby fixing processing of the toner image is performed. The transfer sheet which has passed through the fixing device 25 is discharged and stacked on a discharge tray 57 by a discharge roller 56. Note that image formation is to be performed on the rear face of the sheet on which the toner image has been fixed, the transporting path for the transfer sheet which has passed through the fixing device 25 is switched by a switching claw 55. The transfer sheet is then fed to a sheet reversal device 28 situated below the secondary \transfer device 22, where it is reversed, and guided to the secondary transfer unit again.

With the present embodiment, the photosensitive drums 20Y, 20C, 20M, and 20K, and the peripheral parts such as the developing devices 80 and the like configure an integrated process cartridge. This process cartridge is detachably mounted to the printer main unit. Accordingly, in the event that parts stored in the process cartridge reach their expected life span, or in the event that maintenance is necessary, all that is necessary is to replace the process cartridge, thereby improving ease of use.

Next, the configuration and operations of the developing device, which is a feature of the present invention, will be described in detail. Note that for each of the image formation units 18Y, 18C, 18M, and 18K, the configurations and operations of the developing devices 80Y, 80C, 80M, and 80K are the same, so hereafter, symbols distinguishing the colors will be omitted from the description.

Figure 5:
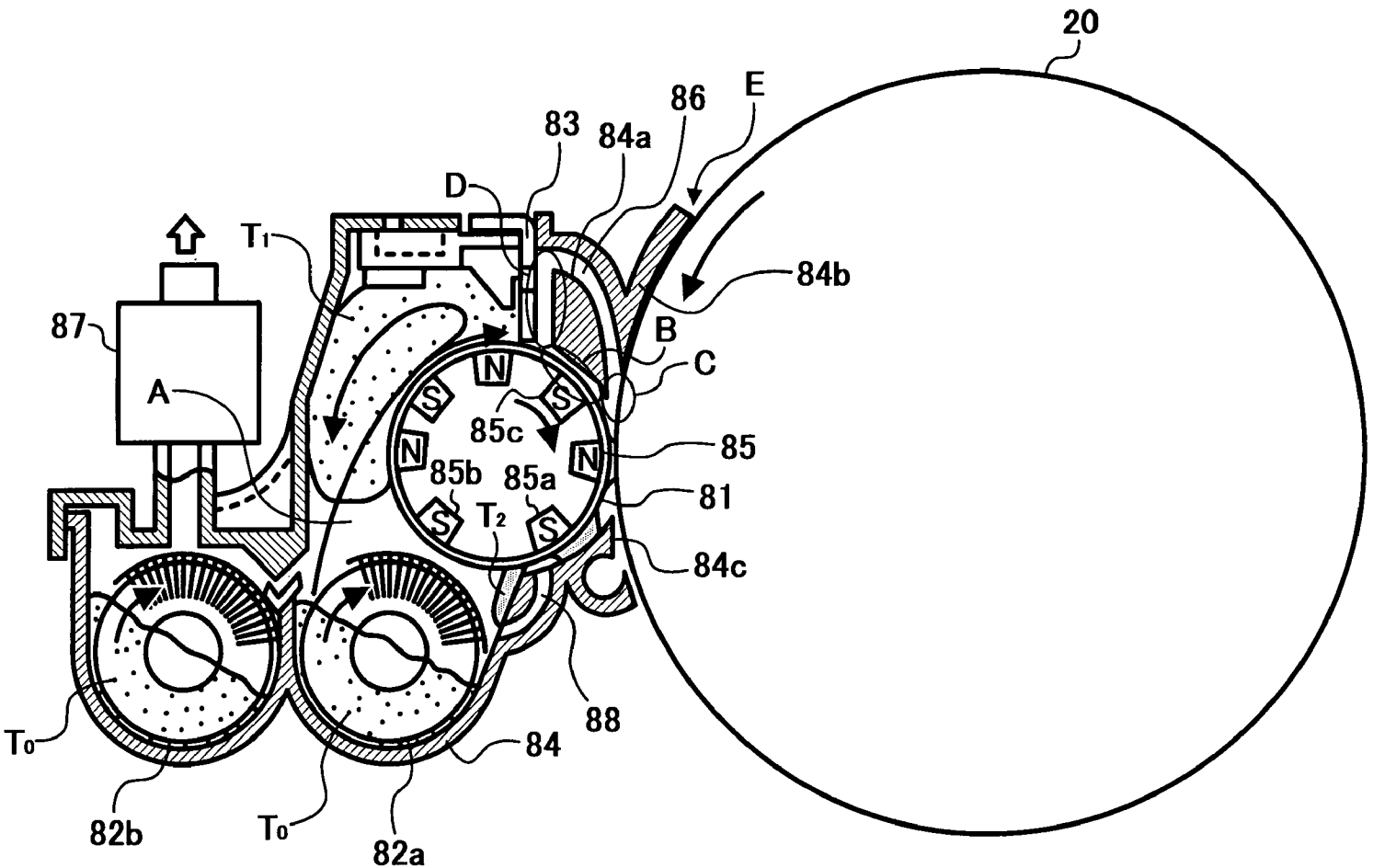
FIG. 5 is a schematic configuration diagram illustrating the developing device.

FIG. 5 is a schematic configuration diagram illustrating a developing device 80 according to the present embodiment.

A magnet roller 85 having multiple magnets is fixedly disposed as a magnetic field generating means within the developing sleeve 81, and the developing sleeve 81 is rotationally driven around the magnet roller 85. The developing agent T0 which is transported and circulated through the inner space A of the casing 84 being stirred by the two transporting screws 82*a* and 82*b* is drawn up to the surface of the developing sleeve 81 under the effects of the magnetic field of the magnet roller 85. Specifically, as shown in FIG. 5, under the effects of the magnetic field of the magnet roller 85, the developing agent T0 is drawn up to the upper portion of the inner space A. The developing agent T1 at this upper portion is then held on the surface of the developing sleeve 81 by magnetic force while circulating at that portion, and is transported as the developing sleeve 81 rotates. This is then restricted to an appropriate amount by a gap (doctor gap) between the tip of a doctor blade 83 serving as a developing agent restricting member and the surface of the developing sleeve 81. The developing agent which has passed through the doctor gap passes through the developing agent transporting space B surrounded by the inner wall of the partition member 84*a* which is a part of the casing 84, and the surface of the developing sleeve, as the developing sleeve 81 rotates, and is transported to the developing region which faces the photosensitive drum 20. On the other hand, the developing agent T1 which was restricted and could not pass through the doctor gap is returned to the upper portion of the internal space A.

The developing agent which has been transported to the developing region in this way is subjected to effects of the magnetic field by the magnet roller 85 and bristles on the surface of the developing sleeve 81, thereby forming a magnetic brush. In this developing region, a developing electric field for moving the toner in the developing agent to the electrostatic latent image portion on the photosensitive drum 20 is formed by the developing bias applied to the developing sleeve 81. Accordingly, the toner within the developing agent moves to the electrostatic latent image portion on the photosensitive drum 20, so that the electrostatic latent image on the photosensitive drum 20 is visualized, and a toner image is formed.

The developing agent which has passed through the developing region passes through the space between the surface of the developing sleeve 81 and the inner wall of the casing 84, as the developing sleeve 81 rotates, and is peeled off of the surface of the developing sleeve 81 by a repelling magnetic field formed by two adjacent magnets 85*a* and 85*b* which are of the same polarity, serving as peeling means provided to the magnet roller 85. Now, the developing agent on the developing sleeve 81 which has been transported to the region where the effects of the repelling magnetic field are present, is prevented from moving integrally with the surface of the developing sleeve 81 due to this repelling magnetic field, and is retained as shown in the drawing. The developing agent T2 retained in this way is pushed out by the new developing agent being consecutively sent by the rotations of the developing sleeve 81, and finally falls due to gravity along the inner wall of the casing, and is taken into the developing agent T0 being transported by the first transporting screw 82*a*.

FIG. 1 is an enlarged diagram illustrating the surroundings of the developing agent transporting space B described above. Also, this enlarged drawing also illustrates the behavior of the magnetic brush near the fixed magnet 85*c*, focusing on one magnetic brush passing through the developing agent transporting space B. The developing agent bristling near the fixed magnet 85*c* in the developing agent transporting space B generates an airflow in the direction illustrated by the hollow arrow in the drawing. Describing this point, as shown in the drawing, the developing agent which moves along with the rotations of the developing sleeve 81 gradually bristles as it approaches the fixed magnet 85*c* and forms a magnetic brush, and the magnetic brush gradually lies down as it departs from the fixed magnet 85*c*. Such behavior of a magnetic brush also functions as a pump for feeding gas near the fixed magnet 85*c* in the developing agent transporting space B in the direction of rotation of the developing sleeve 81. Accordingly, near the fixed magnet 85*c* within the developing agent transporting space B, an airflow following the direction of rotations of the developing sleeve 81 is generated. Due to this airflow, gas flows from the developing agent transporting space B to increased pressure space C which is an upstream space surrounded by the surface of the developing sleeve and the inner wall of the casing, downstream in the direction of rotation of the developing sleeve 81 (hereafter, referred to simply as "downstream side") from the bristling position of the developing agent and upstream in the direction of rotation of the developing sleeve 81 (hereafter, referred to simply as "upstream side") from the developing region. Thus, the pressure of the increased pressure space C is in a high state. Accordingly, the gas within the increased pressure space C attempts to escape from the increased pressure space C.

The developing agent transporting space B is closed off by the bristling developing agent, so the gas within the increased pressure space does not flow toward the developing agent transporting space B. Also, the gap between the surface of the developing sleeve 81 and the surface of the photosensitive drum 20 is closed off by the developing agent bristling with high density at the developing region, so the so the gas within the increased pressure space does not flow toward the developing agent transporting space B. With the present embodiment, a negative pressure space D serving as a developing agent scattering preventive space adjacent to the downstream side of the doctor blade 83 in the direction of rotation of the developing sleeve communicates with the increased pressure space C through a circulation channel 86 serving as a gas exhausting path. This circulation channel 86 has a width equivalent to the axial-direction length of the developing sleeve 81. The gas existing in the negative pressure space D is suctioned into the developing agent transporting space B by the pumping actions of the magnetic brush within the developing agent transporting space B, shown in FIG. 1. Moreover, the doctor gap communicating with the negative pressure space D is closed off by high-density developing agent, so the pressure of the negative pressure space D is low. Accordingly, the pressure difference between the negative pressure space D and the increased pressure space C is very great, and a strong airflow heading from the increased pressure space C toward the negative pressure space D via the circulation channel 86 is generated.

Also, the increased pressure space C communicates with an upstream side gap E formed between the edge 84*b* of the casing opening positioned at the upstream side of the developing region, and the surface of the photosensitive drum 20. At this upstream side gap E, the direction of the surface movement of the photosensitive drum 20 is the direction from the upstream side gap E toward the increased pressure space C, so an airflow is generated at the upstream side gap E which flows from the upstream side gap E toward the increased pressure space C, due to the surface layer airflow of the photosensitive drum 20. As described above, a strong airflow which passes from the developing agent transporting space B to the circulation channel 86 exists at the increased pressure space C, so the airflow from the upstream side gap E toward the increased pressure space C rides on this strong airflow and passes to the circulation channel 86.

Thus, as a result of the airflow flowing through the developing agent transporting space B becoming stronger due to the pumping action of the bristling developing agent within the developing agent transporting space B, the air pressure difference between the increased pressure space C and the negative pressure space D and the airflow flowing from the increased pressure space C to the circulation channel 86 is strengthened, and the airflow heading from the gap at the upstream side toward the increased pressure space C is promoted. That is to say, the flow of the airflow flowing in from outside of the developing device through the upstream side gap E is promoted. Accordingly, the effects of preventing scattering of developing agent or toner within the developing device out from the developing device from the upstream side gap E improve.

Note that with the present embodiment, scattering of toner occurring at the downstream side gap between the opening edge 84*c* of the casing 84 positioned downstream of the developing region and the surface of the photosensitive drum 20 can also be suppressed.

Figure 6:
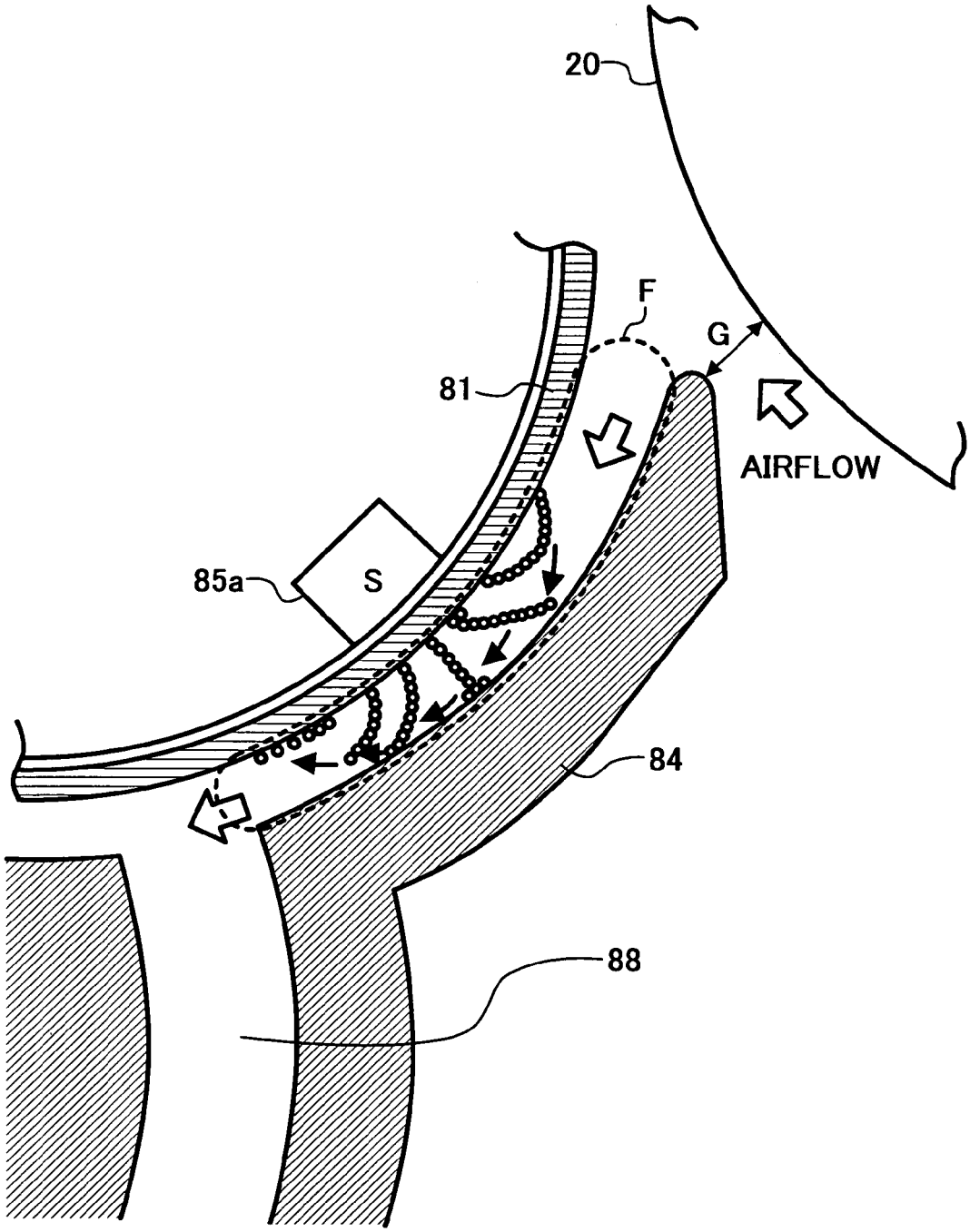
FIG. 6 is an enlarged diagram illustrating around channel space F surrounded by the surface of the developing sleeve downstream of the developing region and the casing inner wall in the developing device.

FIG. 6 is an enlarged diagram illustrating the surroundings of a channel space F surrounded by the surface of the developing sleeve and the inner wall of the casing at the downstream side of the developing region. In the same way as with FIG. 1, the enlarged drawing also illustrates the behavior of the magnetic brush near the fixed magnet 85*a*, focusing on one magnetic brush passing through the channel space F. The developing agent bristling near the fixed magnet 85*a* in the channel space F generates an airflow in the direction illustrated by the hollow arrow in the drawing, as with the case of the developing agent transporting space B.

With the present embodiment, in the region affected by the repelling magnetic field generated by the two adjacent magnets 85*a* and 85*b* of the magnet roller 85 which are of the same polarity, developing agent is retained as shown in FIG. 5. Accordingly, there is the possibility that the flow of gas flowing into the inner space A from outside of the developing device through a downstream side gap G may be obstructed by the retained developing agent T2. However, with the present embodiment, a detour channel 88 is provided for communicating between the inner space A and the channel space F, positioned in the upstream side in the direction of rotations of the developing sleeve, from the portion closed off by the retained developing agent T2. Thus, air in the channel space F flows into the inner space A which is depressurized with a vacuum pump 87. Accordingly, air outside of the developing device flows into the vacuum pump 87 through the downstream side gap G, channel space F, detour channel 88, and inner space A. Due to such a flow of air, effects the same as the scattering prevention effects at the upstream side gap E can be obtained.

Next, a modification using a developing agent scattering prevention space for the increased pressure space C, different from the negative pressure space D, will be described (hereafter, the present modification will be referred to as "first modification"). In the first modification, the inner space of the photosensitive member cleaning device 63 is used as the developing agent scattering prevention space.

Figure 7:
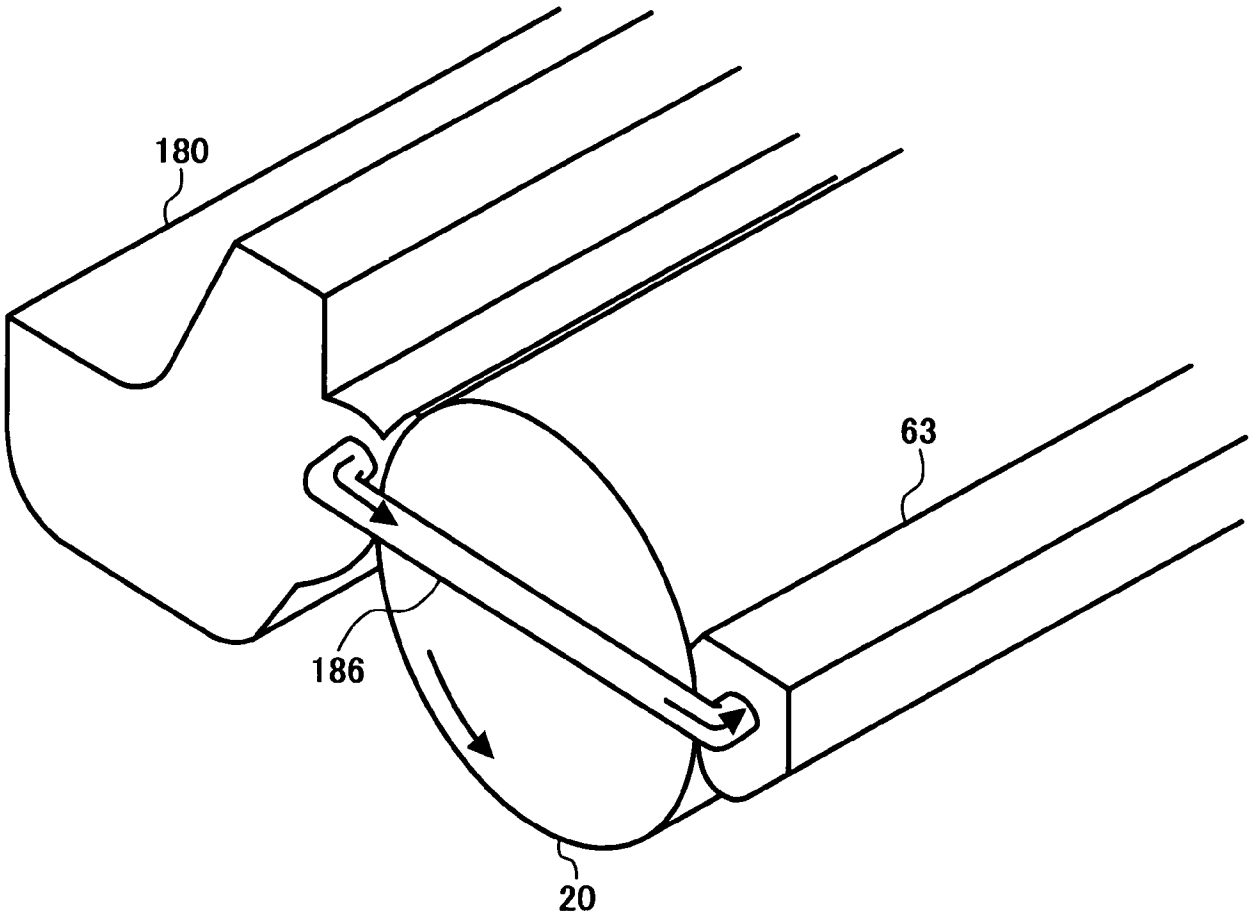
FIG. 7 is a perspective view illustrating around one end of the photosensitive drum in the axial direction, according to a first modification.
Figure 8:
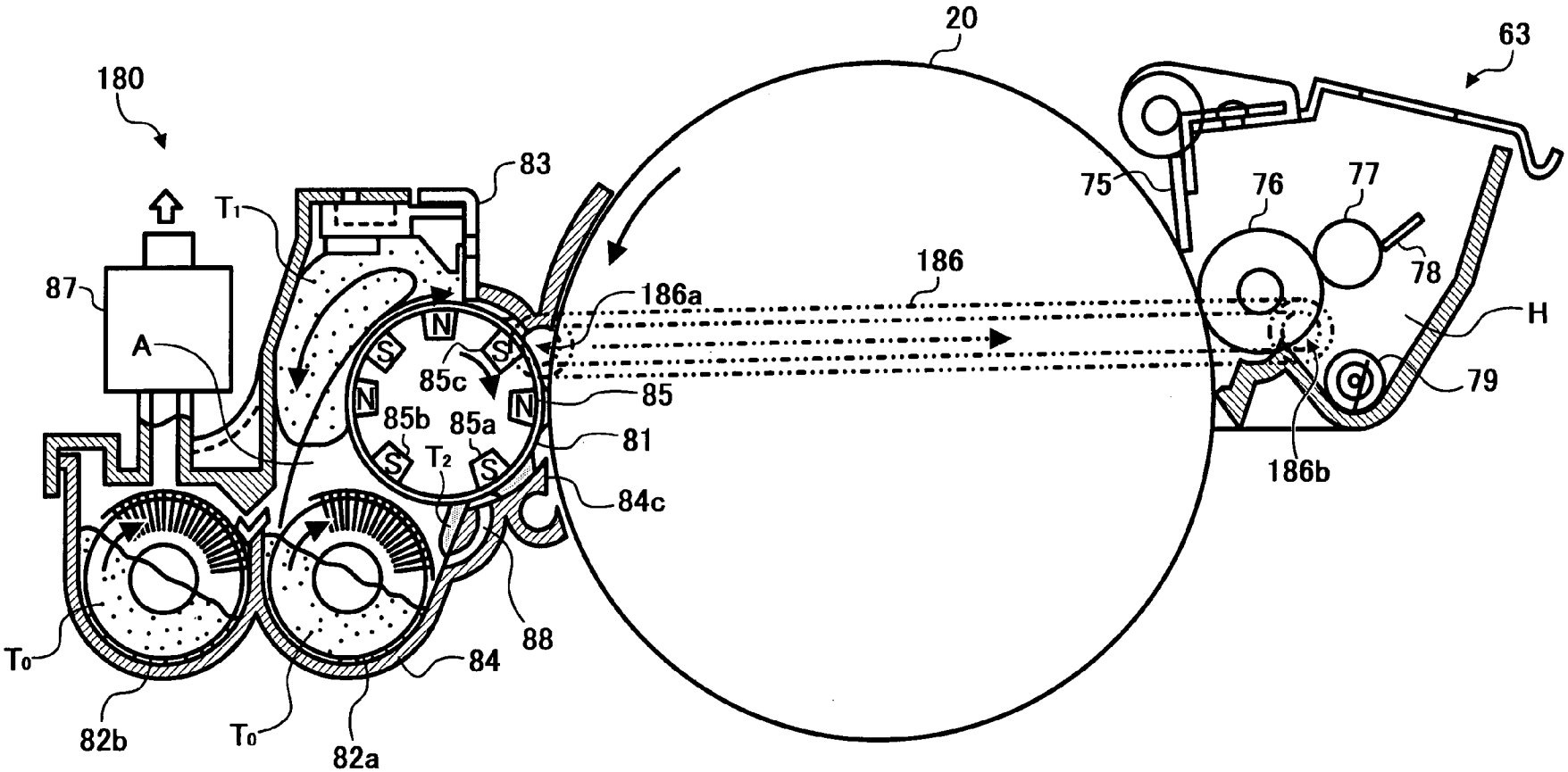
FIG. 8 is an explanatory diagram illustrating the schematic configuration of the developing device and photosensitive member cleaning device as viewed from the axial direction of the photosensitive drum, according to the first modification.

FIG. 7 is a perspective view illustrating the surroundings of one end portion in the axial direction of the photosensitive drum 20 according to this first modification. FIG. 8 is an explanatory view illustrating the schematic configuration of the developing device 180 and the photosensitive member cleaning device 63 as viewed from the axial direction of the photosensitive drum 20 according to this first modification.

As shown in FIG. 8, with the first modification, there is no circulation channel 86 whereby the increased pressure space C and the negative pressure space D communicated, but instead a communicating channel 186 is provided, serving as a gas exhausting path for communicating between the increased pressure space C and internal space H of the photosensitive member cleaning device 63. One end (entrance) 186*a* of the communicating channel 186 opens within the increased pressure space C such that the gas within the increased pressure space C is exhausted from the end of the increased pressure space C in the rotational axis direction of the developing sleeve 81. On the other hand, the other end (exit) 186*b* of the communicating channel 186 opens at the end portion in the axial direction of the photosensitive drum 20 in the inner space H of the photosensitive member cleaning device 63, i.e., at the end portion in the direction of the rotating axis of the developing sleeve.

The photosensitive member cleaning device 63 has a generally airtight structure so that the developing agent collected in the inner space H thereof does not leak out, and further, the developing agent collected in the inner space H is discharged to a waste toner bottle or the like by a recovery screw 79, so the inner pressure is low. That is to say, the inner space H also has low pressure, in the same way as the negative pressure space D in the above embodiment. Accordingly, communicating the inner space H and the increased pressure space C with the communicating channel 186 enables a strong airflow to be generated which flows from the increased pressure space C to the communicating channel 186, there by improving the effects for suppressing scattering of the developing agent or toner within the developing device out of the developing device from the upstream side gap E.

Particularly, with the first modification, the exit 186*b* of the communicating channel 186 is disposed such that the exit 186*b* is rubbed by the end of the fur brush 76 rotating at high speed. This promotes gas flowing out from the exit 186*b* of the communicating channel 186. Accordingly, the airflow flowing from the increased pressure space C to the communicating channel 186 is made stronger, further increasing the effects for suppressing scattering of the developing agent or toner within the developing device out of the developing device from the upstream side gap E.

Also, around the end portion of the increased pressure space C, the airflow in unstable due to the existence of the wall face in the rotation axis direction of the developing sleeve making up the increased pressure space C. Accordingly, even with the configuration described in the above embodiment, there is the possibility that developing agent or toner might scatter out from the developing device from the end of the increased pressure space C through the upstream side gap E. Conversely, with the first modification, a configuration is made wherein the gas within the increased pressure space C is discharged from the end of the increased pressure space C in the rotation axis direction of the developing sleeve 81. Accordingly, an airflow is generated within the increased pressure space C which flows from the end of the increased pressure space C to the communicating channel 186. Consequently, the unstable airflow near the end of the inside of the increased pressure space C is rectified so as to head toward the entrance 186*a* of the communicating channel 186. Accordingly, scattering of developing agent or toner out from the developing device from the end of the increased pressure space C through the upstream side gap E does not readily occur, and the overall toner scattering suppressing effects are improved.

Note that with the first modification, two communicating channels 186 are provided, with the entrances 186*a* of each of the communicating channels 186 opening at both end portions of the increased pressure space C in the rotation axis direction of the developing sleeve 81. Accordingly, effects for suppressing scattering of toner can be further improved.

Note that the cleaning device which recovers the developing agent adhering to the object to be cleaned usually has a generally airtight structure, and has a configuration wherein the developing agent collected therein is discharged to a waste toner bottle or the like. Accordingly, in addition to the photosensitive member cleaning device 63, the pressure of the interior of the cleaning device such as the belt cleaning device 17 or the like also drops. Accordingly, effects the same as the first modification can be obtained by communicating the increased pressure space C with the inner space of the belt cleaning device 17 employing the communicating channels, as well.

Next, another modification using a developing agent scattering prevention space for the increased pressure space C, different from the negative pressure space D and the inner space of the photosensitive member cleaning device 63, will be described (hereafter, the present modification will be referred to as "second modification"). In the second modification, the space downstream from the developing region is used as the developing agent scattering prevention space.

Figure 9:
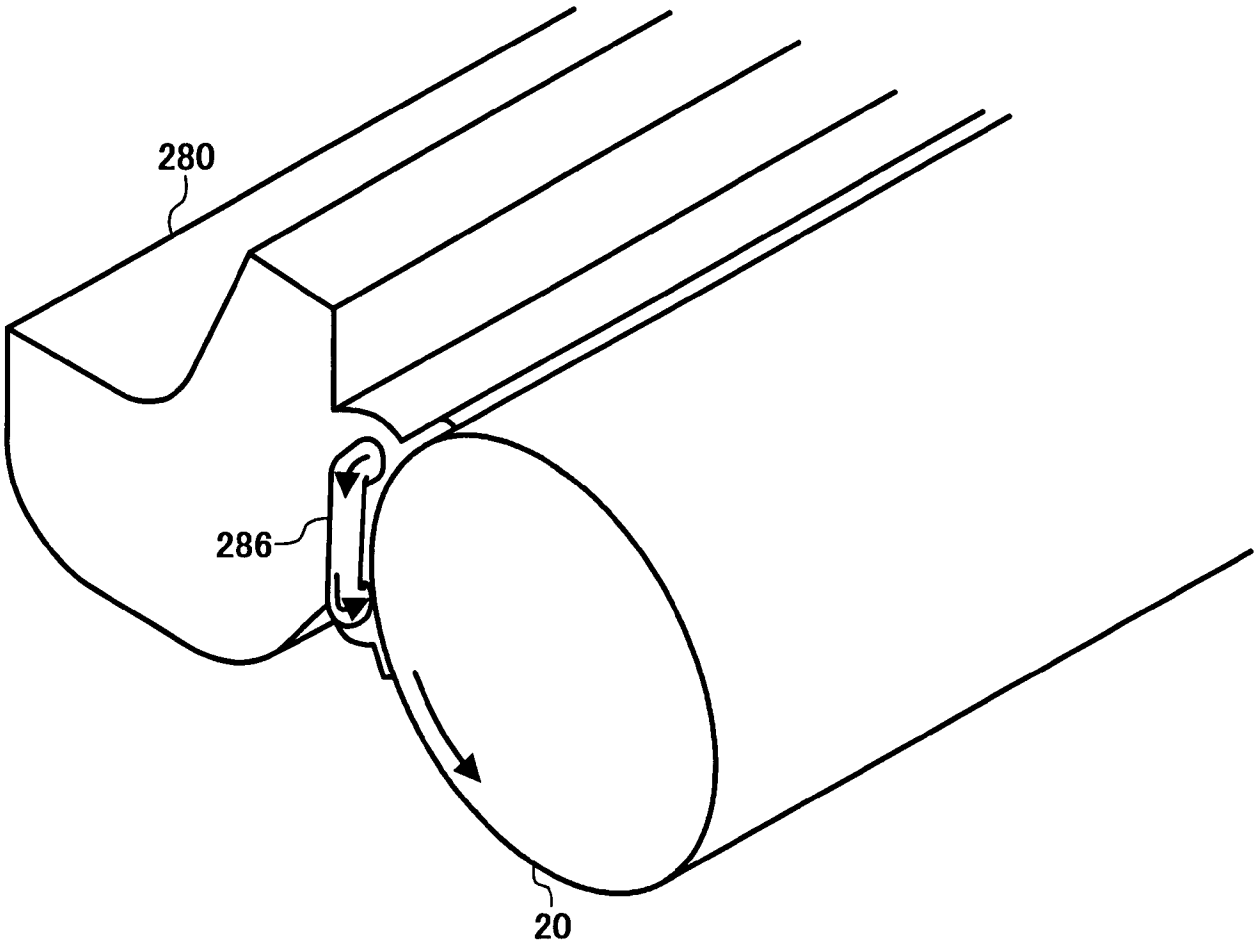
FIG. 9 is a perspective view illustrating around one end of the photosensitive drum in the axial direction, according to a second modification.
Figure 10:
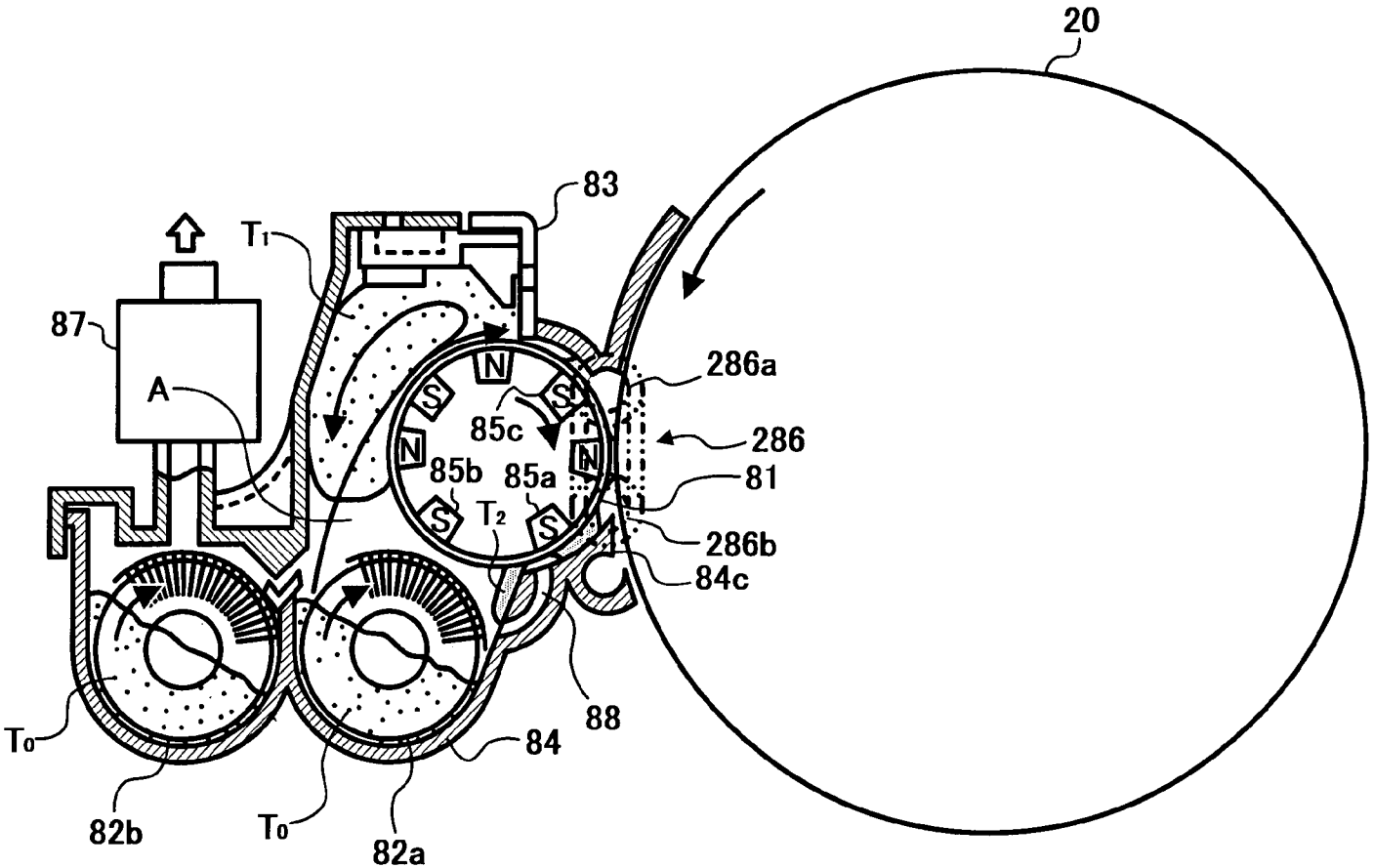
FIG. 10 is an explanatory diagram illustrating the schematic configuration of the developing device viewed from the axial direction of the photosensitive drum, according to the second modification.

FIG. 9 is a perspective diagram illustrating the surroundings of one end in the axial direction of the photosensitive drum 20 according to the second modification. FIG. 10 is an explanatory view illustrating the schematic configuration of the developing device 280 as viewed from the axial direction of the photosensitive drum 20 according to this second modification.

The developing device 280 according to the second modification does not have a circulation channel 86 for communicating the between increased pressure space C and the negative pressure space D, as with the first modification. Instead, with the second modification, a communicating channel 286 is provided, serving as a gas exhausting path for communicating between the increased pressure space C and the channel space F situated downstream of the developing region shown in FIG. 6. One end (entrance) 286*a* of the communicating channel 286 opens within the increased pressure space C such that the gas within the increased pressure space C is exhausted from the end of the increased pressure space C in the rotational axis direction of the developing sleeve 81, as with the first modification. On the other hand, the other end (exit) 286*b* of the communicating channel 286 opens at the end portion in the rotation axial direction of the developing sleeve 81 in the channel space F.

As described above, an airflow heading toward the inner space A which is in a negative pressure state exists in the channel space F. Accordingly, communicating this channel space F with the increased pressure space C by the communicating channel 286 enables a strong airflow to be generated which flows out from the increased pressure space C to the communicating channel 286, as with the above-described embodiment and the first modification. Accordingly, the effects of preventing scattering of developing agent or toner within the developing device out from the developing device from the upstream side gap E improve. Moreover, as with the first modification, a configuration is made wherein the gas within the increased pressure space C is discharged from the end of the increased pressure space C in the rotation axis direction of the developing sleeve 81 through the communicating channel 286. Accordingly, the unstable airflow near the end of the inside of the increased pressure space C is rectified so as to head toward the entrance 286*a* of the communicating channel 286, whereby the overall toner scattering suppressing effects are improved. As with the first modification, two communicating channels 286 are provided with the second modification, with the entrances 286*a* of each of the communicating channels 286 opening at both end portions of the increased pressure space C in the rotation axis direction of the developing sleeve 81. Accordingly, effects for suppressing scattering of toner can be further improved.

Note that while the second modification has the exits 286*b* of the communicating channels 286 opened in the channel space F, the same effects can be obtained by opening these immediately beneath the downstream side of the developing region partway along the detour path 88, or into the inner space A.

Figure 11:
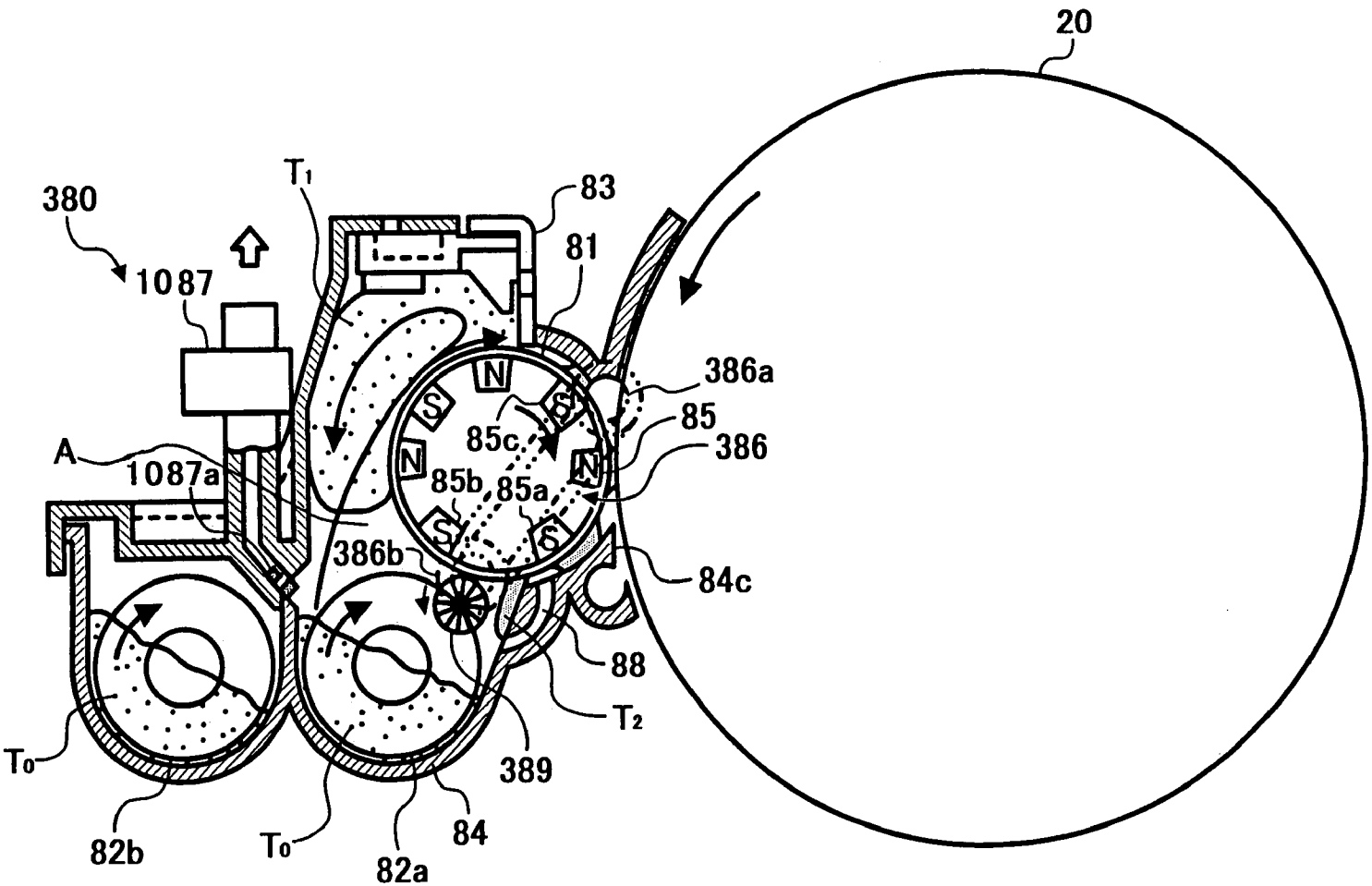
FIG. 11 is a schematic configuration of another configuration example of the developing device in the second modification.

For example, a brush roller 389 is disposed within the inner space A which rotates next to the first transporting screw 82*a* such that the surfaces of each are moving in the same direction at the position of closest proximity, and the exit 386*b* of the communicating channel 386 is disposed so that the end of the brush roller 386 rubs against the exit 386*b*, as with the developing device 380 shown in FIG. 11. Accordingly, gas flowing out from the exit 386*b* of the communicating channel 386 is promoted as with the case in the first modification, and the effects of preventing scattering of developing agent or toner within the developing device out from the developing device from the upstream side gap E further improve. Also, the brush roller 389 rotates with the developing sleeve 81 such that the surfaces of each are moving in the same direction at the position of closest proximity, so the flow of the airflow heading from the detour channel 88 to the vacuum pump 87 through the inner space A is promoted by the surface airflow of the brush roller 389. Accordingly, the effects of preventing scattering of developing agent or toner within the developing device out from the developing device from the downstream side gap G also improve. Further, positioning the brush roller 389 such that the tip of the brush comes into contact with the surface of the developing sleeve 81 enables developing agent which could not be peeled off of the developing agent with the repelling magnetic field to be scraped off.

As described above, the developing devices 80, 180, 280, and 380 according to the present embodiment have a developing sleeve 81 serving as a developing agent carrying member which faces the photosensitive drum 20 serving as the latent image carrying member and rotates with the photosensitive drum 20 such that the surfaces of each are moving in the same direction at the position of closest proximity, in a state of carrying the developing agent T1 on the surface thereof. Also, casing 84 is provided, having an inner space A serving as a developing agent storing space for storing developing agent therein, and an opening for allowing a part of the surface of the developing sleeve to face the photosensitive drum 20. Also, this developing device is disposed so as to form a gap (doctor gap) between the surface of the developing sleeve within the casing 84 at the upstream side in the direction of rotation of the developing sleeve from the developing region where the developing sleeve 81 and the photosensitive drum 20 face one another, and a doctor blade 83 serving as a developing agent restricting member for restricting the amount of developing agent to be supplied to the developing region. The developing device performs developing by bringing the developing agent on the surface of the developing sleeve into contact with the surface of the photosensitive drum in the developing region. Also, in the present embodiment, the developing devices 80, 180, 280, and 380 have a fixed magnet 85*c* of a magnet roller 85 serving as magnetic field generating means for generating a magnetic filed for causing developing agent to bristle so as to close off between the surface of the developing sleeve and the inner wall of a partitioning member 84*a* which is a part of the casing 84, at least one time while the developing agent is being transported from the doctor gap to the developing region by being carried on the surface of the developing sleeve 81. Accordingly, a strong airflow heading from the doctor gap toward the developing region is generated by the pumping actions of the bristling developing agent, and the pressure in the increased pressure space C which is an upstream space surrounded by the surface of the developing sleeve downstream in the developing sleeve rotation direction from the position where the developing agent bristles but upstream from the developing region, and the inner wall of the partitioning member 84*a* increase. The developing device 80 described first in the embodiment has a circulation channel 86 serving as a gas exhausting path for exhausting gas within the increased pressure space C to the negative pressure space D, as the developing agent scatting prevention space. Also, the developing device 180 described as the first modification has a communicating channel 186 which is a gas exhausting path for exhausting into the inner space H of the photosensitive member cleaning device 63 as the developing agent scattering prevention space. Also, the developing device 280 described as the second modification has a communicating channel 286 which is a gas exhausting path for exhausting into the channel space F as the developing agent scattering prevention space. Also, the developing device 380 described as an example in the second modification has a communicating channel 386 which is a gas exhausting path for exhausting into the inner space A of the casing 84 as the developing agent scattering prevention space. Providing such gas exhausting paths allows the gas within the increased pressure space C to pass through the gas exhausting channels 86, 186, 286, and 386 and on into the developing agent scattering preventive spaces, instead of flowing out from the upstream side gap E.

Particularly, in the first modification and the second modification, the entrances 186*a*, 286*a*, and 386*a* of the communicating channels 186, 286, and 386 are opened into the increased pressure space C, so that the gas within the increased pressure space C is exhausted from the end of the increased pressure space C in the direction of the axis of the developing sleeve. Thus, as described above, the unstable airflow near the end of the inside of the increased pressure space C is rectified so as to head toward the entrance of the communicating channel, whereby the overall toner scattering suppressing effects for suppressing scattering of toner occurring in the upstream side gap E are improved.

Also, two of the communicating channels 186, 286 and 386 are provided with the first modification and the second modification, with the entrances of each of the communicating channels opening at both end portions of the increased pressure space C such that the gas within the increased pressure space C is exhausted from the end of the increased pressure space C in the rotation axis direction of the developing sleeve through each of the communicating channels. Accordingly, effects for suppressing scattering of toner occurring in the upstream side gap E can be further improved, as described above.

Also, with the developing device 80 described at first with the embodiment, the negative pressure space D, adjacent at the downstream side of the doctor blade 83 in the direction of rotation of the developing stream, is used as the developing agent scattering preventing space. This negative pressure space D is greatly depressurized by the pumping effects of the developing agent bristling in the developing agent transporting space B as described above, so the gas within the increased pressure space C is exhausted with a strong airflow. Accordingly, scattering of toner occurring in the upstream side gap E can be suppressed effectively. Moreover, the negative pressure space D is near to the increased pressure space C across the developing agent transporting space B, so the path length of the circulation channel 86 for communication therebetween can be reduced, thereby facilitating reduction of loss of airflow flowing out from the increased pressure space C.

Also, with the first modification, the inner space H of the photosensitive member cleaning device 63, which is a cleaning device for recovering the developing agent adhering to an object of cleaning, is used as the developing agent scattering prevention space. The inner space H of the photosensitive member cleaning device 63 is in a negative pressure state as described above, so the gas within the increased pressure space C is exhausted with a strong airflow. Accordingly, scattering of toner occurring in the upstream side gap E can be suppressed effectively. Moreover, the toner floating in the increased pressure space C is generally toner with poor charging properties, so returning such toner into the developing device may cause deterioration of image quality. Conversely, a configuration such as in the first modification wherein the gas within the increased pressure space C is exhausted into the inner space H of the photosensitive member cleaning device 63 allows the toner with poor charging properties to be recovered by the photosensitive member cleaning device 63.

Next, an embodiment for solving the second object of the present invention will be described in detail.

Figure 13:
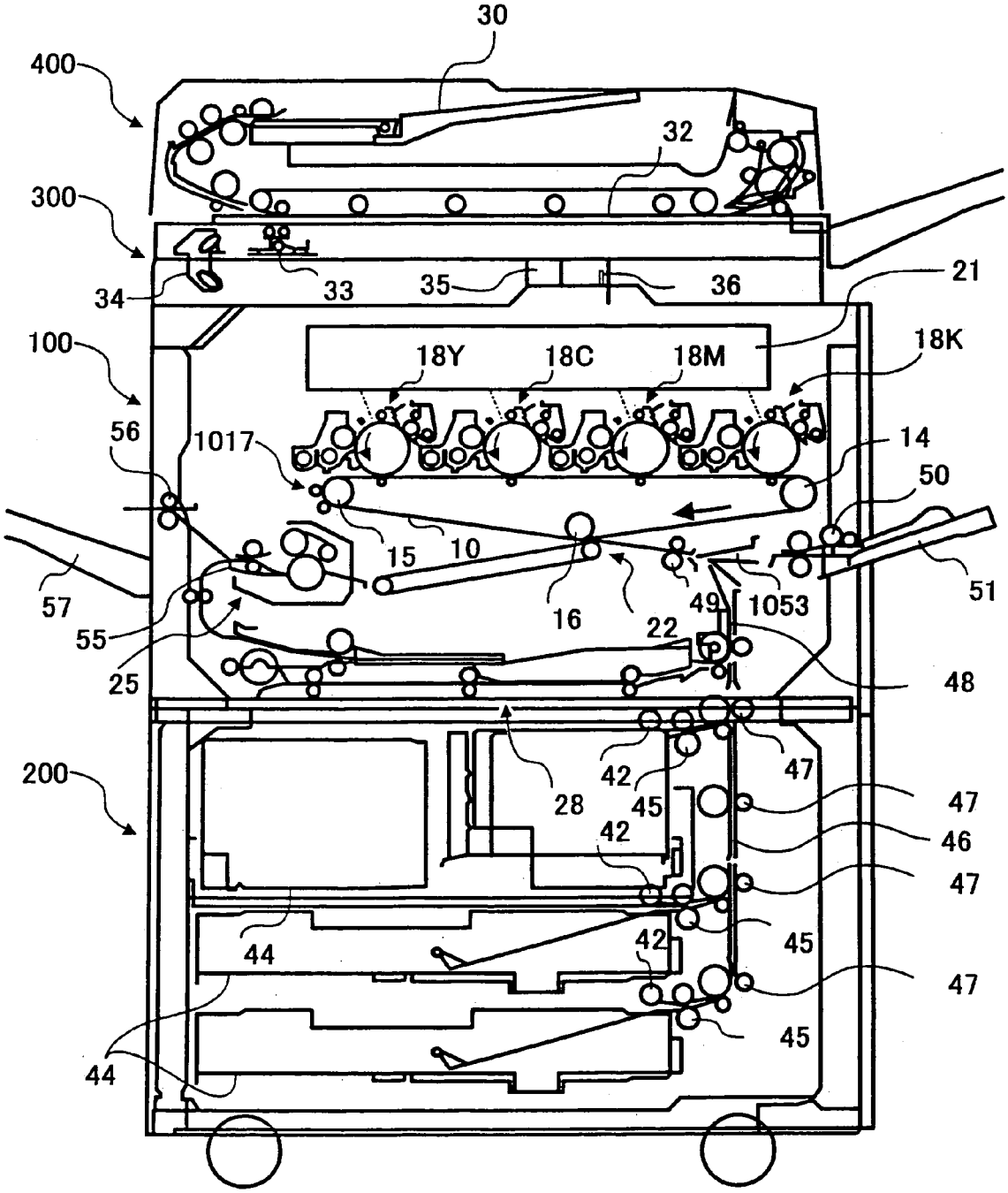
FIG. 13 is a schematic configuration diagram of the entire photocopier.
Figure 14:
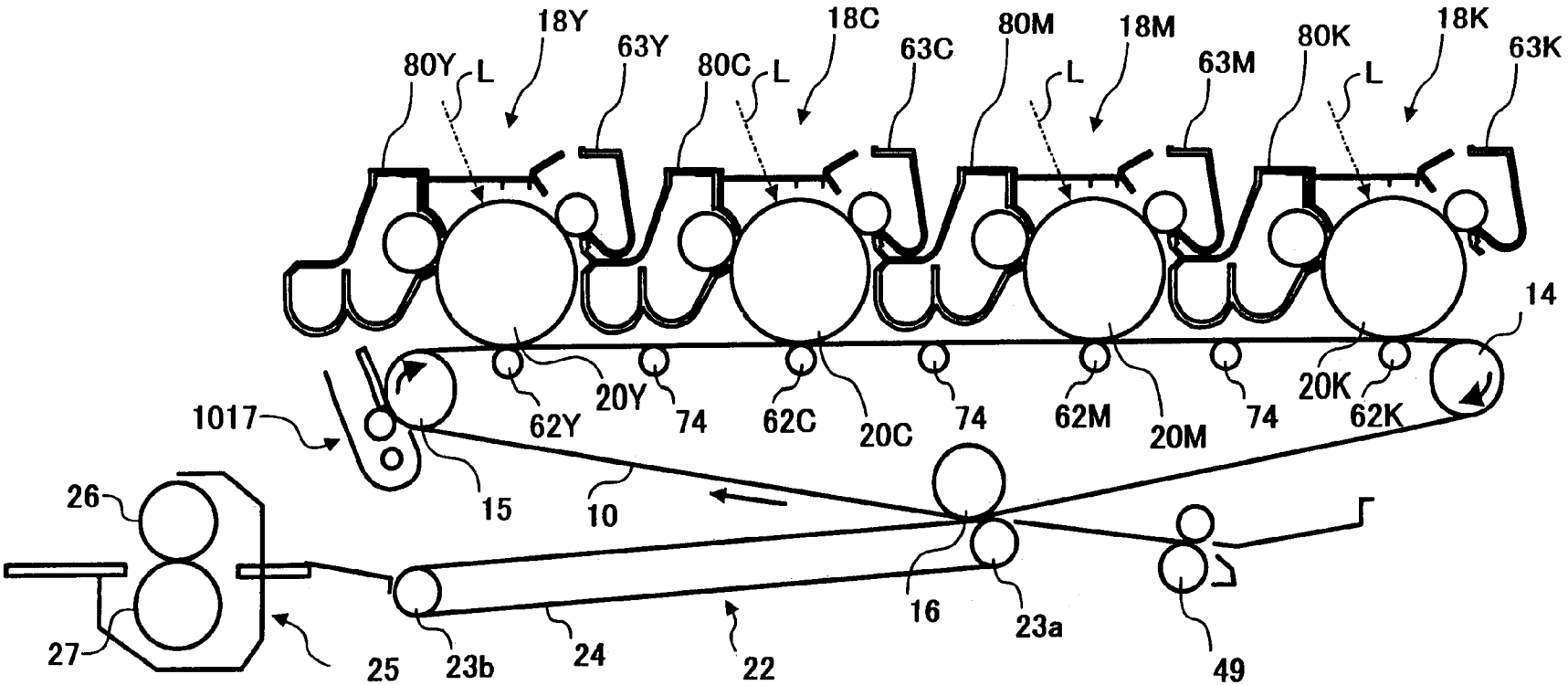
FIG. 14 is an enlarged diagram illustrating the configuration of the main unit portion of the photocopier.
Figure 15:
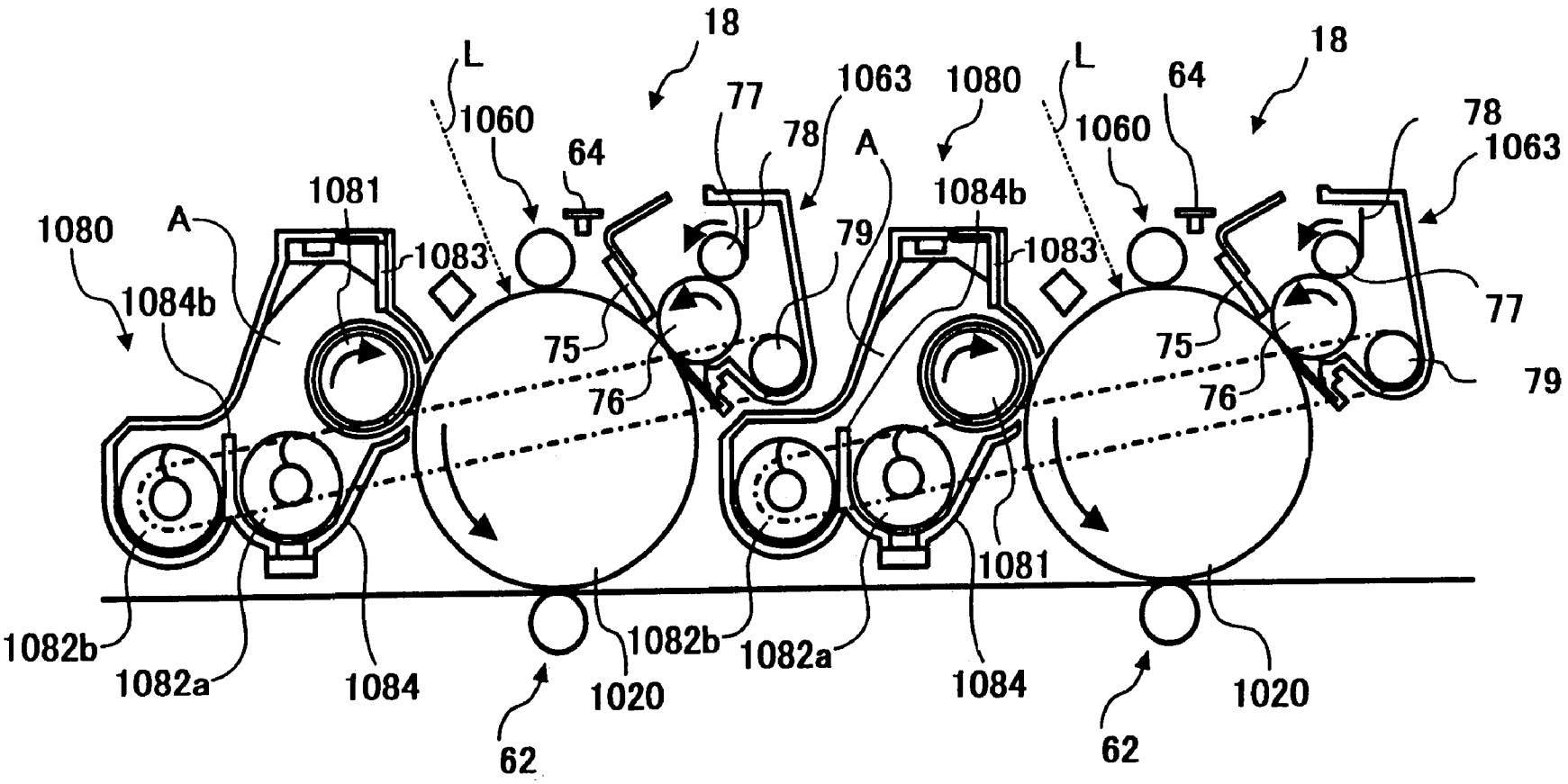
FIG. 15 is an enlarged diagram illustrating the configuration of two image formation units adjacent in the photocopier.

Note that FIG. 13 through FIG. 15 are the same as the already-described FIG. 2 through FIG. 4, so diagrams are shown with some of the reference numerals changed and description will be omitted. The following description will focus on the configuration and operations of the developing device which is the featured portion.

Figure 12:
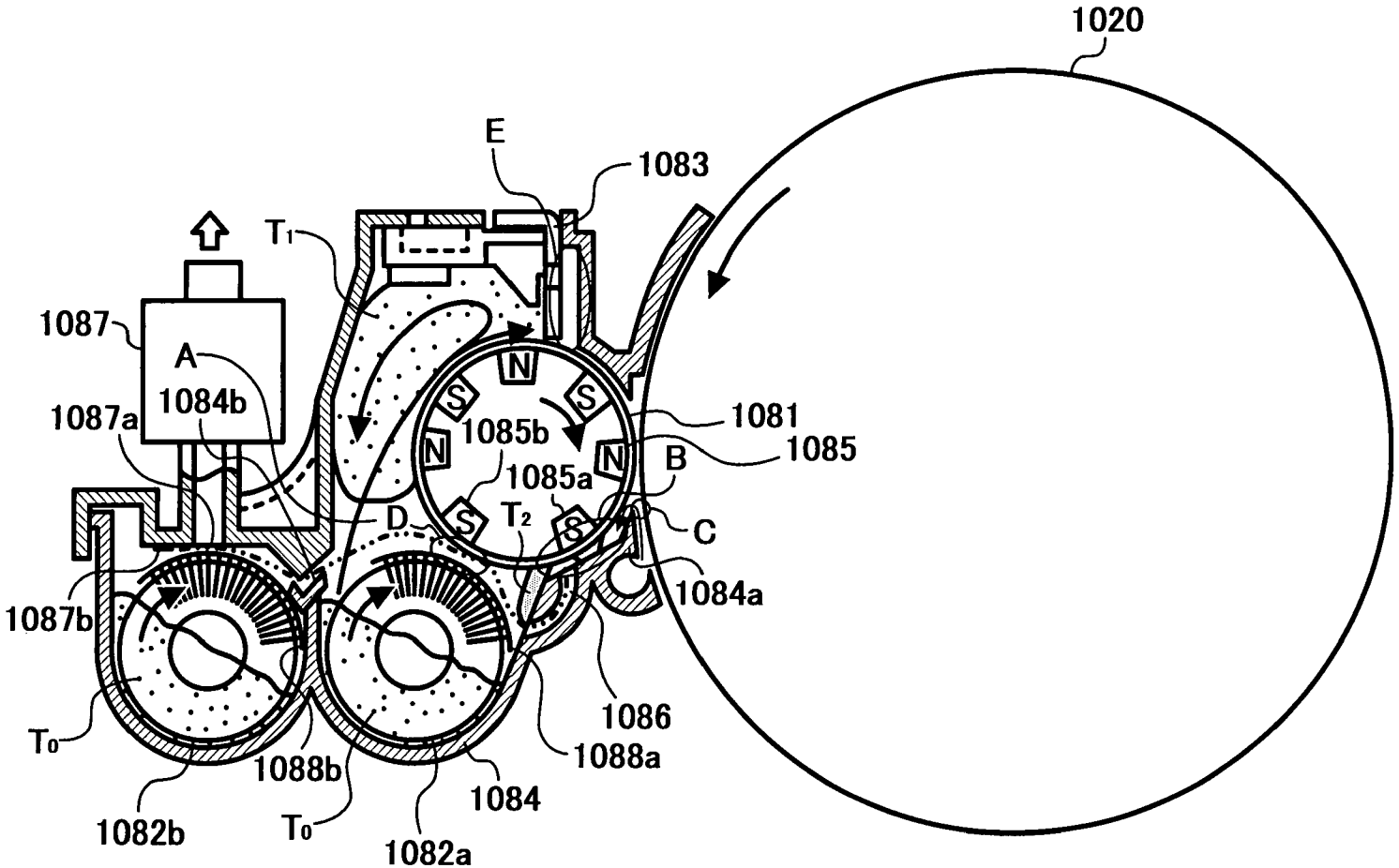
FIG. 12 is a schematic configuration diagram of a developing device of a photocopier according to the embodiment for solving the second object.

FIG. 12 is a schematic configuration diagram illustrating a developing device 1080 according to the present embodiment.

A magnet roller 1085 having multiple magnets is fixedly disposed as a magnetic field generating means within the developing sleeve 1081, and the developing sleeve 1081 is rotationally driven around the magnet roller 1085. The developing agent T0 which is transported and circulated through the inner space A of the casing 1084 while being stirred by the two transporting screws 1082*a* and 1082*b* is drawn up to the surface of the developing sleeve 1081 under the effects of the magnetic field of the magnet roller 1085. Specifically, as shown in FIG. 12, under the effects of the magnetic field of the magnet roller 1085, the developing agent T0 is drawn up to the upper portion of the inner space A. The developing agent T1 at this upper portion is then held on the surface of the developing sleeve 1081 by magnetic force while circulating at that portion, and is transported as the developing sleeve 1081 rotates. This is then restricted to an appropriate amount by a gap (doctor gap) between the tip of a doctor blade 1083 serving as a developing agent restricting member and the surface of the developing sleeve 1081. The developing agent which has passed through the doctor gap as the developing sleeve 1081 rotates is transported to the developing region which faces the photosensitive drum 1020. On the other hand, the developing agent T1 which was restricted and could not pass through the doctor gap is returned to the upper portion of the internal space A.

The developing agent which has been transported to the developing region in this way is subjected to effects of the magnetic field by the magnet roller 1085 and bristles on the surface of the developing sleeve 1081, thereby forming a magnetic brush. In this developing region, a developing electric field for moving the toner in the developing agent to the electrostatic latent image portion on the photosensitive drum 1020 is formed by the developing bias applied to the developing sleeve 1081. Accordingly, the toner within the developing agent moves to the electrostatic latent image portion on the photosensitive drum 1020, so that the electrostatic latent image on the photosensitive drum 1020 is visualized, and a toner image is formed.

The developing agent which has passed through the developing region passes through the channel space B between the surface of the developing sleeve 1081 and the inner wall of the casing 1084, as the developing sleeve 1081 rotates, and is peeled off of the surface of the developing sleeve 1081 by a repelling magnetic field formed by two adjacent magnets 1085*a* and 1085*b* which are of the same polarity, serving as peeling means provided to the magnet roller 1085. Now, the developing agent on the developing sleeve 1081 which has been transported to the region where the effects of the repelling magnetic field are present, is prevented from moving integrally with the surface of the developing sleeve 1081 due to this repelling magnetic field, and is retained as shown in the drawing. The developing agent thus retained closes off the channel B. The developing agent T2 retained in this way is pushed out by the new developing agent being consecutively sent by the rotations of the developing sleeve 1081, and finally falls due to gravity along the inner wall of the casing, and is taken into the developing agent T0 being transported by the first transporting screw 1082*a*.

Accordingly, with the present embodiment, an entrance 1086*a* for a detour channel 1086 which is a second opening, is formed at the inner wall portion of the casing 1084 on the upstream side in the direction of rotation of the developing sleeve 1081, from the position where the developing agent closes off the channel space B, i.e., the position where the developing agent T2 is retained.

Figure 16:
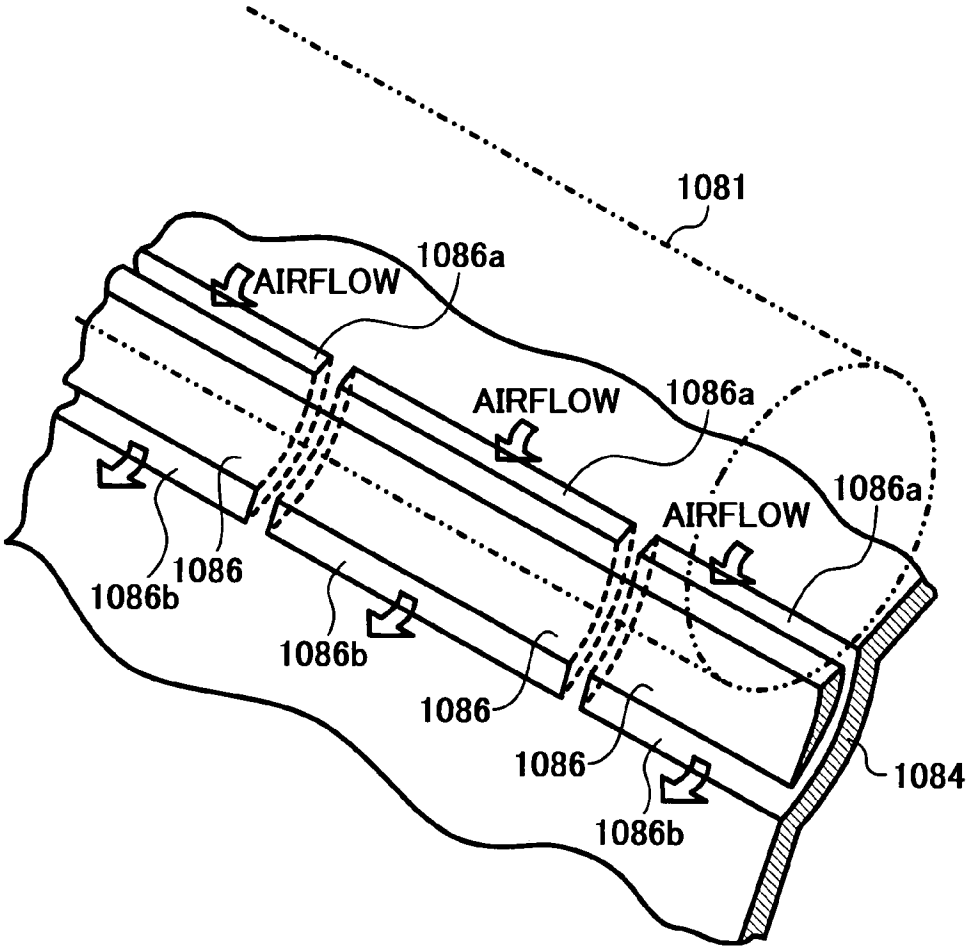
FIG. 16 is an enlarged diagram viewing, from the inner space, a portion in the developing device where developing agent is retained.

FIG. 16 is an enlarged diagram viewing the portion where the developing agent T2 is retained from the inner space A. The detour channel 1086 is a gas exhausting path for exhausting gas within the channel space B through the entrance 1086*a*, and communicates with the inner space A serving as the developing agent scattering preventing space, of the casing 1084, through the exit 1086*b*. With the present embodiment, the detour channel 1086 is formed in the axial direction of the developing sleeve 1081. Moreover, the partition portion between the inner space A and the detour channel 1086 is relatively thin, so there is the possibility that in the event that the partition portion may deform under pressure of the developing agent T2 which is retained under the effects of the repelling magnetic field, thereby making the detour channel 1086 narrower. Particularly the partition portion needs to have insulating properties since it is close to the developing sleeve 1081 to which voltage is applied, and accordingly is generally formed of resin, so it is relatively weak and tends to deform. Accordingly, with the present embodiment, as shown in the drawing, the detour channel 1086 is divided into multiple detour channels 1086 in the rotational axis direction of the developing sleeve 1081. Accordingly, the divided walls between the channels function as ribs, increasing the strength of the partition portion. Note that the same effects can be obtained by forming ribs within a single detour channel 1086 rather than dividing the detour channel 1086 into multiple detour channels 1086. Also, the center portion of the detour channel 1086 in the axis direction of the developing sleeve 1081 is the weakest and deforms the easiest, so in the event that multiple ribs are to be provided, the ribs should be provided at intervals which are closest at the center portion. The center portion has a relatively stable airflow as compared to the end portions, so there is no disturbance of airflow even in the event that the rib intervals are closer than at the end portions.

The inner pressure of the inner space A with which the detour channel 1086 communicates is set lower than the air pressure outside of the causing. Accordingly, the gas within the channel space B flows into the inner space A of the casing 1084 through the detour channel 1086.

Describing this more specifically, with the present embodiment, the suctioning opening 1087*a* of a vacuum pump 1087 serving as suctioning means communicates above the second transporting screw 1082*b* in the inner space A. This vacuum pump 1087 suctions external air into the space serving as the developing agent scattering preventing space from the suctioning opening 1087*a*, and the gas in the space above the second transporting screw 1082*b* is exhausted from the suctioning opening 1087*a* by the vacuum pump 1087. A filter member 1087*b* is attached to the suctioning opening 1087*a*, so there is no exhausting of developing agent along with the gas. Thus, suctioning with the vacuum pump 1087 generates an airflow in the inner space A of the casing 1084 which heads toward the suctioning opening 1087*a* (see FIG. 12).

Now, the inner space A of the casing 1084 communicates with the outside of the device by the gap between the end of the casing 1084 positioned upstream from the developing region and the surface of the photosensitive drum 1020, and the inlet gap C between the end 1084*a* of the casing 1084 downstream from the developing region (see FIG. 17) and the surface of the photosensitive drum 1020. However, the former gap communicates with the inner space A through the doctor gap, and the doctor gap is closed off with highly dense developing agent. Accordingly, external air does not flow in through this gap. Thus, the developing device 1080 according to the present embodiment has a configuration wherein external air can only flow in through the inlet gap C, due to suctioning with the vacuum pump 1087.

Note that in FIG. 12, developing agent bristles near the magnet 1085*a* of the magnet roller 1085, and may appear to close off the channel space B, but the developing agent at this portion does not obstruct the flow of the airflow, but rather promotes the flow of the airflow. This point will be described with reference to FIG. 17.

Figure 17:
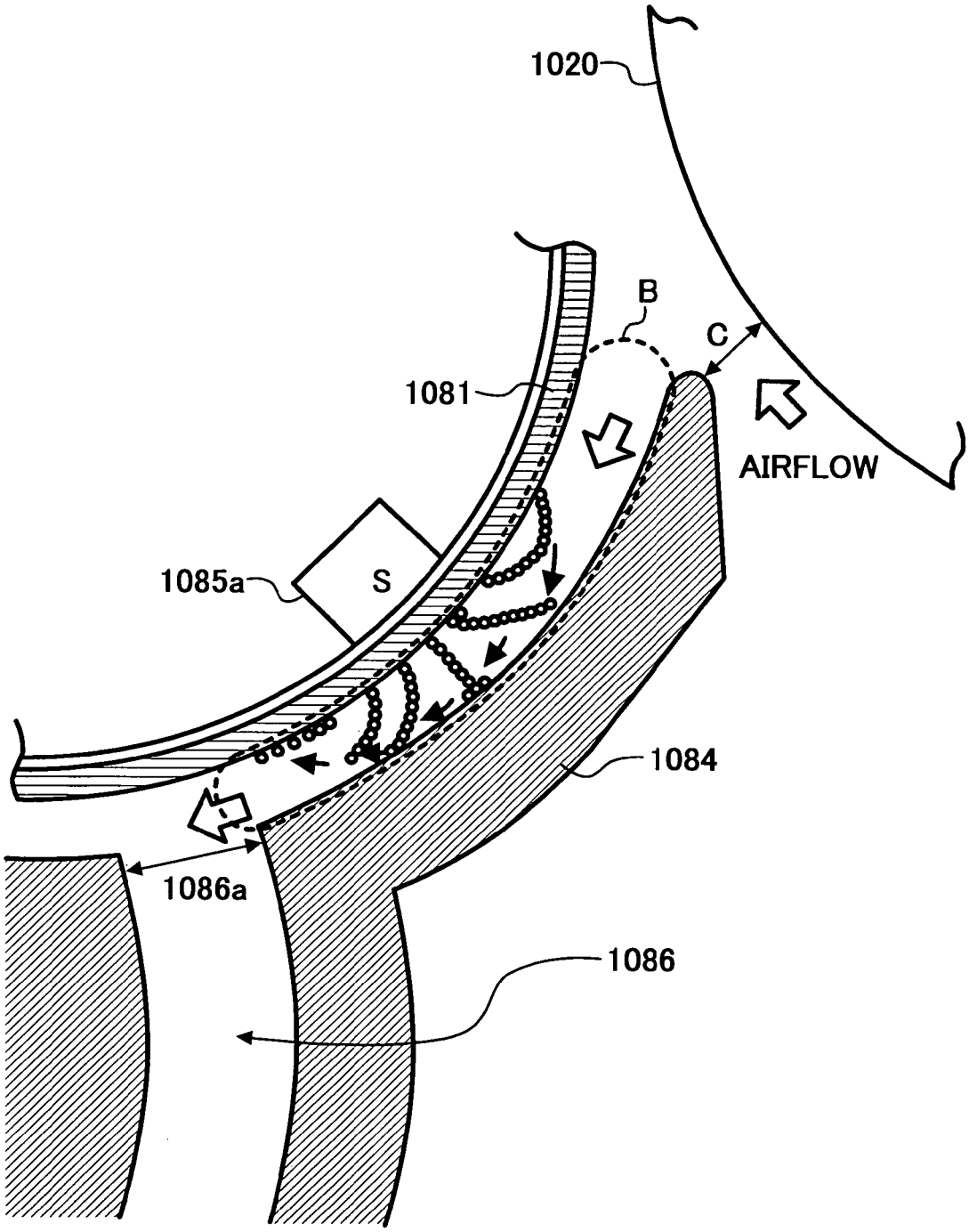
FIG. 17 is an explanatory diagram illustrating the behavior of a magnetic brush near a magnet, focusing on one magnetic brush passing through the channel space in the developing device.

FIG. 17 is an explanatory diagram illustrating the behavior of the magnetic brush near the magnet 1085*a*, focusing on one magnetic brush passing through the channel space B. As shown in the diagram, the developing agent which moves along with the rotations of the developing sleeve 1081 gradually bristles as it approaches the magnet 1085*a* and forms a magnetic brush, and the magnetic brush gradually lies down as it departs from the magnet 1085*a*. Such behavior of a magnetic brush also functions as a pump for feeding gas near the magnet 1085*a* in the channel space B in the direction of rotation of the developing sleeve 1081. Accordingly, near the magnet 1085*a* within the channel space B, an airflow following the direction of rotations of the developing sleeve 1081 is generated. This airflow promotes the inflow of external air from the inlet gap C formed between the downstream edge 1084*a* of the casing opening where the developing sleeve 1081 is exposed, and the surface of the photosensitive drum 20.

Due to such a configuration, with the developing device 1080 according to the present embodiment, an airflow can be generated which flows through the inlet gap C, the channel space B, the detour channel 1086, the channel gap D in the inner space A between the developing sleeve 1081 and the first transporting screw 1082*a*, between the upper portion of the partitioning plate 1084*b* (see FIG. 12) and the inner wall of the casing 1084, and the suctioning opening 1087*a*. With the present embodiment, there is no place in the airflow channel where the developing agent T2 is retained in the channel space B, so even in the event that the developing agent T2 is retained at that portion, the strength of the airflow is not weakened. Accordingly, the effects of suppressing scattering of toner which occurs at the inlet gap C can be maintained by causing air outside of the casing 1084 to flow in through the inlet gap C.

Note that with the present embodiment, the exit 1086*b* of the detour path 1086 opening to the inner space A of the casing 1084 is formed on the inner wall of the casing positioned vertically downwards from the developing agent T2 retained by the repelling magnetic field. Accordingly, the developing agent T2 falling down along the inner wall of the casing might close off the exit 1086*b* of the detour path 1086. However, the magnetic force of the magnet roller 1085 is weak near the exit 1086*b* of the detour path 1086, so the developing agent T2 falls down sparsely along the inner wall of the casing. Moreover, upon the transporting screws 1082*a* and 1082*b* rotating, the surface of the developing agent T0 being transported sinks downward in the direction vertically below the upstream side of rotations of the transporting screws 1082*a* and 1082*b*, as shown in FIG. 12, so the exit 1086*b* of the detour path 1086 is not buried by the developing agent T2 which has passed along the inner wall of the casing and reached the surface of the developing agent T0.

Figure 18:
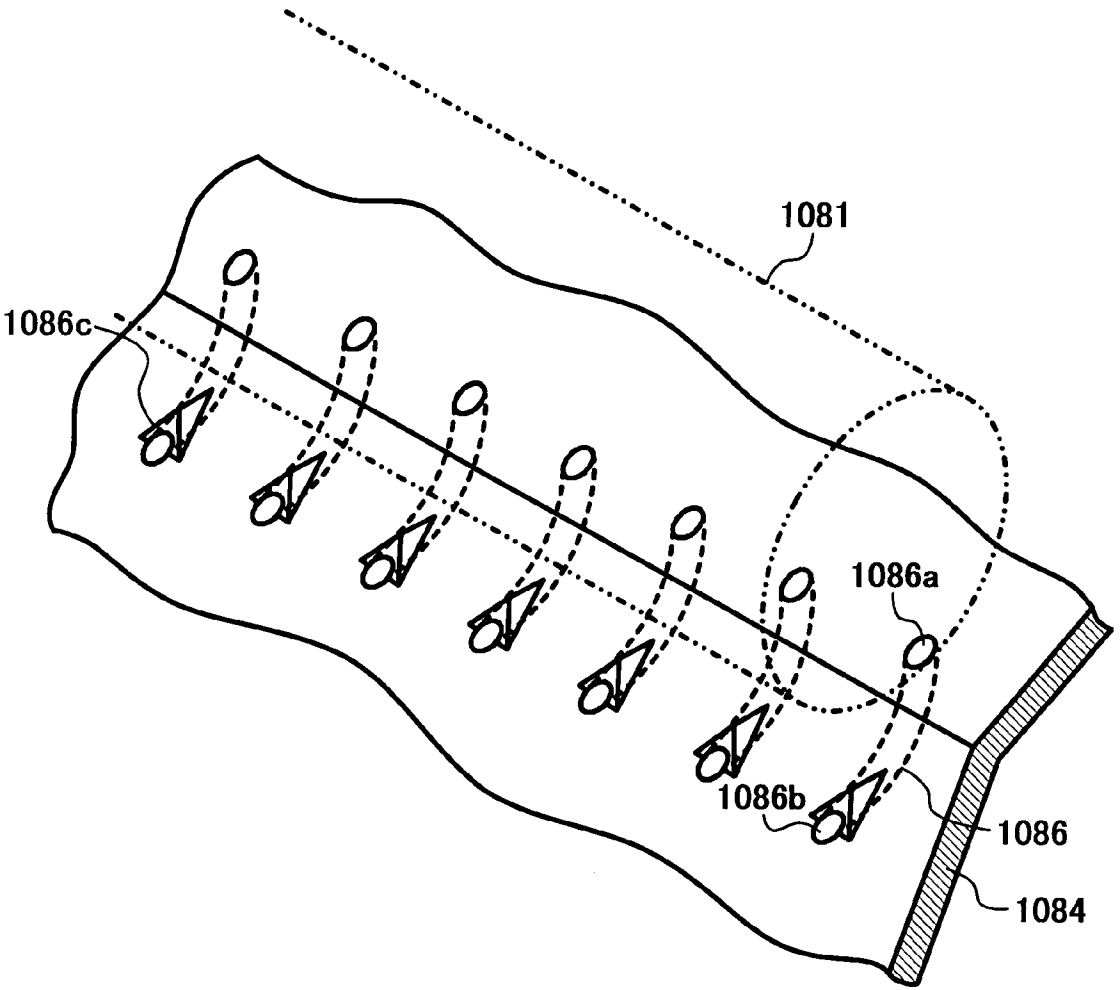
FIG. 18 is an enlarged diagram illustrating another configuration example relating to around the exit of the detour channel.

However, in the event that a configuration different from that of the developing device 1080 illustrated as an example of the present embodiment, for example a configuration wherein the exit 1086*b* of the detour path 1086 is moved upwards in the vertical direction as to the present embodiment is employed, the developing agent retained by the repelling magnetic field may extend as far as the exit 1086*b* of the detour path 1086. In this case, the air flow of external air from the inlet gap C will weaken. Accordingly, in such a case, a protrusion 1086*c* may be provided vertically above the exit 1086*b* so as to serve as a preventive member for preventing the developing agent T2 from passing over the exit 1086*b* of the detour path 1086, as shown in FIG. 18. In this case, the developing agent T2 falling down along the inner wall of the casing 1084 moves along the protrusion 1086*c*, and does not pass over the exit 1086*b*.

Figure 19:
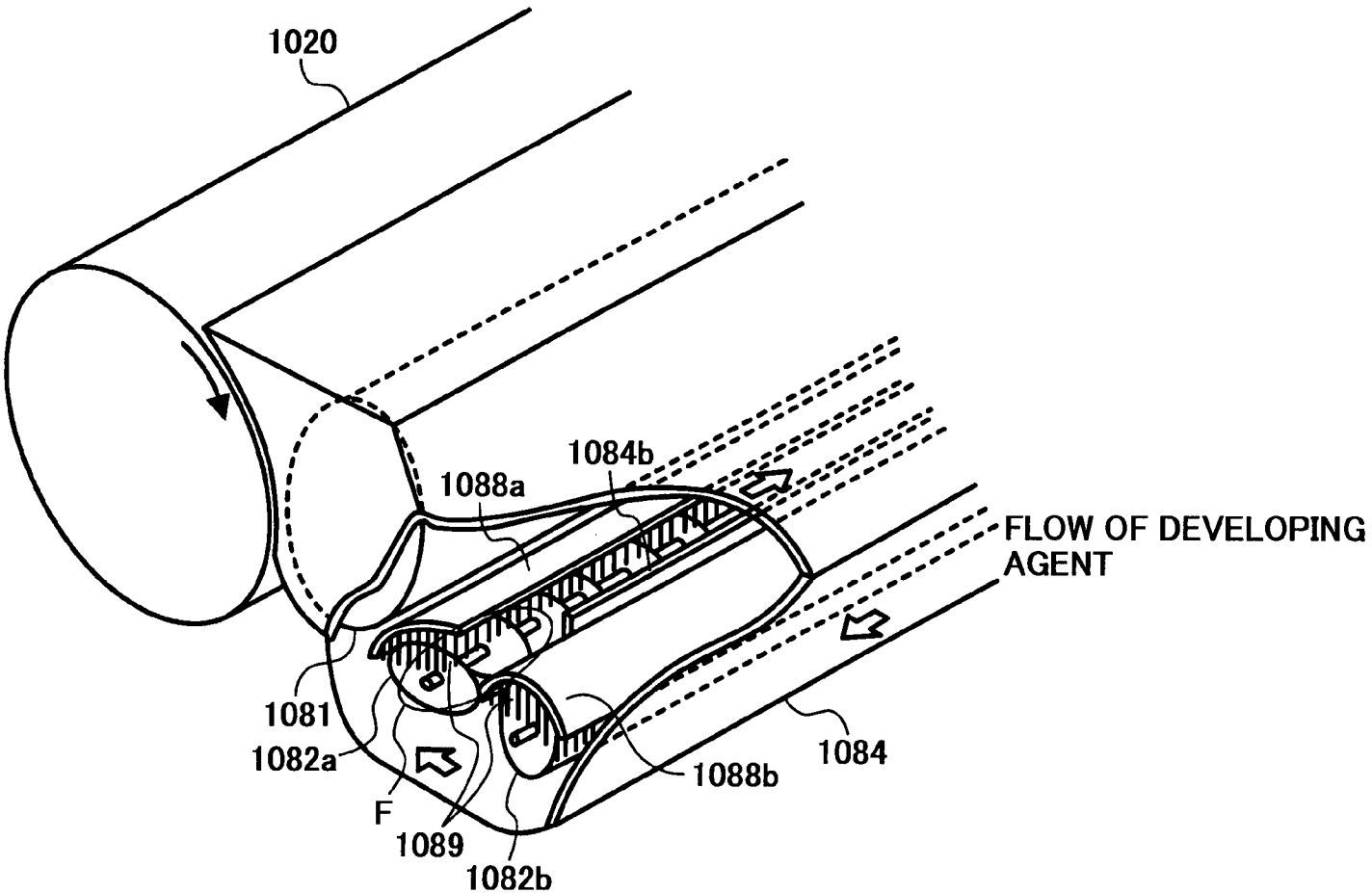
FIG. 19 is a perspective view with part of the casing of the developing device cut away so that the transporting screws are visible.

FIG. 19 is a perspective view with a part of the casing 1084 cut away so that the transporting screws 1082*a* and 1082*b* of the developing device 1080 according to the present embodiment are visible. With the present embodiment, there is a surface layer airflow generated by the viscosity of air near the surface of the developing sleeve, due to the rotations of the developing sleeve 1081. The direction of flow of the surface layer airflow is the same as the direction of the airflow generated in the inner space A described above at the channel gap D, so the airflow passing through the channel gap D is promoted, thereby promoting the effects for suppressing scattering of toner by taking in external air from the inlet gap C. Now, the two transporting screws 1082*a* and 1082*b* provided in the inner space A transport the developing agent T0 along the direction of the rotation axis of the developing sleeve 1081. Accordingly, the direction of flow of the surface layer airflow generated on the surface of the developing agent T0 being transported is a direction orthogonal to the direction of flow of the airflow generated in the inner space A as described above. Accordingly, as a result of the airflow generated in the inner space A as described above being disturbed by the surface layer airflow of the developing agent T0, the effects of suppressing scattering of toner by taking in external air from the inlet gap C decrease.

Accordingly, the developing device 1080 according to the present embodiment is provided with a screw cover 1088*a* serving as a shielding member for shielding the developing agent T0 being transported by the first transporting screw 1082*a* from the airflow passing through the channel gap D. The screw cover 1088*a* is provided so as to cover the first transporting screw 1082*a* over the direction of the rotating axis of the first transporting screw 1082*a*. Providing such a screw cover 1088*a* allows the surface layer airflow of the developing agent T0 being transported by the first transporting screw 1082*a* to be isolated from the airflow passing through the channel gap D. Accordingly, the airflow passing through the channel gap D is not disturbed by the surface layer airflow of the developing agent T0. Accordingly, deterioration of the effects for suppressing scattering of toner by taking in external air from the inlet gap C can be suppressed.

Also, the present embodiment is also provided with a screw cover 1088*b* serving as a shielding member for shielding the developing agent T0 being transported by the second transporting screw 1082*b* from the airflow passing through the channel gap D. This is because the surface layer airflow of the developing agent T0 being transported by the second transporting screw 1082*b* also disturbs the airflow passing between the top of the partitioning plate 1084*b* and the inner wall of the casing 1084 and flowing into the suctioning opening 1087*a*.

Also, a supplying opening for supplying new toner from an unshown toner supplying portion is opened at the transportation starting end side of the second transporting screw 1082*b*, at the portion of the inner space A where the suctioning opening 1087*a* is opened, i.e., above the second transporting screw 1082*b*. The force of adsorption to the carrier is weak with this new toner since charging is insufficient, so a great amount of toner floats near the supplying opening. Accordingly, in the event that the suctioning opening 1087*a* of the vacuum pump 1087 is positioned near the new toner supplying opening, a great amount of toner adheres to the filter member 1087, leading to the airflow being obstructed. Accordingly, the suctioning opening 1087*a* of the vacuum pump 1087 is preferably as far away from the new toner supplying opening as possible. However, with the present embodiment, the screw cover 1088*b* has been provided on the second transporting screw 1082*b* as well, so even in the event that the suctioning opening 1087*a* of the vacuum pump 1087 is positioned near the new toner supplying opening, a great amount of toner does not adhere to the filter member 1087*b*. Note that in addition to providing the screw cover 1088*b* on the second transporting screw 1082*b*, methods for suppressing a great amount of toner from adhering to the filter member 1087*b* include, for example, providing magnetic force generating means (electromagnet) for causing the developing agent T0 existing a the position facing the new toner supplying opening to bristle, thereby causing the developing agent to bristle at the time of supplying toner. According to this method, new toner from the supplying opening can be fed deep into the bristling developing agent, so floating toner can be reduced, and a great amount of toner can be prevented from adhering to the filter member 1087*b*. Employing such a method allows the freedom of positioning the suctioning opening 1087*a* to be increased.

Note that upon the transporting screws 1082*a* and 1082*b* rotating, the surface of the developing agent T0 being transported bulges vertically upwards at the downstream side in the direction of rotation of the transporting screws 1085*a* and 1082*b*, as shown in FIG. 12. With the present embodiment, the portions of the transporting screws 1082*a* and 1082*b* which are not buried in the developing agent T0 being transported are covered with the screw covers 1088*a* and 1088*b*. Accordingly, the screw covers 1088*a* and 1088*b* do not obstruct transportation of the developing agent T0. Also, the portion of the developing agent T0 bulging vertically upwards due to the rotations of the transporting screws 1082*a* and 1082*b* is drawn upwards into the upper portion of the inner space A by the effects of the magnetic field of the magnet roller 1085. Accordingly, this portion bulging upwards is not covered with the screw covers 1088*a* and 1088*b*, and a space necessary for drawing up the developing agent is provided here.

Also, with the present embodiment, brushes 1089 which are flexible members are provided on the entire face of the screw covers 1088*a* and 1088*b* facing the transporting screws 1082*a* and 1082*b*. The brushes 1089 are disposed so as to come into contact with the perimeter of the fins of the transporting screws 1082*a* and 1082*b*. Accordingly, the flow of the surface layer airflow generated by the developing agent T0 being transported by the transporting screws 1082*a* and 1082*b* is interrupted by the brushes 1089. Thus, a case wherein the flow of the surface layer airflow generated by the developing agent T0 being transported leaks out from the gap between the transporting screw 1082*a* and the screw cover 1088*a*, the gap between the transporting screw 1082*b* and the screw cover 1088*b* and disturbs the airflow for causing external air to flow in from the inlet gap C, can be prevented.

Figure 20:
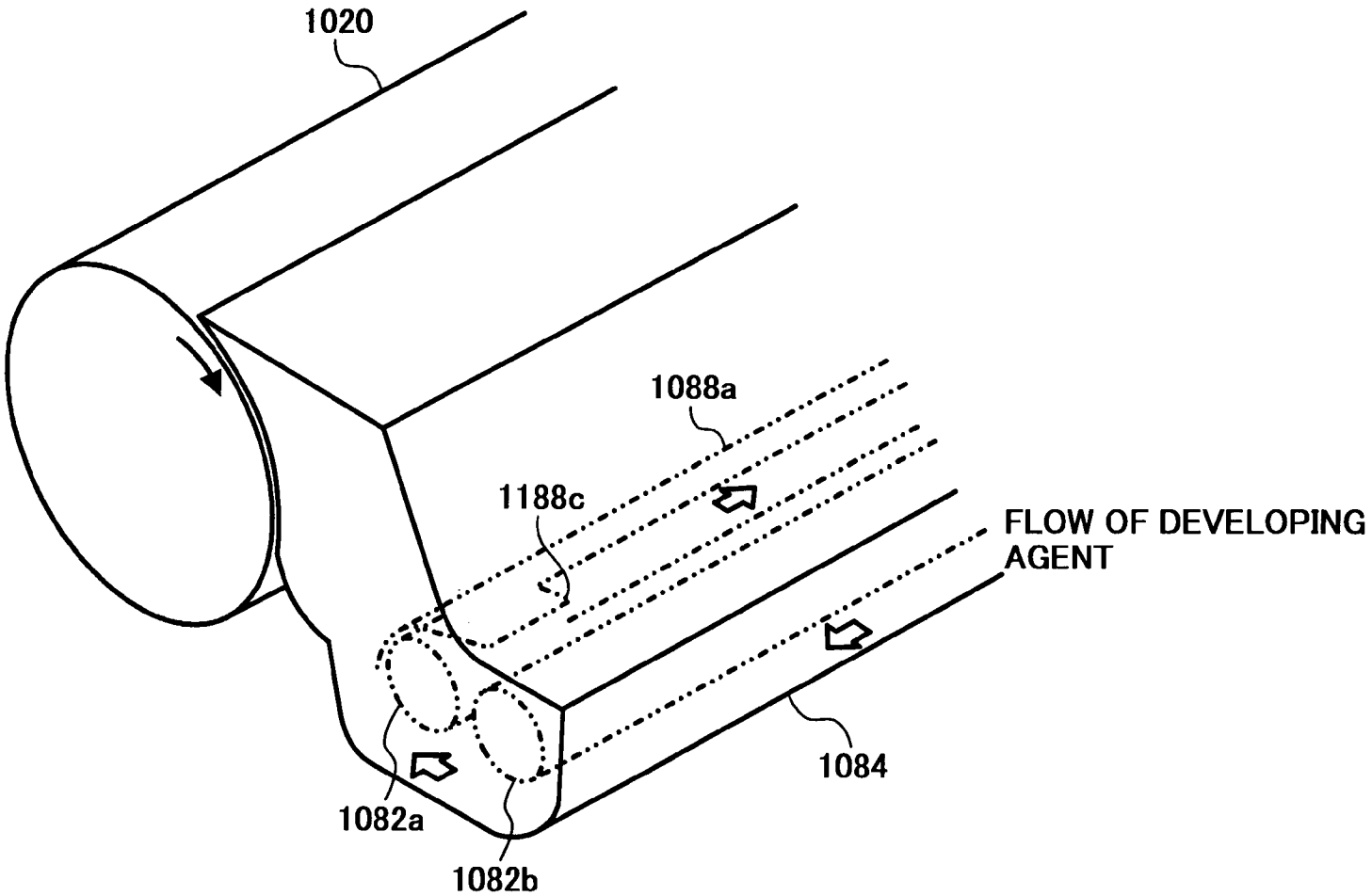
FIG. 20 is a partial cutaway perspective diagram illustrating another configuration of the screw cover at one end of the transporting screws.

Also, as described above, moving paths F are formed at both end portions of the two transporting screws 1082*a* and 1082*b*, whereby developing agent T0 which has been transported to the transportation ending end portion of one of the transporting screws 1082*a* and 1082*b* is moved to the transportation starting end portion of the other of the transporting screws 1082*a* and 1082*b*. In these moving paths F, upon the developing agent being transported to the transportation ending end portion by the transporting screws 1082*a* and 1082*b*, the developing agent is turned 90° and moved through the moving path F, and then turned another 90° and transported in the direction of the rotation axis of the other of the transporting screws 1082*a* and 1082*b*, so the airflow near the moving paths F is greatly disturbed due to such motion of the developing agent. In the event of suppressing disturbance of the airflow flowing in from the inlet gap C due to this disturbed airflow, an arrangement may be made such as shown in FIG. 20, wherein both edge portions of the screw cover 1088*a* in the rotational axis direction of the transporting screws 1082*a* and 1082*b* comprises protruding portions 1188*c* extending to above the moving channels F. Owing to this protruding portion 1188*c*, the flow for causing the external air to flow in from the inlet gap C can be isolated from the airflow disturbed due to the developing agent T0 moving through the moving paths F.

Also, with the present embodiment, a humidity path 1090 is provided to the inlet gap C for supplying humidity-adjusting air, which is air for making the environment within the inner space A of the casing to be suitable for toner charging properties as shown in FIG. 12. Humidity-adjusting air, which has been generated at an unshown humidity-adjusting air generating unit, flows through the humidity path 1090. The portion of the humidity path 1090 which faces the inlet gap C is opened, so the humidity-adjusting air flowing through this humidity path 1090 rides on the airflow heading from the inlet gap C and heads to the inner space A, and thus is supplied to the inner space A. Thus, feeding humidity-adjusting air into the inner space A enables making the humidity environment of the developing agent within the inner space A to be that suitable for toner charging properties. Moreover, according to the configuration of the present embodiment, the airflow for suppressing toner scattering is used as the force for sending the humidity-adjusting air into the inner space A, so there is no need to individually provide a separate force for this.

Next, a modification of the developing device according to the above-described embodiment (hereafter, this modification will be referred to as "first modification") will be described.

Figure 21:
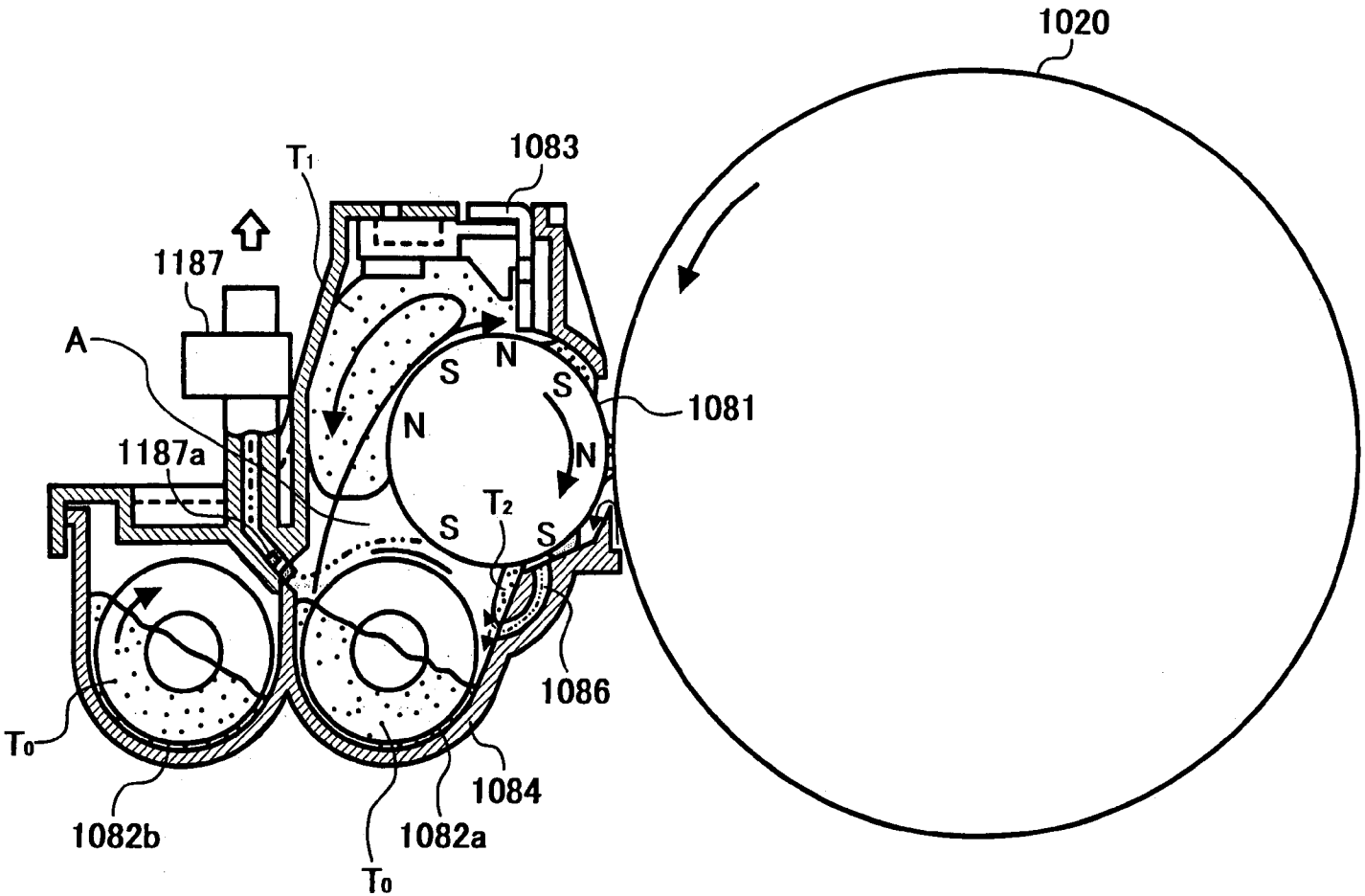
FIG. 21 is a schematic configuration diagram illustrating the developing device according to a first modification.

FIG. 21 is a schematic configuration diagram illustrating a developing device according to the first modification. This developing device has the position of the suctioning opening of the vacuum pump of the developing device according to the present embodiment changed. That is to say, the developing device according to the first modification has the suctioning opening 1187*a* of the vacuum pump 1187 opened on the inner wall portion of the casing 1084 near to the channel gap D between the developing sleeve 1081 and the first transporting screw 1082*a* (see FIG. 12). With this developing device, the channel length for the flow from the inlet gap C to the suctioning opening 1187*a* is shorter than that of the developing device of the above-described embodiment. Accordingly, the pressure loss which weakens the airflow can be reduced, and the strength of the airflow at the inlet gap C can be ensured.

Figure 22:
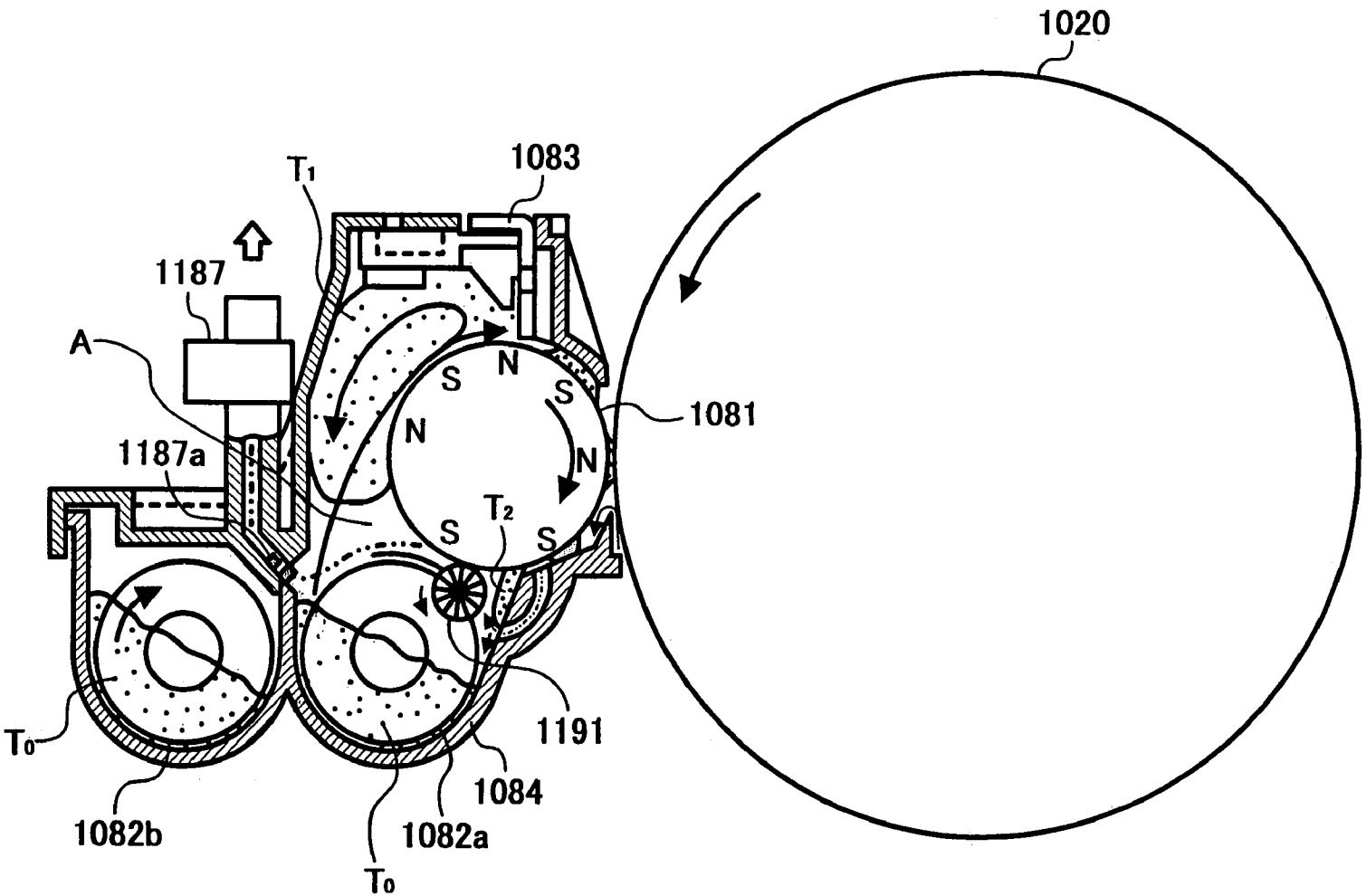
FIG. 22 is a schematic configuration diagram illustrating another configuration of the developing device.

Also, a brush roller 1191 (see FIG. 22) which rotates along with the first transporting screw 1082*a* such that the surfaces of each are moving in the same direction at the position of closest proximity, may be provided near the channel gap D (see FIG. 12). Upon the first transporting screw 1082*a* rotating, the brush roller 1191 rotates along with the rotations thereof such that the surfaces of each are moving in the same direction at the position of closest proximity. Accordingly, the surface layer airflow of the brush roller 1191 can generate an airflow heading from the exit 1086*b* of the detour path 1086 toward the channel gap D (see FIG. 12). Thus, the gas entering the inner space A from the exit 1086*b* of the detour path 1086 can be smoothly sent to the channel gap D. Moreover, in the event that the brush roller 1191 is disposed so as to come into contact with the brush tips thereof with the surface of the developing sleeve 1081, the developing agent which could not be peeled off of the surface of the developing sleeve due to the repelling magnetic field can be scraped off.

Next, a modification of the developing device according to the above-described embodiment (hereafter, this modification will be referred to as "second modification") will be described.

The airflow flowing into the inner space A form the inlet gap C is primarily generated by the airflow generated near the suctioning opening 1187*a* by the vacuum pump 1187. Accordingly, how to reduce pressure loss on the channel of the flow from the inlet gap C to the suctioning opening 1187*a* is crucial to ensuring a strong airflow at the inlet gap C. With regard to this point in the above-described embodiment, disturbance in the airflow is suppressed by attaching the screw covers 1088*a* and 1088*b* to the transporting screws 1082*a* and 1082*b*, thereby reducing the pressure loss on the channel of the flow. Also, in the above first modification, the channel length for the flow is reduced to reduce pressure loss. However, there are many factors which obstruct the flow of the airflow in the inner space A of the casing 1084, so there is the possibility that the pressure loss will be relatively great with the configuration wherein the airflow from the inlet gap C is passed to the inner space A of the casing 1084.

Figure 23:
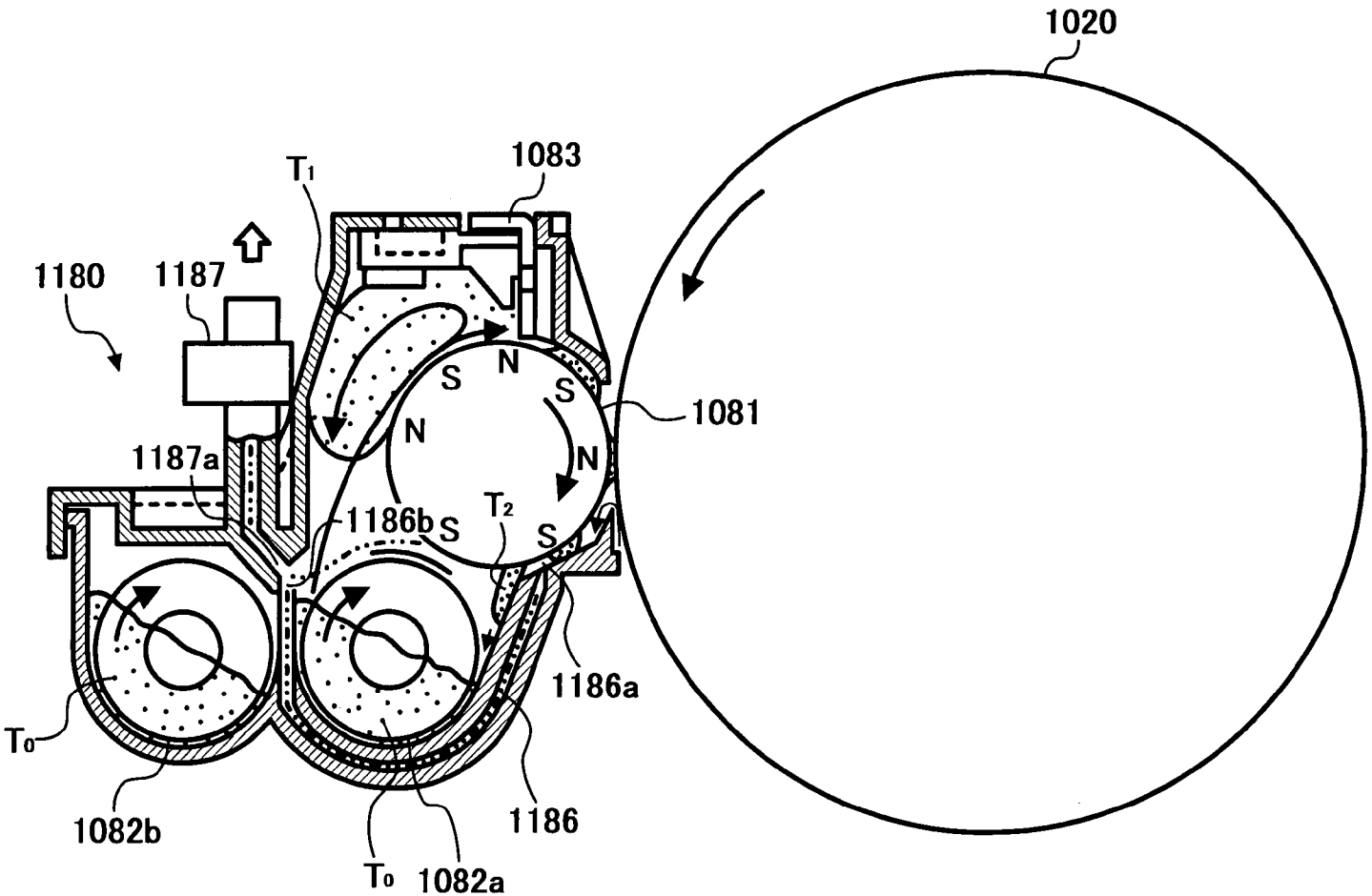
FIG. 23 is a schematic configuration diagram illustrating the developing device according to a second modification.

FIG. 23 is a schematic configuration illustrating a developing device 1180 according to the second modification.

The developing device 1180 according to the second modification has the exit 1186*b* of a detour path 1186 opened near the suctioning opening 1187*a* of the vacuum pump 1187. According to this configuration, suctioning by the vacuum pump 1187 enables an airflow to be generated which passes through the inlet gap C, channel space B, detour channel 1186, and suctioning opening 1187*a*. Accordingly, an airflow can be created which does not pass through the inner space A of the casing 1084, such as through the channel gap D between the developing sleeve 1081 and the first transporting screw 1082*a*, and the upper portion of the partitioning plate 1084*b* and inner wall of the casing 1084, in the inner space A. Accordingly, the pressure loss on the airflow channel is small, and the strength of the airflow flowing from the inlet gap C to the inner space A can be ensured.

Also, with the second modification, the airflow does not pass through the channel gap D between the developing sleeve 1081 and the first transporting screw 1082*a* in the inner space A, or over the second transporting screw 1082*b*, so there is no need to attach the screw covers 1088*a* and 1088*b* to the transporting screws 1082*a* and 1082*b*.

Next, a modification of the developing device according to the above-described embodiment (hereafter, this modification will be referred to as "third modification") will be described.

Figure 24:
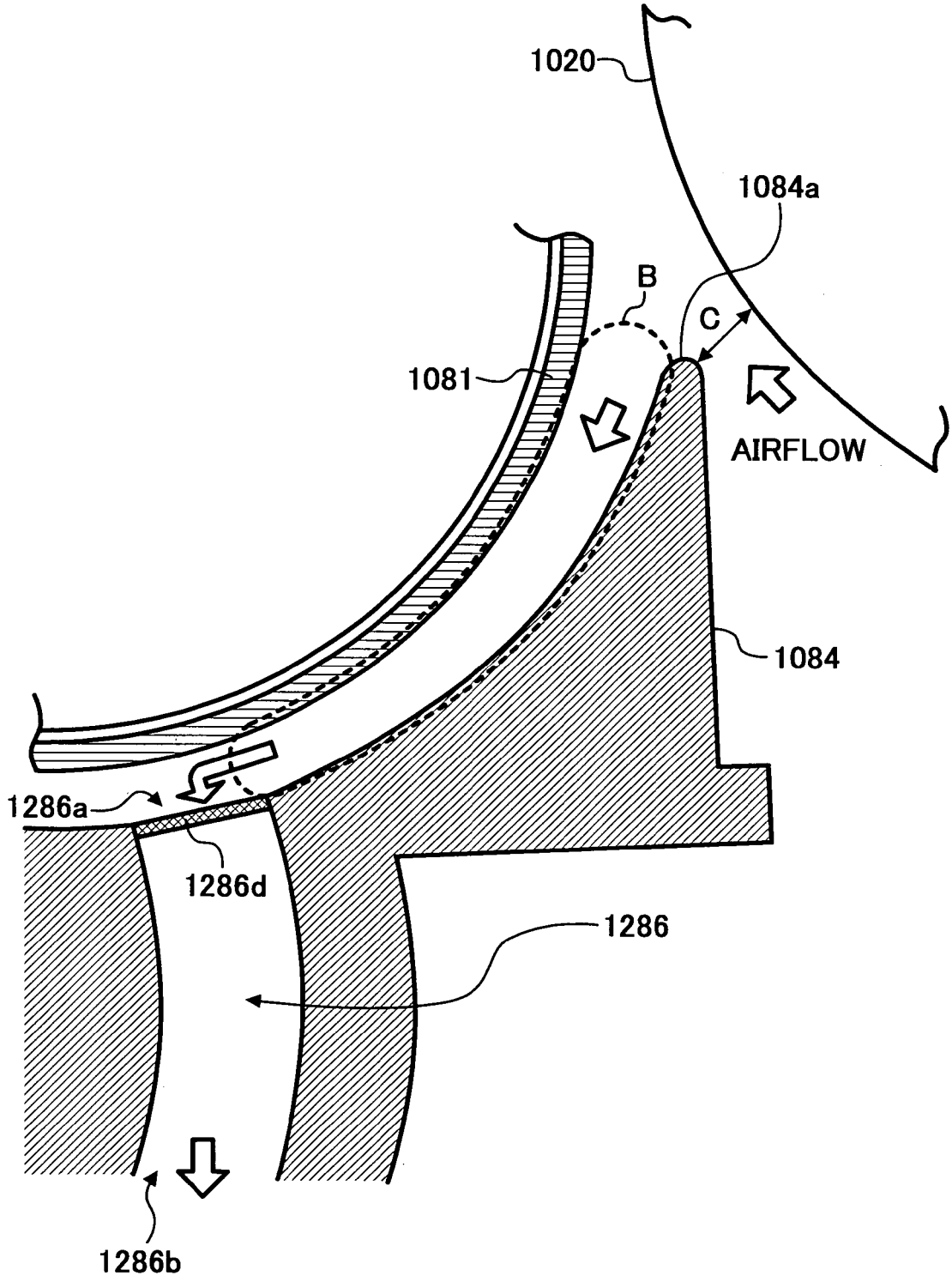
FIG. 24 is an enlarged diagram illustrating around the channel space in the developing device according to a third modification.

FIG. 24 is an enlarged diagram illustrating around the channel space B in the developing device according to the third modification.

The developing device according to the third modification has the exit 1286*b* of a detour channel 1286 having an entrance 1286*a* at a position similar to that in the above embodiment, opened to the outside of the developing device. According to this configuration, an airflow can be generated which passes through the inlet gap C, channel space B, and detour channel 1286. Note that while the developing device according to the third embodiment does not have suction means such as a vacuum pump or the like, as shown in FIG. 17, the behavior of the magnetic brush in the channel space B serves as a pump, so an airflow capable of sufficiently suppressing scattering of toner at the inlet gap C can be generated. Also, even in the event that there are no pumping actions by the magnetic brush in the channel space B, an airflow capable of sufficiently suppressing scattering of toner at the inlet gap C can be generated by the surface layer airflow generated by the rotations of the developing sleeve 1081. Also, with the developing device according to the third modification, a filter member 1286*d* is provided, to prevent developing agent within the channel space B from exiting from the developing device through the detour channel 1286 along with the external air which has flowed in through the inlet gap C. Accordingly, no developing agent is ejected from the exit 1286*b* of the detour channel 1286, and only the external air which has flowed in through the inlet gap C is exhausted therefrom.

According to the third modification, an airflow capable of sufficiently suppressing scattering of toner at the inlet gap C can be generated even without providing a vacuum pump, thereby facilitating simplification of the device and reduction of costs.

Note that the configuration wherein an airflow capable of sufficiently suppressing scattering of toner at the inlet gap C can be generated without providing a vacuum pump is not restricted to the configuration in the third modification. For example, a configuration may be made which uses a device or the like already provided in the photocopier as the suction means instead of a vacuum pump.

For example, cleaning devices such as a photosensitive member cleaning device 1063 or belt cleaning device 1017 may be used as the suction means. In this case, the space within the cleaning device serves as the developing agent scattering prevention space. Such cleaning devices generally have a generally airtight structure so that the developing agent collected therein does not leak out, and moreover, the collected developing agent is discharged to a waste toner bottle or the like, so the inner pressure is low. Accordingly, communicating the cleaning devices 1063 and 1017 having low inner pressure with the channel space B via the detour 1286 allows an airflow heading from the channel space B toward the cleaning devices 1063 and 1017 to be generated.

Also, for example, negative pressure space E which is adjacent to the downstream side of the doctor blade 1083 in the direction of rotation of the developing sleeve and serves as developing agent scattering prevention space can be used as the suction means. Air within this negative pressure space E rides on the surface layer airflow generated by the rotations of the developing sleeve 1081 and is sent out to the upstream side in the developing sleeve rotation direction. Moreover, a phenomenon the same as the pumping action by the magnetic brush within the channel space B shown in FIG. 17 also occurs in the space between the surface of the developing sleeve 1081 and the inner wall of the casing 1084 downstream of the doctor blade 1083 in the direction of rotation of the developing sleeve. Accordingly, the air in the negative pressure space E is sent upstream in the direction of rotation of the developing sleeve even with this pumping action. Moreover, the doctor gap which enables air to flow into this negative pressure space E is closed off with developing agent in high density. Accordingly, the pressure of the negative pressure space E is in a lowered state. Accordingly, communicating between the negative pressure space E and the channel space B with the detour channel 1286 enables an airflow to be generated which heads from the channel space B toward the cleaning devices 1063 and 1017.

As described above, the developing devices 1080 and 1180 according to the present embodiment have a developing sleeve 1081 serving as a developing agent carrying member which faces a photosensitive drum 1020 serving as a latent image carrying member and rotates along with the photosensitive drum 1020 such that the surfaces of each are moving in the same direction at the position of closest proximity while carrying the developing agent T1 on the surface thereof. Also, casing 1084 having an inner space A for storing developing agent therein is provided, which has an opening whereby a portion of the developing sleeve surface faces the photosensitive drum 1020 in the direction of rotation of the developing sleeve. Also, the developing devices 1080 and 1180 have a configuration wherein external air can flow in toward the inner space A of the casing 1084, through the inlet gap C formed between the edge 1084*a* of the casing opening positioned at the downstream side in the direction of rotation of the developing sleeve, and the surface of the photosensitive drum 1020. Entrances 1086*a*, 1186*a*, and 1286*a*, which are second openings, are formed at the inner wall portion of the casing 1084 on the upstream side in the direction of rotation of the developing sleeve from the position where the developing agent T2 closes off part or all of the channel space B between the surface of the developing sleeve and the inner wall of the casing, which can serve as a channel for external air flowing into the inner space A of the casing 1084 through the inlet gap C, and detour channels 1086, 1186, and 1286 which are gas exhausting channels for exhausting the gas within the channel space B through the entrances thereof are connected to the entrances thereof. Accordingly, a new airflow channel can be formed wherein the air flowing in through the inlet gap C passes through the detour channels 1086, 1186, and 1286 through the entrances 1086*a*, 1186*a*, and 1286*a*. Accordingly, event in the event that part or all of the channel space B is closed off with the developing agent T2, the airflow flowing in through the inlet gap C can be generated. Accordingly, scattering of toner which occurs downstream of the developing region can be suppressed in a stable manner without necessitating changing the design such that part or all of the channel space B is not closed off by the developing agent T2 or restricting the functions of the developing device.

Particularly, with the developing device described in the embodiment above and the developing device described in the first modification and the second modification, a vacuum pump 1187 is provided to serve as suction means for suctioning gas from the exits 1086*b* and 1186*b* which are the ends of the detour channels 1086 and 1186 opposite to the entrances 1086*a* and 1186*a*. Generating an airflow by aggressively suctioning with the vacuum pump 1187 allows a stronger airflow to be generated at the inlet gap C. Accordingly, the effects of preventing scattering of toner can be improved due to this airflow.

Also, the developing device 1080 and 1180 according to the embodiment described above have a doctor blade 1083, serving as developing agent restricting member for restricting the amount of developing agent carried on the surface of the developing sleeve, disposed facing the surface of the developing sleeve at the upstream side of the developing region in the direction of rotation of the developing sleeve with a predetermined gap therebetween, so as to adjust the amount of developing agent being transported to the developing region. As described above, the negative pressure space E adjacent to the downstream side of the doctor blade 1083 in the direction of rotation of the developing sleeve 1081 may be used as the suctioning means for suctioning from the exists 1086*b* and 1186*b* of the detour channels 1086 and 1186. In this case, there is no need to individually provide suctioning means such as the vacuum pumps 1087 and 1187, thereby facilitating simplification of the device and reduction of costs.

Also, the developing device 1080 described in the above embodiment and the first modification is configured such that the inner space A of the casing 1084 is in a generally airtight state. The entrance 1086*a* of the detour channel 1086 and the inner space A communicate through the detour channel 1086, and the gas in the inner space A is suctioned by the vacuum pump 1087. Accordingly, the gas within the channel space B is suctioned by the vacuum pump 1087 through the inner space A. Developing agent is present in the channels pace B, and also there is a great deal of toner which was not consumed at the developing region. Accordingly, developing agent is mixed into the airflow flowing out of the channel space B through the detour channel 1086. Accordingly, a configuration wherein the airflow containing developing agent passes through the inner space A as with the present developing device 1080 enables the developing agent in the airflow to be reused.

Also, the protrusion 1086*c* serving as an obstructing member for obstructing passage of the developing agent T2, flowing through the inner space A near the exit 1086*b* of the detour channel 1086 opened into the inner space A, over the exit 1086*b*, may be provided vertically above the exit 1086*b*. In this case, the developing agent T2 falling down along the inner wall of the casing 1084 moves along the protrusion 1086*c*, and does not pass over the exit 1086*b*. Thus, the flow of the airflow flowing into the inner space A from the exit 1086*b* is not obstructed by the developing agent T2, thereby enabling weakening of the strength of the airflow generated at the inlet gap C to be suppressed.

Also, with the third modification, a configuration is employed wherein the entrance 1286*a* and the outside of the developing device are made to communicate through the detour channel 1286. Thus, an airflow capable of sufficiently suppressing scattering of toner at the inlet gap C can be generated at the inlet gap C even without individually providing suctioning means or the like for generating the airflow flowing in from the inlet gap C. This facilitates simplification of the device and reduction of costs.

Also, with the developing device 1080 described in the above embodiment and the first modification, transporting screws 1082*a* and 1082*b* are provided serving as transporting members for transporting developing agent T0 in the direction of the rotational axis of the developing sleeve 1081 in the inner space A of the casing 1084. Also, this developing device 1080 has a configuration wherein external air can flow into the inner space A within the casing 1084 through the inlet space C, due to the airflow passing through the channel gap D between the developing sleeve 1081 and the first transporting screw 1082*a*. The developing device 1080 comprises a screw cover 1088*a* serving as a shielding member for shielding the developing agent T0 being transported by the first transporting screw 1082*a* from the airflow passing through the channel gap D. Provided such a screw cover 1088*a* allows the surface layer airflow the developing agent T0 being transported by the first transporting screw 1082*a* to be isolated from the airflow passing through the channel gap D. Accordingly, the airflow passing through the channel gap D is not disturbed by the surface layer airflow of the developing agent T0. Thus, deterioration in effects of suppressing toner scattering by letting external air in from the inlet gap C can be suppressed.

Also, the developing device 1080 described in the above embodiment and the first modification comprises a doctor blade 1083, and the negative pressure space E adjacent to the downstream side of the doctor blade 1083 in the direction of rotation of the developing sleeve 1081, and the inner space A of the casing 1084, may be made to communicate, so that an airflow passing through the channel gap D is generated. In this case, there is no need to individually provide suctioning means such as the vacuum pumps 1087 and 1187, thereby facilitating simplification of the device and reduction of costs.

Also, the two transporting screws 1082*a* and 1082*b*, provided to the developing device 1080 described in the above embodiment and the first modification, rotate fins fixed to rotating shafts extending in the rotating axis direction of the developing sleeve 1081, thereby transporting the developing agent T0 in a direction along the rotational axis direction of the developing sleeve 1081 in mutually opposite directions. Moving paths F are formed at the end portions of the transporting screws 1082*a* and 1082*b* in the rotating axis direction, whereby developing agent which has been transported to the transportation ending end portion of one of the transporting screws 1082*a* and 1082*b* is moved to the transportation starting end portion of the other of the transporting screws 1082*b* and 1082*a*. Accordingly, the developing agent in the inner space A circulates while being stirred by the transporting screws 1082*a* and 1082*b*. Also, a screw cover 1088*a* is disposed so as to shield at least the first transporting screw 1082*a* closer to the developing sleeve 1081 from the airflow passing through the channel gap D. Such a first transporting screw 1082*a* rotates with the fin exposed upwards from the developing agent T0, so the surface layer airflow due to the developing agent T0 being transported, and also airflow generated by rotations of the fins can be factors disturbing the airflow passing through the channel gap D. Accordingly, in the event of using such a first transporting screw 1082*a*, shielding the first transporting screw 1082*a* itself with the screw cover 1088*a* enables deterioration in effects of suppressing toner scattering by letting external air in from the inlet gap C to be effectively suppressed.

Also, the developing agent T0 moving through, of the moving paths F, at least the moving path for moving the developing agent to the transporting starting end portion of the first transporting screw at the side closer to the developing sleeve 1081, may be shielded from the airflow passing through the channel gap D with a protruding portion 1188*c* of the screw cover 1088*a*. In this case, the direction of airflow generated by the movement of the developing agent T0 is in the opposite direction to the airflow passing through the channel gap D, and accordingly can be a factor in disturbing the airflow passing through the channel gap D. Accordingly, shielding such developing agent T0 with the protruding portion 1188*c* enables deterioration in effects of suppressing toner scattering by letting external air in from the inlet gap C to be effectively suppressed.

With the developing device 1080 according to the above-described embodiment, brushes 1089 which are flexible members capable of coming into contact with the perimeter of the fins of the transporting screws 1082*a* and 1082*b* are provided on the entire face of the screw covers 1088*a* and 1088*b* facing the transporting screws 1082*a* and 1082*b*. Accordingly, the flow of the surface layer airflow generated by the developing agent T0 being transported by the transporting screws 1082*a* and 1082*b* is interrupted by the brushes 1089. Thus, a case wherein the flow of the surface layer airflow generated by the developing agent T0 being transported leaks out from the gap between the transporting screw 1082*a* and the screw cover 1088*a*, and the gap between the transporting screw 1082*b* and the screw cover 1088*b*, and disturbs the airflow for causing external air to flow in from the inlet gap C, can be prevented.

Also, with the developing device according to the first modification, the suctioning opening 1187*a* serving as suctioning means of the vacuum pump 1187 for suctioning gas is provided on the inner wall portion of the casing near the channel gap D between the first transporting screw 1082*a* closer to the developing sleeve 1081 and the developing sleeve 1081. Accordingly, the channel length for the flow from the inlet gap C to the suctioning opening is shorter than that of the developing device shown in FIG. 12 wherein the suctioning opening 1187*a* is at a position distanced from the exit 1086*b* of the detour channel 1086. Thus, the pressure loss which weakens the airflow can be reduced, and the strength of the airflow at the inlet gap C can be ensured.

On the other hand, configuring airflow generating means by disposing the suctioning opening 1087*a* of the vacuum pump 1087 as with the developing device shown in FIG. 12, so as to generate an airflow which passes through the channel gap D and which passes through the perimeter region of the second transporting screw 1082*b* farther away from the developing sleeve 1081 allows the toner being carried by the airflow to be carried to a position far away from the developing sleeve 1081. Toner which is carried by an airflow generally has insufficient charge, so carrying such toner to a position far away from the developing sleeve 1081 enables the transporting path for the toner to be carried on the developing sleeve 1081 to be longer. Accordingly, toner with insufficient charge can be stirred while being transported, and thus sufficiently charged.

Also, the developing device 1080 according to the above-described embodiment comprises a humidity path 1090 serving as air supplying means provided to the inlet gap C for supplying humidity-adjusting air, which is air for making the environment within the inner space A of the casing to be suitable for toner charging properties. With the developing device 1080, the airflow for suppressing toner scattering flows from the inlet gap C toward the inner space A, so humidity-adjusting air can be fed into the inner space A using this without any need to individually provide a separate force.

Also, as described above, integrally forming at least the photosensitive drum 1020 and the developing devices 1080 and 1180 in a process cartridge which is detachably mounted to the photocopier main unit facilitates replacing of the developing devices 1080 and 1180, thereby improving ease of maintenance.

Figure 25:
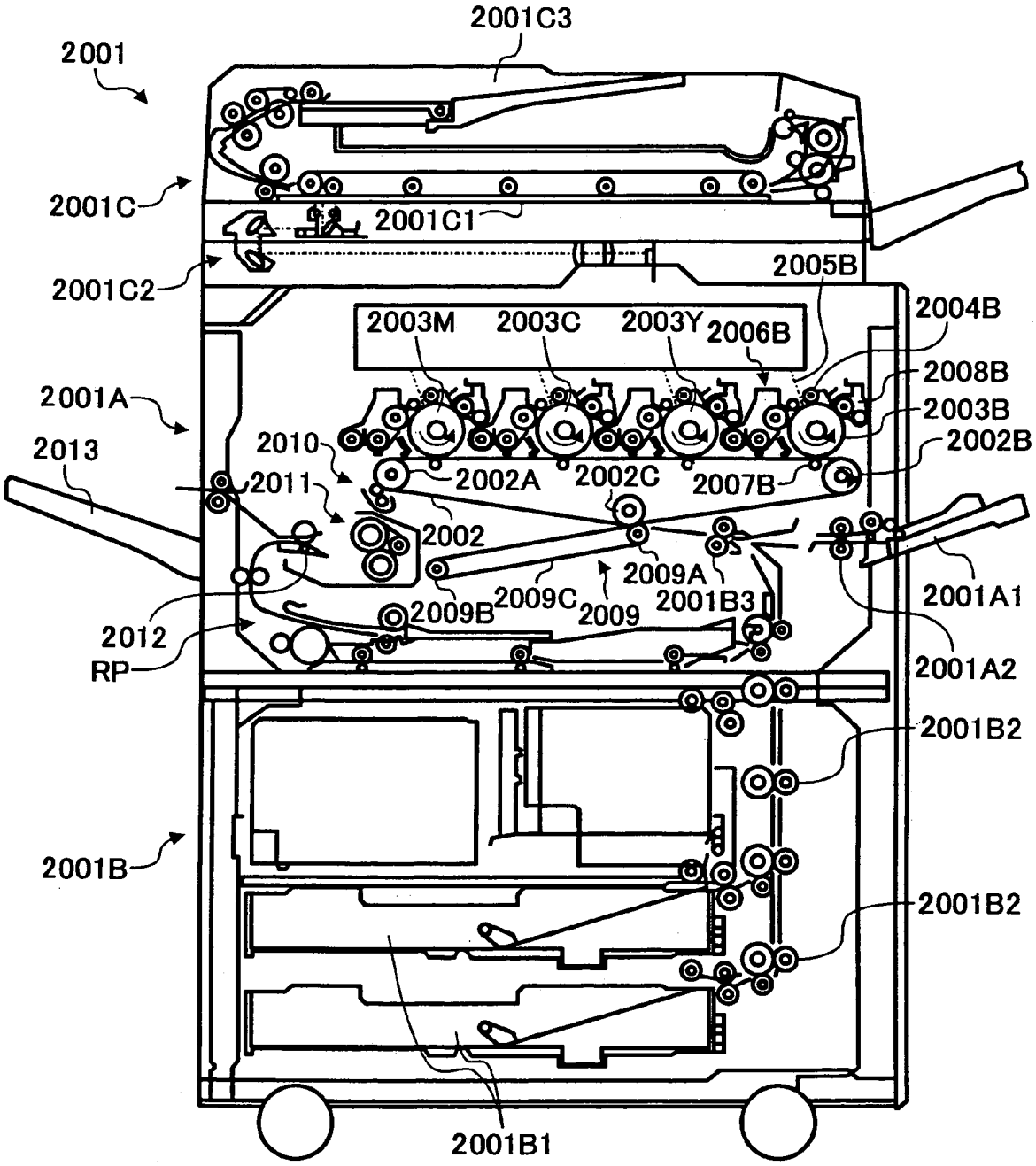
FIG. 25 is a model diagram illustrating a developing device according to an embodiment of the present invention, and an image formation apparatus to which has been applied a process cartridge wherein the developing device according to the present embodiment has been built in, for solving the third object.

Next, an embodiment for solving the third object of the present invention will be described in detail. FIG. 25 illustrates an image formation apparatus to which has been applied a process cartridge wherein the developing device according to the present embodiment has been built in. The image formation apparatus 2001 shown in FIG. 25 is a color printer which has a tandem configuration wherein multiple photosensitive members serving as latent image carrying members capable of formation images of colors corresponding to color separation are arrayed, and can form a multi-color image by performing superimposed transfer of the toner images formed on the photosensitive members onto an intermediate transfer member, and then transferring the superimposed image all at once onto a sheet such as recording member or the like. With the present invention, it is needless to say that the image formation apparatus is not restricted to color printers, and also includes color photocopiers, facsimile apparatuses, printing apparatuses, and so forth.

In FIG. 25, a color printer 2001 has an image formation unit 2001A in the center portion in the vertical direction, with a sheet supplying unit 2001B disposed below, and further a document scanning unit 2001C having a document loading table 2001C1 disposed above the image formation unit 2001A.

Transfer means configured of an intermediate transfer belt 2002 having an extended face in the horizontal direction are provided to the image formation unit 2001A, and a configuration for forming images of colors which are complementary to color separation colors provided at the upper portion of the intermediate transfer belt 2002.

The image formation unit 2001A has photosensitive members 2003B, 2003Y, 2003C, and 2003M, capable of carrying images of toner of complementary colors (yellow, magenta, cyan, and black), arrayed along the extended face of the intermediate transfer belt 2002. Note that in the following description, in the event that the contents relate to all of the photosensitive members in common, the photosensitive members will be denoted with reference numeral 2003.

The photosensitive members 2003B, 2003Y, 2003C, and 2003M are each configured of drums capable of rotating in the same direction (the counter-clockwise direction in FIG. 25), and provided in the perimeter of each are a charging device 2004 for executing image formation processing in the rotating process, a writing device 2005, a developing device 2006, a primary transfer device 2007, serving as one of transfer bias applying means, and a cleaning device 2008 (illustrated regarding the photosensitive member 2003B with B appended to the reference numerals of each device, for sake of simplicity in description).

The intermediate transfer belt 2002 is equivalent to a primary transfer unit into which visible images from the image-making unit having the photosensitive members are sequentially transferred, with a configuration of being hung over multiple rollers 2002A through 2002C and movable in the same direction as the photosensitive members at the portions facing the photosensitive members, wherein a roller 2002C which is separate from the rollers 2002A and 2002B making up the extended face faces a secondary transfer device 2009 across the intermediate transfer belt 2002. Note that in FIG. 25, reference numeral 2010 denotes the cleaning device of the intermediate transfer belt 2002.

The secondary transfer device 2009 comprises a transfer belt 2009C hung over a charging driving roller 2009A and slave roller 2009B so as to be capable of moving in the same direction as the intermediate transfer belt 2002 at a second transfer position where the secondary transfer device 2009 is situated, and is capable of transferring onto recording sheets which, are transported by electrostatic adsorption by charging the transfer belt 2009C with the charging driving roller 2009A, a multip-color image superimposed on the intermediate transfer belt 2002 all at once, or each of mono-color images being carried.

Recording sheets are supplied to the secondary transfer position from the sheet supplying unit 2001B. The sheet supplying unit 2001B comprises multiple sheet supplying cassettes 2001B1, multiple transporting rollers 2001B2 disposed in the transporting path of the recording sheets fed out from the sheet supplying cassettes 2001B1, and a resist roller 2001B3 situated in front of the secondary transfer position. With the present embodiment, a configuration capable of feeding recording sheets of types not stored in the sheet supplying cassettes 2001B1 to the secondary transfer position is provided in addition to the transporting path of the recording sheets fed out from the sheet supplying cassettes 20011, and this configuration has a hand feed tray 2001A1 provided such that a portion of the wall face of the image formation unit 2001A can be erected or laid down, and a feeding roller 2001A2.

Along the transporting path of the recording sheets from the sheet supplying cassettes 2001B1 toward the resist roller 2001B3, the transporting path of the recording sheets fed out from the hand feed tray 2001A1 merges, so recording sheets from either transporting path have the resist timing set by the resist roller 2001B3.

At the writing device 2005 (denoted by reference numeral 2005B in FIG. 25 for ease of description), writing light is controlled by image information obtained by scanning the document on the document loading table 2001C1 of the document scanning unit 2001C or image information output from an unshown computer, and electrostatic images corresponding to the image formation are formed on the photosensitive members 2003B, 2003Y, 2003C, and 2003M.

A scanner 2001C2 for scanning the document on the document loading table 2001C1 is provided to the document scanning unit 2001C, and further, an Automatic Document Feeder 2001C3 is disposed on the upper face of the document loading table 2001C1. The Automatic Document Feeder 2001C3 has a configuration capable of inverting documents being fed onto the document loading table 2001C1, so that both the front and rear faces of documents can be scanned.

The latent images formed by the writing device 2005 on the photosensitive members 2003 (the members denoted by the reference numerals 2003B, 2003Y, 2003C, and 2003M in FIG. 25) are subjected to visualizing processing by a developing device 2006 (denoted by reference numeral 2006B in FIG. 25 for ease of description), and subjected to primary transfer onto the intermediate transfer belt 2002. Upon toner images of each color being superimposed in transfer as to the intermediate transfer belt 2002, these are subjected to secondary transferring to a recording sheet by the secondary transfer device 2009 all at once.

Recording sheets subjected to secondary transferring have the unfixed image carried on the surface thereof fixed by a fixing device 2011. The fixing device 2011 has a belt fixing configuration comprising a fixing belt heated by a heating roller, and a pressurizing roller facing and coming into contact with the fixing belt, though the details are no shown in the drawing, so that the heating region of the recording sheets can be made wider than the fixing configurations of other roller methods by providing a contact region between the fixing belt and the pressurizing roller, i.e., a nip region.

Recording sheets that have passed through the fixing device 2011 have the transporting direction thereof changed by a transporting path switching claw 2012 disposed behind the fixing device 2001, whereby the transporting direction is selected from a transporting path toward a discharge tray 2013 and an inverse transporting path RP.

With the color printer 2001 having a configuration as described above, an electrostatic image is formed on the uniformly-charged photosensitive member 2003, by image information obtained by scanning a document on the document loading table 2001C1 or image information output from an unshown computer, and following visualizing processing of the electrostatic latent image by the developing device 2006, a toner image is subjected to primary transfer onto the intermediate transfer belt 2002.

The toner image which is transferred onto the intermediate transfer belt 2002 is transferred without change onto a recording sheet fed out from the sheet supplying unit 2001B in the event of a mono-color image, and in the event of a multi-color image primary transfer is repeated whereby toner images are superimposed, and then subjected to secondary transfer all at once to a recording sheet. The recording sheet following secondary transfer has the unfixed images thereupon fixed by the fixing unit 2011, and then fed toward the discharge tray 2013 or reversed and fed to the resist roller 2001B3 again.

In FIG. 25, while details are not shown, the intermediate transfer belt 2002 comprises a base layer formed of a base portion made up of a material such as a fluororesin which stretches little, or canvas which does not readily stretch on a rubber material which stretches greatly, and an elastic member layer formed on this base layer, using fluororubber or acrylonitrile-butadiene copolymer rubber or the like. The surface of the elastic member layer has a coat layer and is covered with fluororesin to improve smoothness.

The intermediate transfer belt 2002 is hung over at least supporting rollers 2002A and 2002B which are a pair of rollers, and a roller 2002C having back-up functions and is driven by counter-clockwise rotations of the driving roller 2002A. The face expanded between the supporting rollers 2002A and 2002B, i.e., a flat face with no curves, faces the photosensitive members 2003B, 2003Y, 2003C, and 2003M of each image formation unit. At the positions facing each photosensitive member across the intermediate transfer belt 2002 are provided transfer rollers 2002D for performing electrostatic transfer of the visible image on the photosensitive members.

Figure 26:
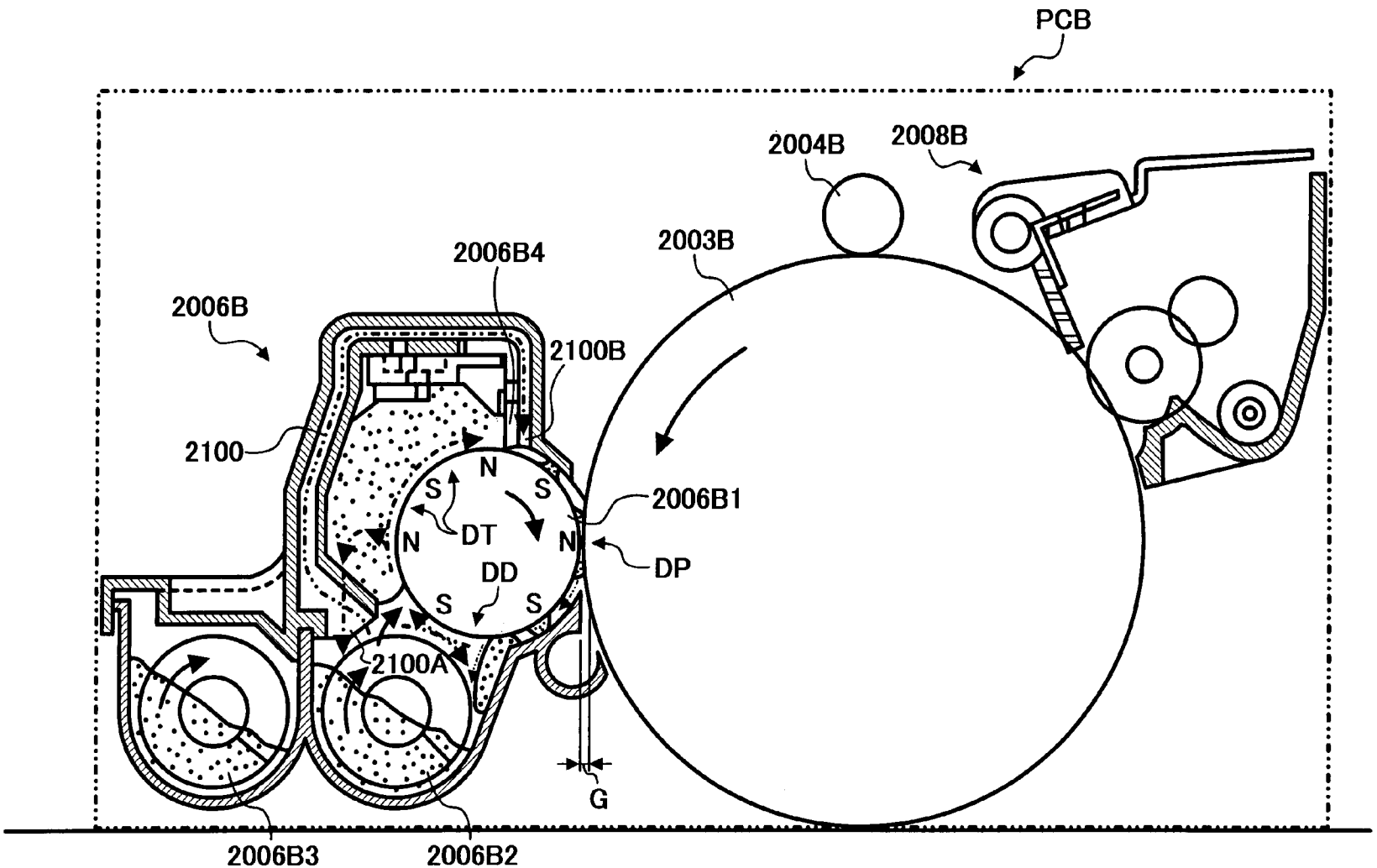
FIG. 26 is a model diagram describing the process cartridge having the developing device according to an embodiment of the present invention.

With the image formation apparatus 2001 shown in FIG. 25, the photosensitive member positioned at the image formation unit 2001A is stored in a process cartridge shown in FIG. 26. FIG. 26 illustrates the process cartridge (denoted with the reference symbol PCB) for the photosensitive member indicated with the reference numeral 2003B at the image formation unit 2001A shown in FIG. 25, and in this drawing, the housing making up the process cartridge PCB has a configuration wherein the inside is almost airtight except for the portion where the developing sleeve 2006B1 facing the photosensitive member 2003B is exposed, and stored in side are the photosensitive member 2003B and also a charging device 2004B, developing device 2006B, and cleaning device 2008B, for image formation processing thereupon. The developing device 2006B within the process cartridge PCB is capable of forming a magnetic brush using a two-component developing agent wherein toner and magnetic carrier are mixed, and as a configuration to this end, comprises a developing sleeve 2006B1 which has fixed magnetic poles on the interior and rotates around these, and a pair of screw members 2006B2 and 2006B3 having augers such that the stirring-transporting direction of the developing agent is mutually in the opposite direction.

The developing sleeve 2006B1 is capable of bringing the magnetic brush into contact with the photosensitive member 2003B by being exposed from the exposing opening formed in the housing, and developing agent prior to coming into contact with the photosensitive member 2003B is drawn up by the screw member 2006B2 so as to be carried on the circumferential face thereof. The magnetic brush carried on the circumferential face of the developing sleeve 2006B1 has the layer thickness thereof restricted by a doctor blade 2006B4 at the stage before reaching the developing region (developing nip) DP where contact is made with the electrostatic latent image on the photosensitive member 2003B.

The fixed electrodes used for forming the magnetic brush on the perimeter face of the developing sleeve 2006B1 comprise a transporting region DT wherein opposite poles are adjacent one to another, for transporting the developing agent which has been drawing up, and a developing-agent-dropping repelling magnetic field formation region DD wherein the same poles are adjacent one to another at a position facing a position following the developing agent which has been restricted in layer thickness passing a developing region DP where the bristling state is maintained.

The developing agent drawn up by the screw member 2006B2 and carried on the circumferential face of the developing sleeve 2006B1 is subjected to layer thickness restriction by the blade 2006B4 and comes into contact with the electrostatic latent image on the photosensitive member 2003B, and thus is applied to visualizing processing. The developing agent remaining on the developing sleeve 2006B1 following passing the developing region DP is peeled off from the developing sleeve 2006B1 by the repelling magnetic field upon reaching the developing-agent-dropping repelling magnetic field formation region DD, and falls down. The developing sleeve 2006B1 carries developing agent on the circumferential face thereof by the drawing up from the screw member 2006B2 again, and subsequently repeats layer thickness restriction, passing the developing region DP, and passing the developing-agent-dropping repelling magnetic field formation region DD.

The feature of the embodiment shown in FIG. 26 is that the positive pressure portion and negative pressure portion generated at the upstream side and downstream side in the direction of motion of the developing agent, employing the magnetic brush moving along the housing wall of the developing device 2006B as a boundary, are made to communicate. That is to say, the magnetic brush generates a pumping action in the same way as a piston within a cylinder by moving in contact over the inner wall of the housing, so that the upstream side in the direction of movement is in a positive pressure state and the down stream side in the direction of movement is in a negative pressure state.

On the other and, within the developing device, there are portions generated wherein the density of air increases due to the above-described positive pressure state being yielded, so pressure increases at the portions with the high air density. Accordingly, with the present embodiment, a communicating channel is provided having the starting end opening and the ending end opening at the positive pressure portion and the negative pressure portion, thereby allowing the air at the portion with increased pressure to escape to the negative pressure portion.

In FIG. 26, the communicating channel 2100 is configured of an exhaust path, such that the starting end opening portion 2100A positioned in the positive pressure portion is positioned in a developing agent moving path at the side where drawing up of the developing agent is started by the screw member 2006B2, and the ending end opening portion 2100B positioned in the negative pressure portion is positioned behind the doctor blade 2006B4 which is the layer thickens restricting member in the direction of movement of the developing agent. Behind the doctor blade 2006B4 where the ending end opening portion 2100B is positioned, a negative pressure tendency occurs due to the pumping action by the air being dammed by the doctor blade 2006B4. Accordingly, communicating this with the starting end opening portion 2100A in a positive pressure state generates a pressure difference, whereby air can be communicated.

Figure 27:
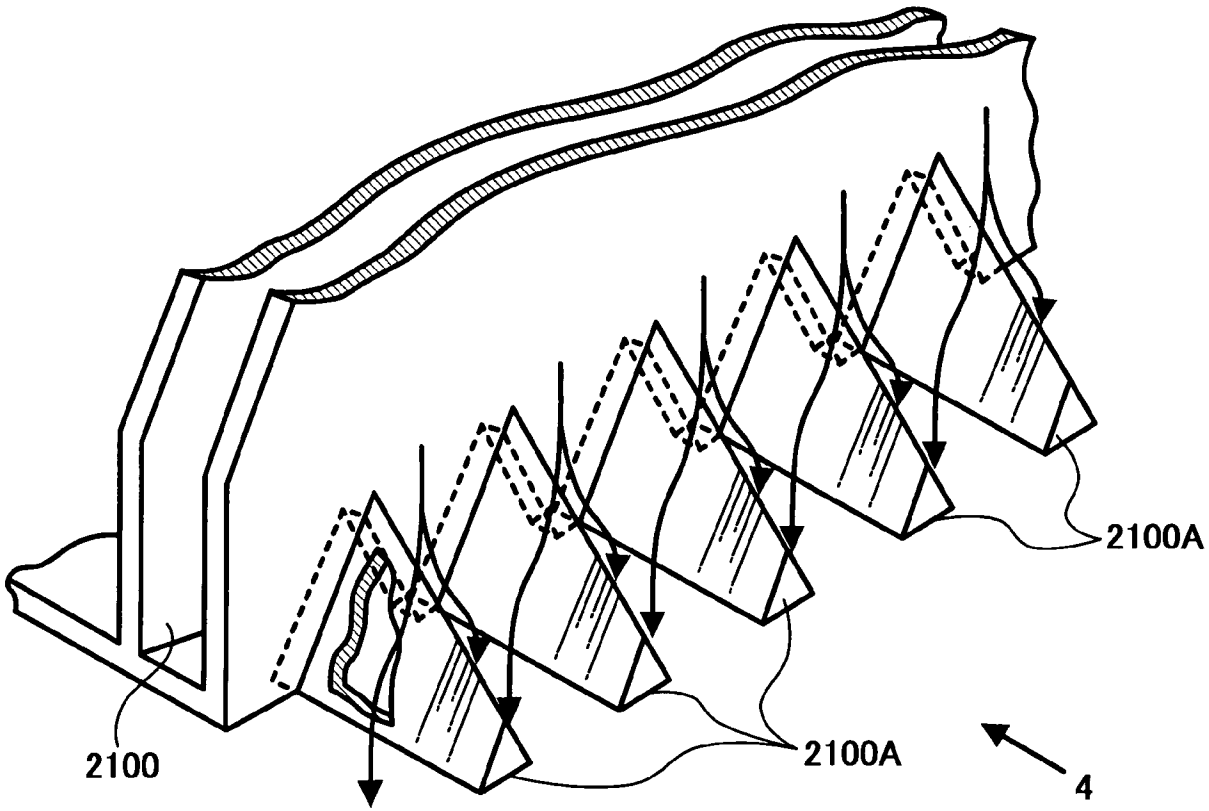
FIG. 27 is a partial perspective view illustrating the configuration of the starting end opening provided at a positive pressure portion used with the developing device shown in FIG. 26.
Figure 28:
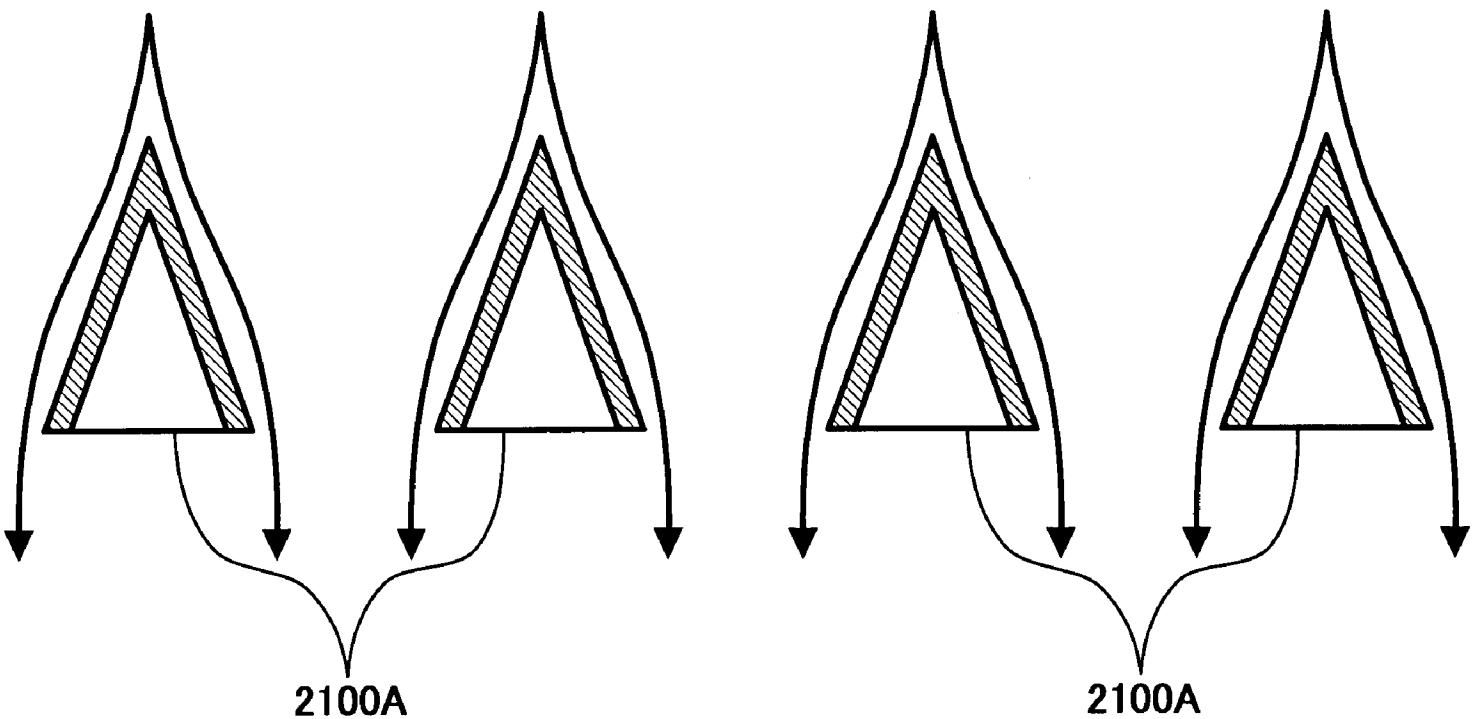
FIG. 28 is a view along the direction of the arrow denoted by reference numeral (4) in FIG. 27.

As shown in detail in FIG. 27 and FIG. 28, the starting end opening portion 2100A has shapes formed which widen in the direction from the upper portion to the lower portion in the direction of the developing agent which has been drawn up by the developing sleeve 2006B1 falling (the direction indicated by the arrow), triangular shapes in a frontal view, and has openings formed at the widened portions.

A plurality of the starting end opening portions 2100A having the triangular roof portion are positioned in the axial direction of the developing sleeve 2006B1 as shown in FIG. 28, and the portions equivalent to the eaves of the roof extend into the developing agent moving path at the starting side of drawing up the developing agent by the screw member 2006B2, as shown in FIG. 26.

The position of extending into the developing agent moving path is a position where the direction of movement of the developing agent drawn up by the screw member 2006B2 changes according to the rotational direction of the developing sleeve 2006B1. Accordingly, upon the developing agent entering a so-called floating state not receiving effects of the motive force so far at the point of the direction of motion thereof being switched, the air which had been following the motion of the developing agent so far peels away from the developing agent due to inertia, and is readily taken into the starting end opening portions 2100A. Particularly, due to the negative force from the ending end opening 2100B side acts upon the starting end opening portions 2100A, the air which has little mass as compared to the developing agent is readily taken in.

While multiple starting end opening portions 2100A are positioned in the axial direction of the developing sleeve 2006B1, a configuration is used as the connecting structure with the ending end opening 2100B such that the pressure distribution in the axial direction of the developing sleeve 2006B1 is uniform. The reason for this is as follows.

Figure 29:
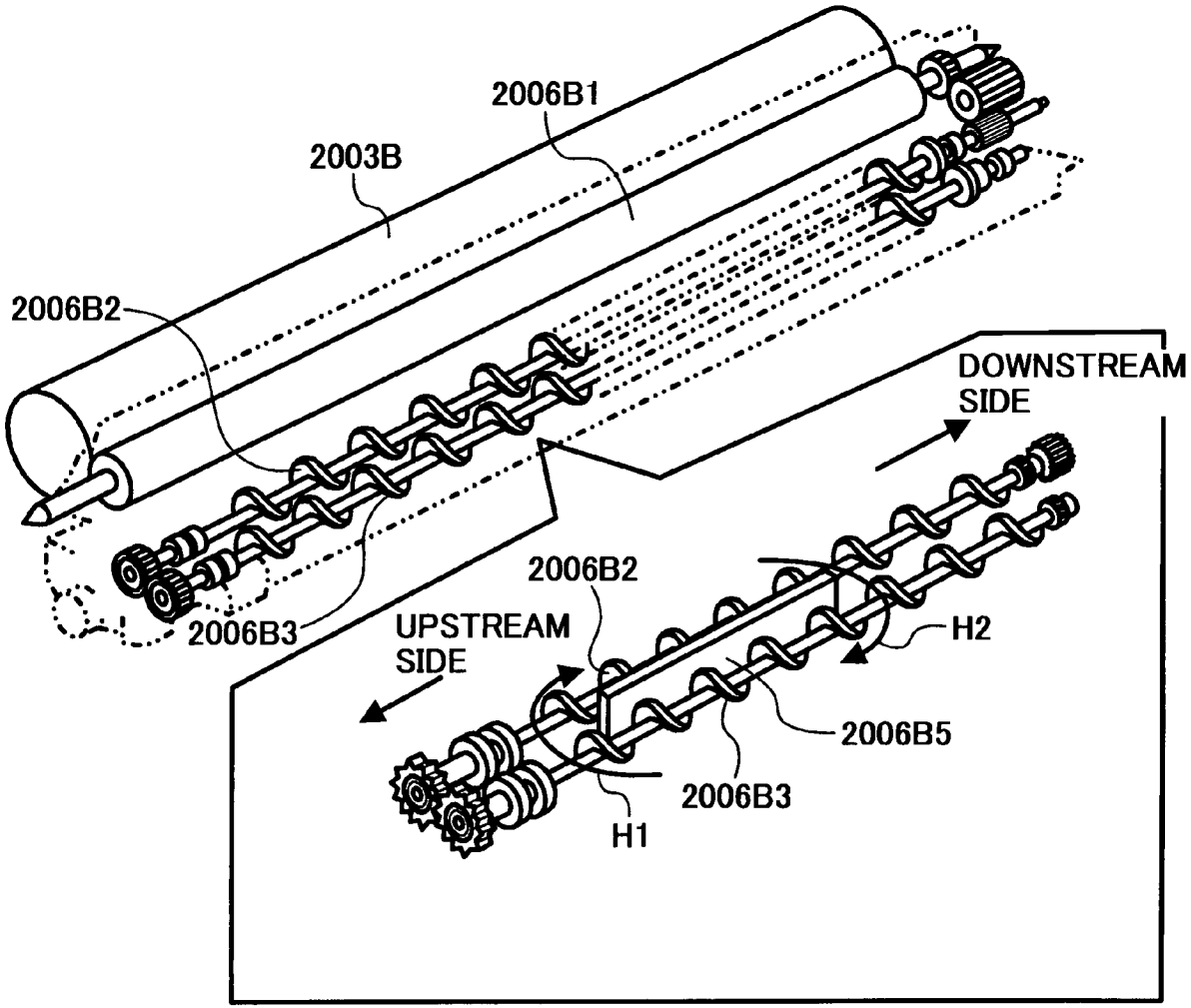
FIG. 29 is a partial perspective view illustrating the displacement configuration of the screw members used in the developing device.
Figure 30:
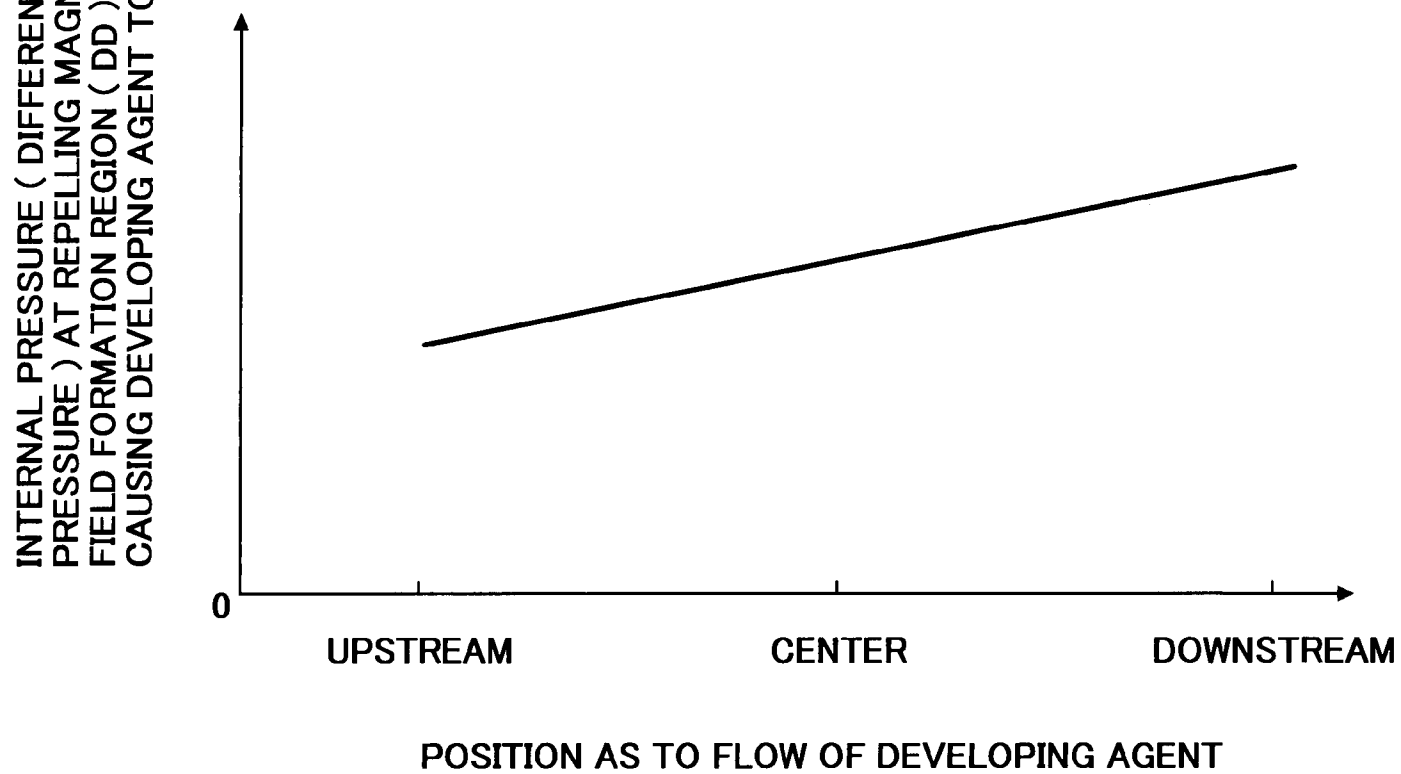
FIG. 30 is a graph explaining the pressure distribution at the ends and the center portion in the axial direction of the screw members shown in FIG. 29.

FIG. 29 is a diagram illustrating the placement configurations of screw members 2006B2 and 2006B3. As shown in the drawing, the screw members 2006B2 and 2006B3 have the stirring-transporting paths of the developing agent separated by a sectioning member 2006B5 positioned at the center portion therebetween in the axial direction, so as to transport the developing agent in mutually opposite directions (the directions indicated by the arrows H1 and H2). In the partially enlarged diagram shown in FIG. 29, in a case wherein one axial direction is the upstream side in the transporting direction, and the other axial direction is the downstream side in the transporting direction, the pressure distribution of the developing agent at the upstream side, center, and downstream side position in the transporting direction, is not uniform, as shown in FIG. 30.

Figure 31:
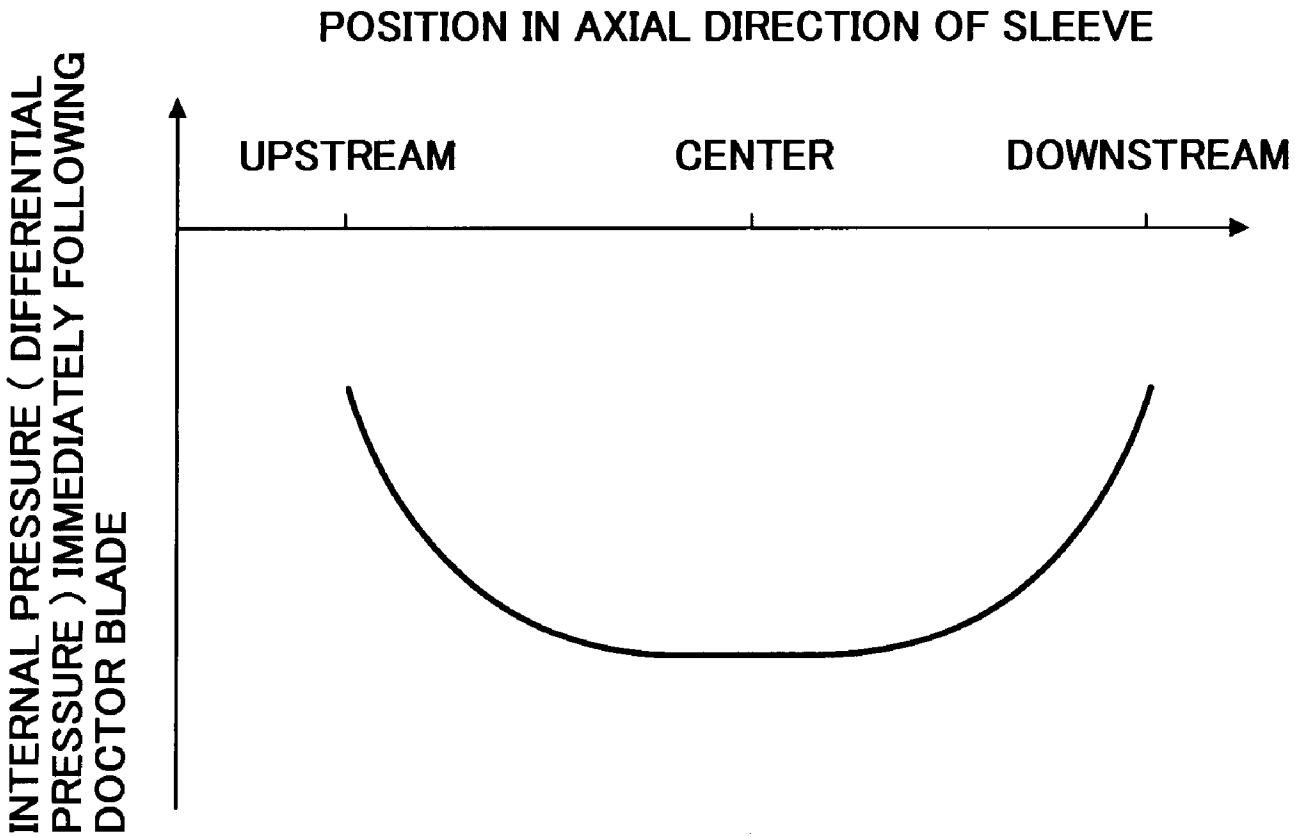
FIG. 31 is a graph explaining the pressure distribution at positions corresponding to the ends and the center portion in the axial direction of the developing sleeve, at the portion where the negative pressure inclination occurs.

On the other hand, the state of the negative pressure in the axial direction of the developing sleeve 2006B1 behind the doctor blade 2006B4 where the ending end opening 2100B is positioned, is not a uniform distribution, as shown in FIG. 31. This is due to depressurization owing to convolution of the atmosphere at both end portions in the axial direction.

Accordingly, connecting the starting end opening 2100A at the outside position in the axial direction of the developing sleeve 2006B1 with the ending end opening 2100B positioned at the center position in the axial direction of the developing sleeve 2006B1 allows the pressure distribution to be made uniform.

Figure 32:
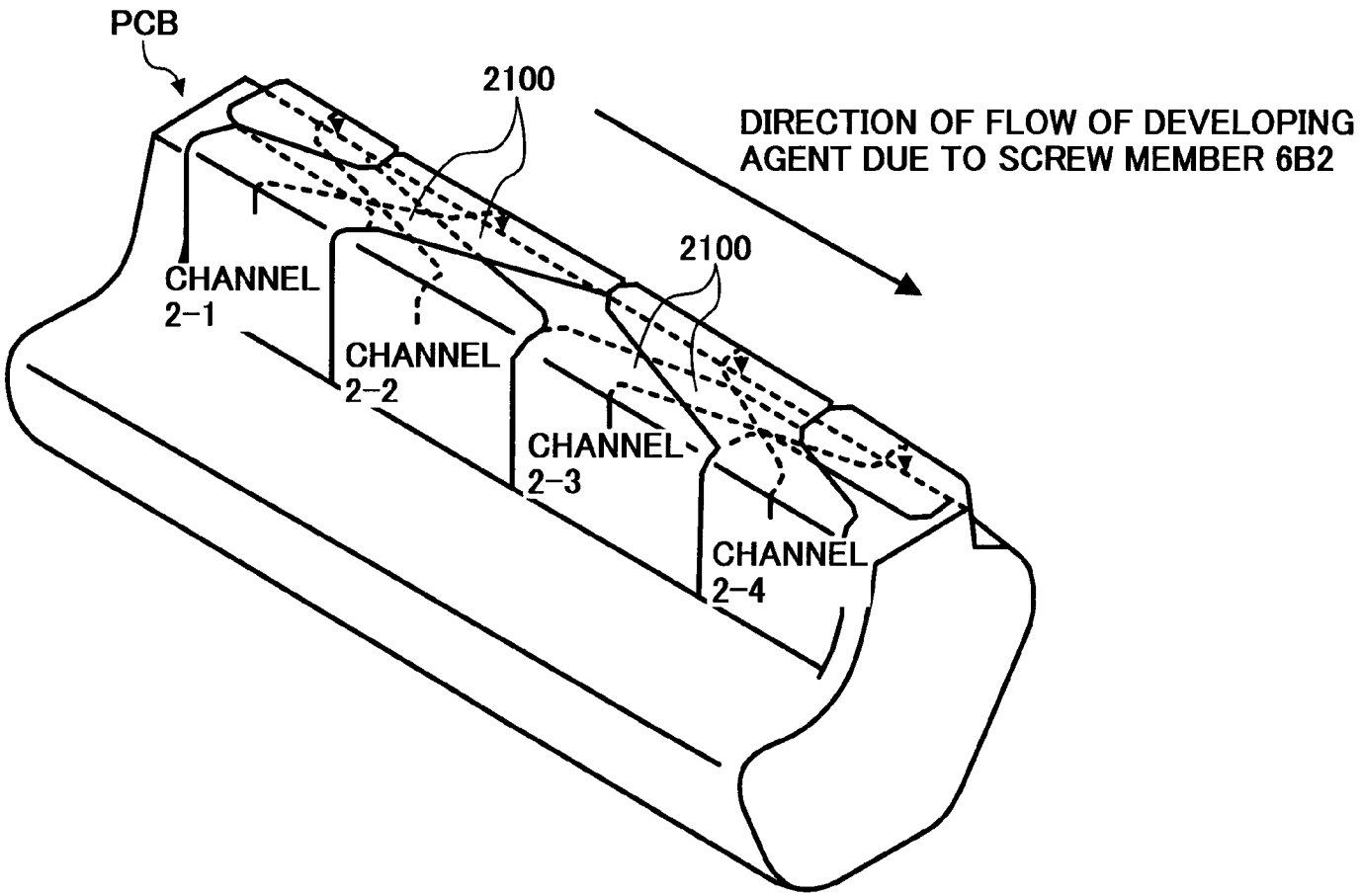
FIG. 32 is a perspective view describing a configuration for making the pressure distribution shown in FIG. 29 and FIG. 30 uniform.

With the present embodiment, due to the above-described reason, the multiple starting end openings 2100A and ending end openings 2100B arrayed in the axial direction of the developing sleeve 2006B1 are connected such that the position wherein the pressure at the starting end opening is high is connected to the position wherein the pressure at the ending end opening is low, and the position wherein the pressure at the starting end opening is not so high is connected to the position wherein the pressure at the ending end opening is not so low, as shown in FIG. 32. FIG. 32 illustrates the connection state of the openings with arrows.

The present embodiment has a configuration such as described above, and accordingly, the channel 2100 is provided with the starting end opening 2100A being positioned where increased inner pressure is marked due to drawing up of developing agent being started, and the ending end opening 2100B being positioned where there is a negative pressure tendency due to pumping, whereby an air communicating channel can be configured within the developing device 2006B. Accordingly, the inside of the developing device 2006B can be reduced without necessitating negative pressure generating means, and scattering of toner due to increased pressure can be prevented.

Next, another embodiment of the present invention will be described. The present embodiment features, as a configuration for allowing air to flow between a positive pressure portion and a negative pressure portion, positioning the starting end opening at the developing-agent-dropping repelling magnetic field formation region and the ending end opening behind the doctor blade.

Figure 33:
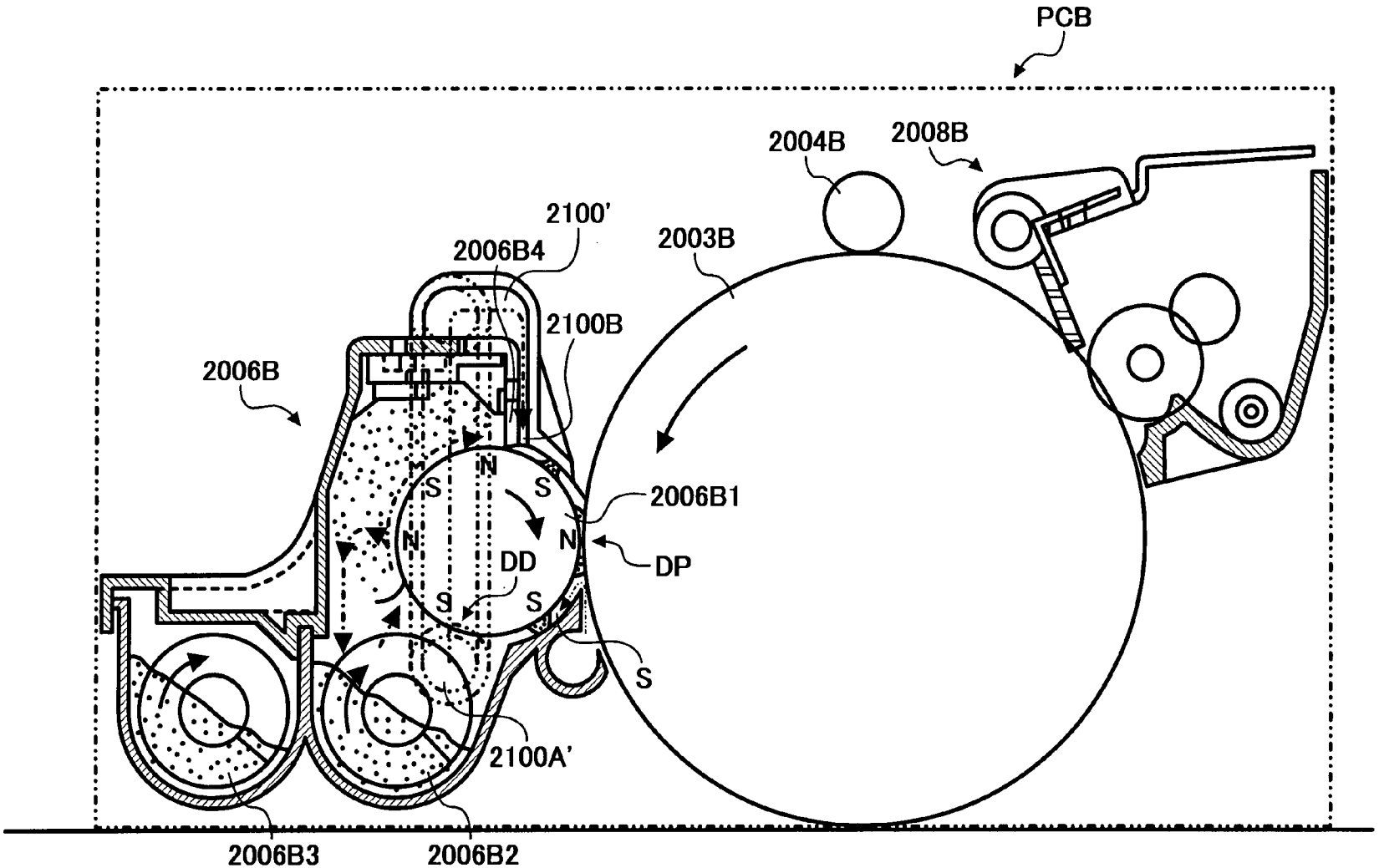
FIG. 33 is a model diagram illustrating the configuration of principal components of the developing device according to another embodiment of the present invention.

FIG. 33 is a diagram illustrating the configuration of the present embodiment, and the portions other than the feature portion described below are the same as the members used in the configuration shown in FIG. 26, so description thereof will be omitted and only the reference numerals will be included.

In FIG. 33, the channel 2100' for communicating between the positive pressure portion and the negative pressure portion has the starting end opening 2100A' positioned at the developing-agent-dropping repelling magnetic field formation region DD at the developing sleeve 2006B1 and the ending end opening 2100B' positioned behind the doctor blade 2006B4.

With the present embodiment, an exhaust path for the starting end opening 2100A' is formed by communicating between the developing-agent-dropping repelling magnetic field formation region DD where increased inner pressure is marked inside the developing device 2006B, and behind the doctor blade 2006B4 where there is a tendency for negative pressure. Thus, the increased pressure at the developing-agent-dropping repelling magnetic field formation region is resolved due to flow of air due to the pressure difference with the negative pressure generated by the ending end opening 2100B.

In the present embodiment, the pressure at the position where the air pressure increases due to the surface layer air of the developing sleeve 2006B1 and the screw member 2006B2 merging at the position where these components face one another, leading to increased pressure, can be reduced. Accordingly, the developing agent remaining on the developing sleeve 2006B1 after passing through the developing position DP is not dammed up in front of the developing-agent-dropping repelling magnetic field formation region, so the gap (denoted by symbol S in FIG. 33 for ease of description) between the circumferential surface of the developing sleeve 2006B1 reaching the developing-agent-dropping repelling magnetic field formation region DD and the opposing face of the housing can be used as a toner suctioning space. Consequently, scattering of toner can be prevented in a sure manner, due to toner suctioning not being obstructed.

Figure 34:
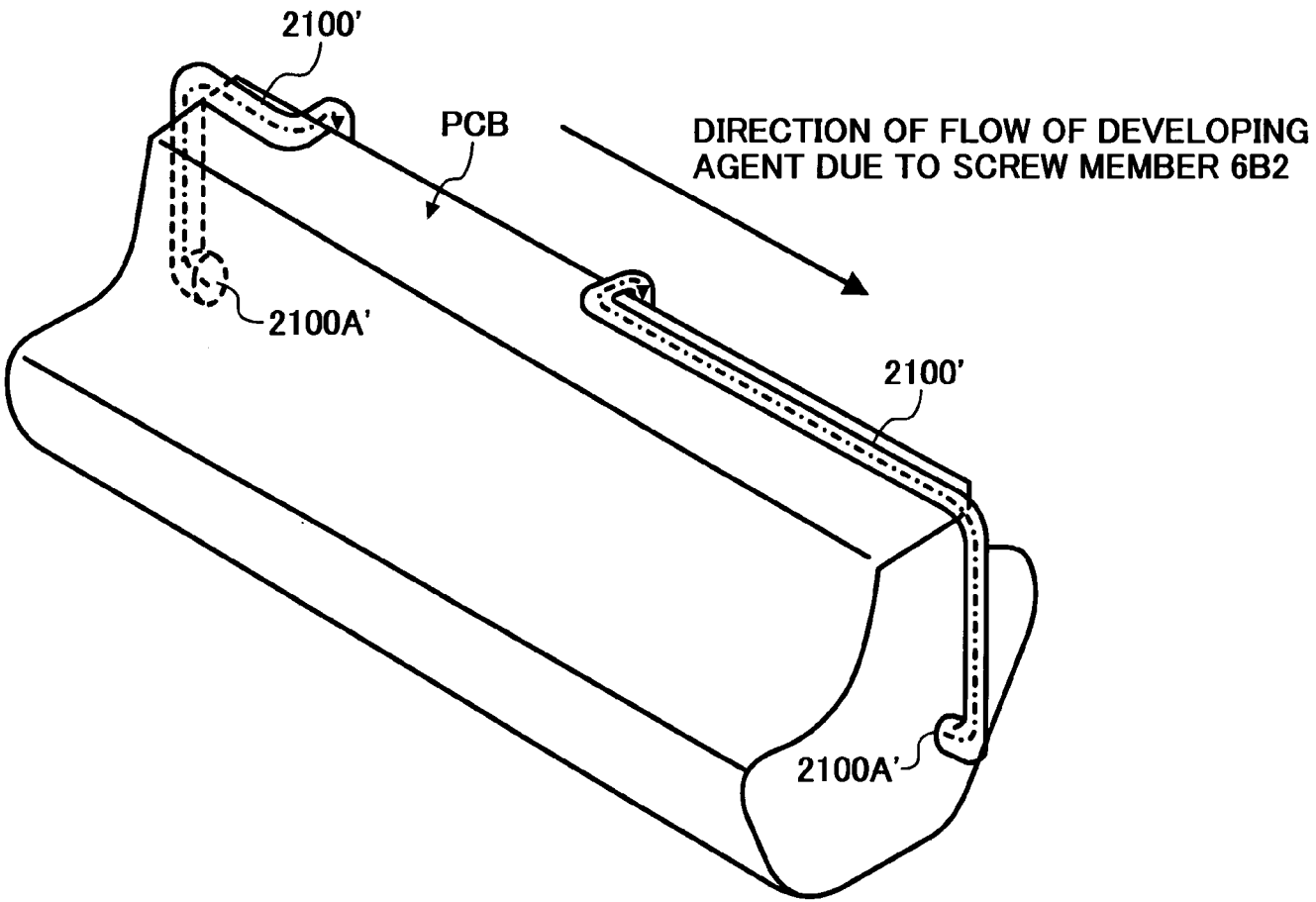
FIG. 34 is a perspective view describing a configuration for making the pressure distribution in the configuration shown in FIG. 32 uniform.

In the present embodiment as well, the starting end openings 2100A' in connected to the developing-agent-dropping repelling magnetic field formation region at the end portions in the axial direction of the developing sleeve 2006B1 are connected by channels with the ending end openings 2100B as shown in FIG. 34, in the same way as the case shown in FIG. 33, to make the pressure distribution in the axial direction uniform.

Next, another embodiment according to the present invention will be described. The feature of the present embodiment is that the position in the housing of the developing device past the developing position in the direction of rotation of the developing sleeve is set so that the gap with the photosensitive member is smaller than the facing gap at the developing position.

In FIG. 26, the facing gap G between the photosensitive member 2003B and the housing of the developing device 2006B at the position where the developing sleeve 2006B1 has passed the developing position DP is set so as to be smaller than the facing gap between the developing sleeve 2006B1 and the photosensitive member 2003B at the developing position. Accordingly, toner remaining on the developing sleeve 2006B1 past the developing position DP can be prevented from leaking out, and the flow speed of the air at the time of the air passing can be speeded up to increase the suctioning force, since the air flow channel has been narrowed down. Note that with regard to suctioning of toner, the percentage of increase of the flow speed is increased markedly in the event that the starting end opening 2100A' is positioned in the developing-agent-dropping repelling magnetic field formation region DD where pressure increase is marked as shown in FIG. 33, thereby improving the efficiency of toner suctioning.

Figure 35:
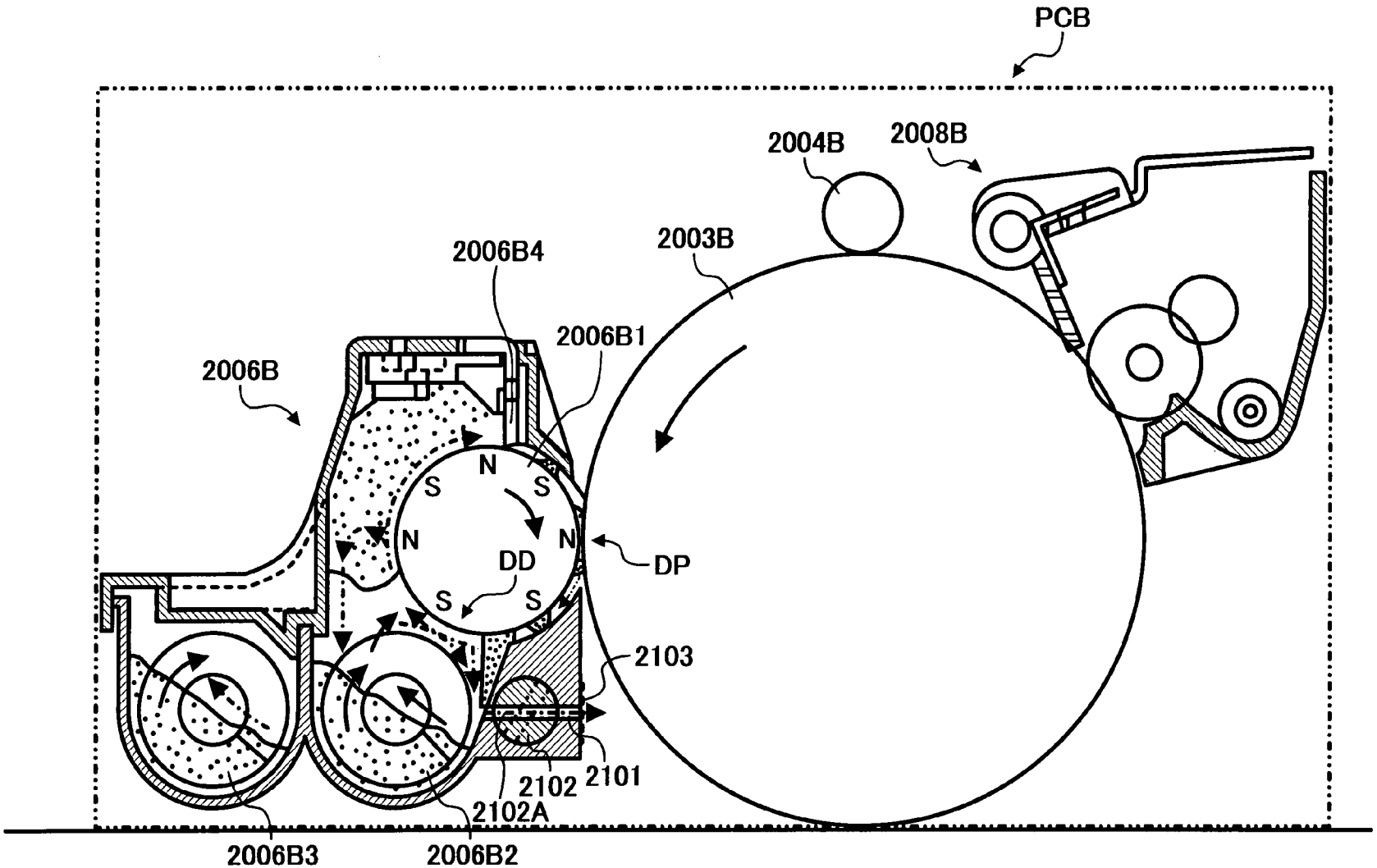
FIG. 35 is a model diagram illustrating a partial modification of the configuration of principal components of the developing device shown in FIG. 31.

Next, a partial modification of the present embodiment will be described. FIG. 35 illustrates an example wherein a channel 2101 is provided capable of communicating the developing-agent-dropping repelling magnetic field formation region DD in the configuration shown in FIG. 33 with the external air so as to release to the atmosphere, wherein the channel 2101 is capable of being opened and closed.

In FIG. 35, the channel 2101 which is the communicating portion between the developing-agent-dropping repelling magnetic field formation region DD and the external air comprises a rotatably supported opening/closing valve 2102, with a channel 2102A provided to the opening/closing valve 2102, configured so as to penetrate in the diameter direction. The opening/closing valve 2102 is provided to prevent the developing agent existing at the developing-agent-dropping repelling magnetic field formation region DD from undesirably entering the channel 2101 and closing off the channel 2101. That is to say, at the developing-agent-dropping repelling magnetic field formation region DD, the developing agent forms icicle-shaped formations due to the repelling force of the magnetic poles of the same polarity, and the density of the developing agent contained therein is small. Accordingly, in the event that the developing agent is situated near the opening at the side of the developing-agent-dropping repelling magnetic field formation region DD, the icicle-shaped formations may break due to shock and enter the channel 2101, since the density of the developing agent is small. Accordingly, with the preset configuration, the channel 2101 is closed beforehand with the opening/closing valve 2102 in cases wherein shock would be applied. Note that reference numeral 2103 denotes a filter provided at the opening at the atmosphere side, for obstructing the blowing out of developing agent.

With the present configuration, upon the process cartridge PCB being mounted or detached, or at the time of image formation standby, the opening/closing valve 2102 closes so as to allows the path 2102A and the channel 2101 to be shut off. Accordingly, no developing agent within the developing device 2006B undesirably leaks out. Also, in the event that the process cartridge is mounted within the image formation apparatus 2001 or at the time of image formation, the path 2102A of the opening/closing valve 2102 and the channel 2101 communicate. Accordingly, the air within the developing-agent-dropping repelling magnetic field formation region DD is released into the atmosphere via the channel 2101 and the path 2102A, so the developing-agent-dropping repelling magnetic field formation region DD is released to the atmosphere and the pressure drops. Accordingly, in the same way as the case using the configuration shown in FIG. 33, air can be allowed to escape from portions where increased pressure is marked so as to reduce the pressure thereof, and prevent scattering of toner within the developing device 2006B due to the increased pressure. Moreover, unlike the case illustrated in FIG. 33, there is no need to provide a detour path to behind the doctor blade 2006B4, and all that is necessary is to configure a channel using the wall of the housing facing the developing-agent-dropping repelling magnetic field formation region, so the channel length can be minimized, and accordingly, loss of pressure due to the pipe resistance for the air flowing through the channel can be minimized.

Now, with regard to the visualizing processing of the electrostatic latent image according to the developing device, depending on change in charging properties of the toner within the developing agent which affect image properties, and particularly change in humidity, phenomena such as toner fogging wherein excessive toner adheres occur, resulting in an abnormal image.

Accordingly, with the present invention, an arrangement is made so as to supply humidity-adjusted air to the interior of the developing device. This configuration will be described below.

Figure 36:
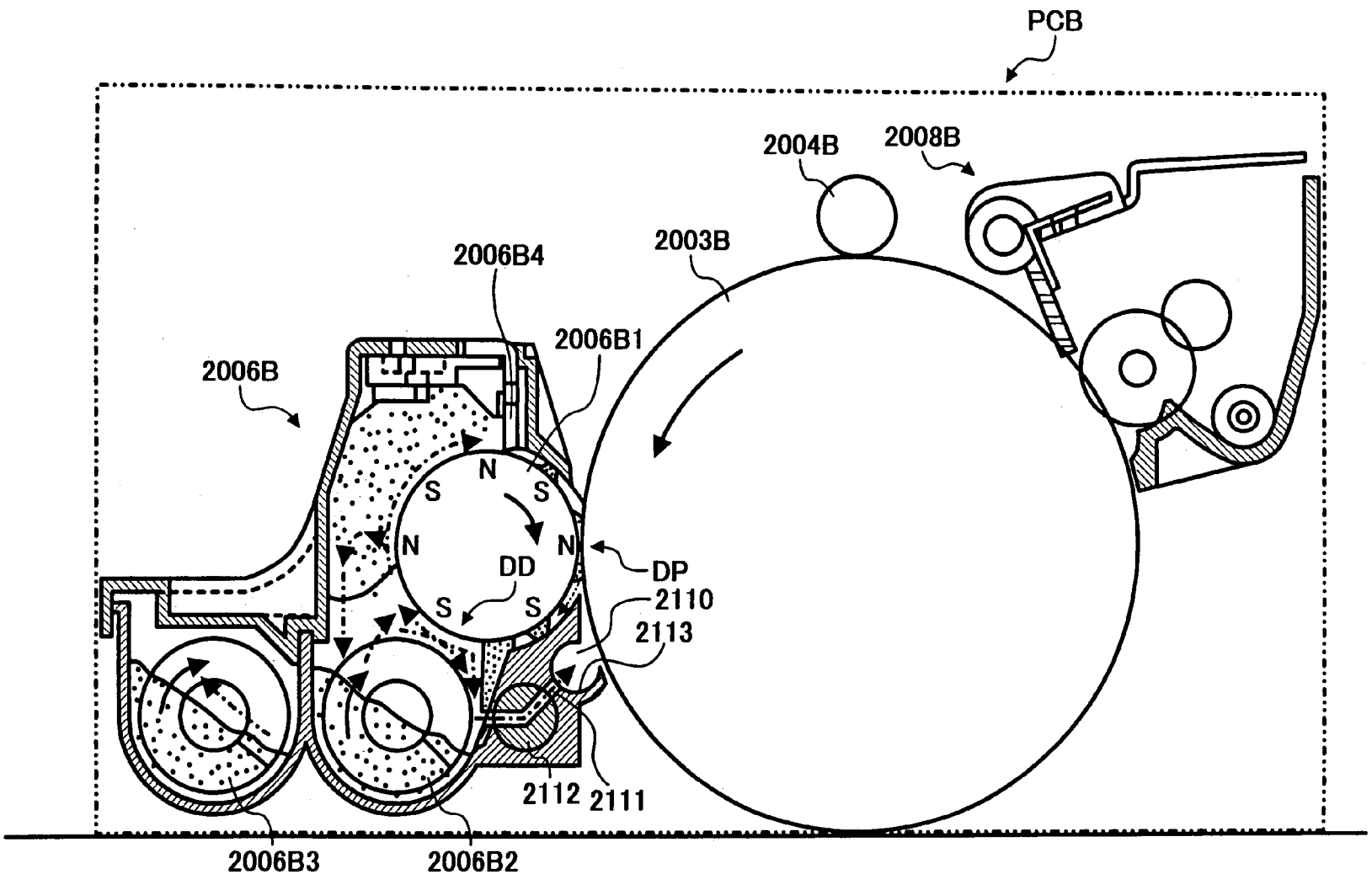
FIG. 36 is a model diagram illustrating yet another modification of the principal components of the developing device shown in FIG. 31.

In FIG. 36, in the developing device 2006B provided in the process cartridge PCB, a circulation chamber 2110 having space released to the atmosphere is provided at the portion of the housing side facing the developing sleeve 2006B1 which has passed through the developing position DP.

At the circulation chamber 2110, humidity-adjusted air is circulated with the air suctioned using the negative pressure generated at the downstream side in the direction of movement of the magnetic brush carried on the developing sleeve 2006B1 which has passed through the developing position DP.

On the other hand, the other end of a channel 2111 having one end opened at the developing-agent-dropping repelling magnetic field formation region DD of the developing device 2006B is opened in the circulating chamber 2110 so as to communicate. The channel 2111 sets the state of communication between the circulating chamber 2110 and the developing-agent-dropping repelling magnetic field formation region DD through an opening/closing valve 2112 provided thereupon. That is to say, as with the configuration shown in FIG. 35 at the time of mounting or detaching the processes cartridge PCB or in image formation standby, the opening/closing valve 2112 closes the channel 2111. On the other hand, a filter 2113 is provided at the opening to the side of the circulating chamber 2110 at the channel 2111, so as to prevent developing agent from blowing out.

With this configuration, while the air within the developing device 2006B can be made to circulate within the circulating chamber 2110, the humidity within the developing device 2006B can be maintained in an optimal state, due to supplying humidity-adjusted air, the air suctioned in using the negative pressure due to pumping generated by the magnetic brush carried on the developing sleeve 2006B1 which has passed through the developing position is humidity-adjusted air.

On the other hand, using a configuration wherein atmospheric release can be performed through the circulating chamber 2110 and the developing-agent-dropping repelling magnetic field formation region DD which is a portion where increased pressure is marked in the developing device 2006B, allows the pressure at the developing-agent-dropping repelling magnetic field formation region DD to be reduced by being discharged to the atmosphere, so inability to suction toner due to increased pressure within the developing device 2006B can be prevented, and scattering of toner can be prevented.

Next, an embodiment corresponding to the fourth object of the present invention will be described.

Figure 37:
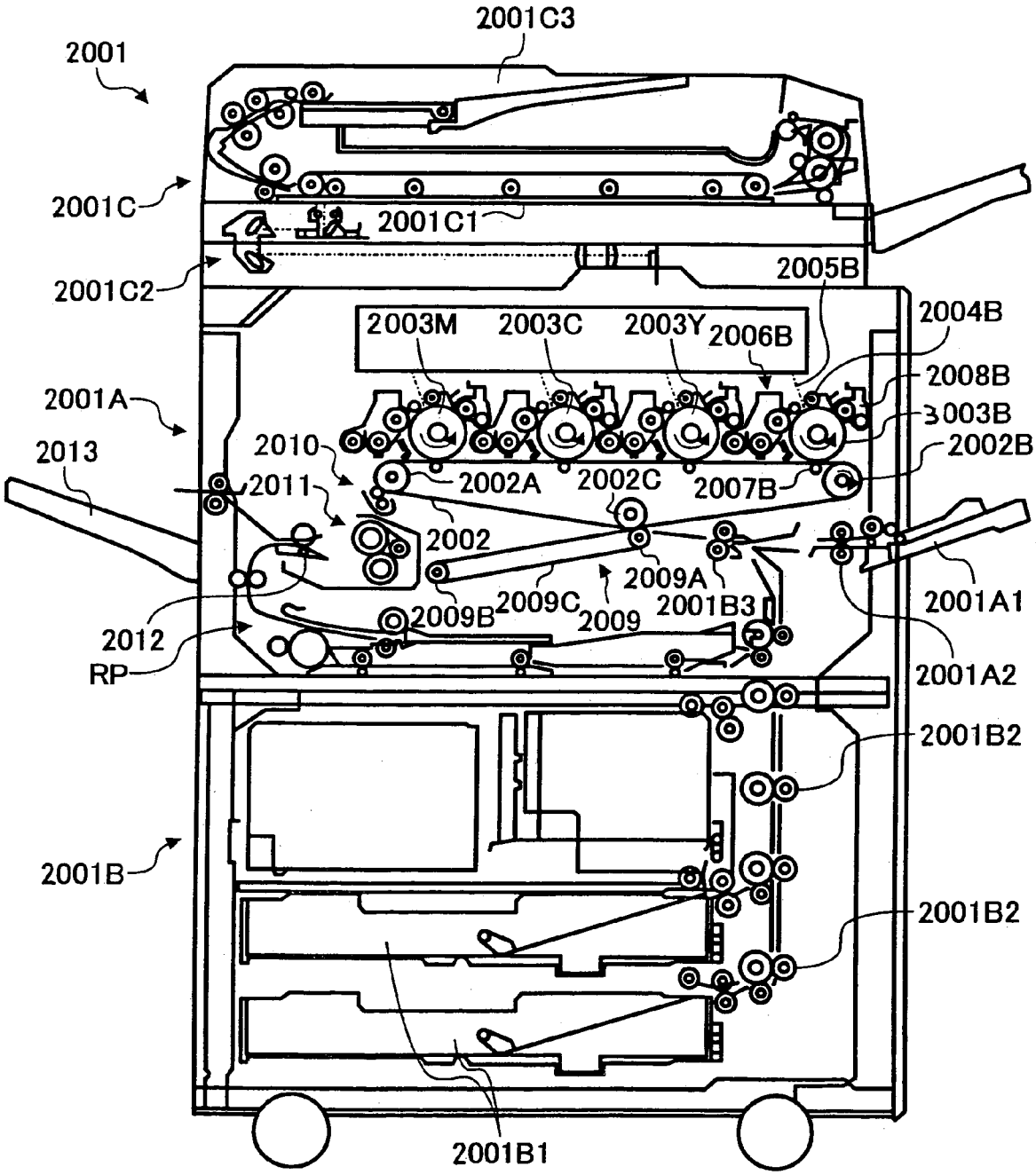
FIG. 37 is a model diagram illustrating an image formation apparatus to which the developing device according to an embodiment of the present invention is applied.
Figure 38:
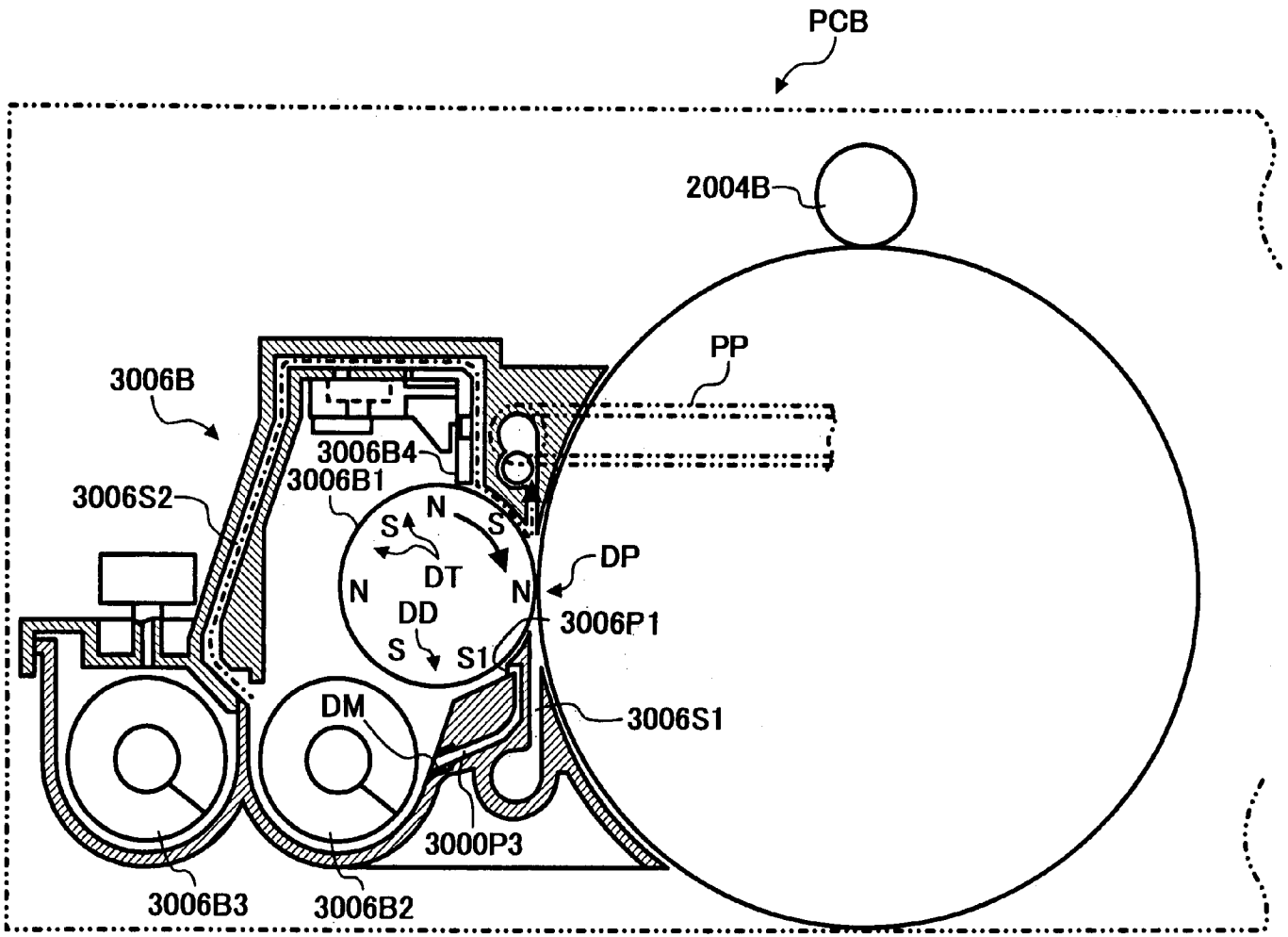
FIG. 38 is a model diagram describing the process cartridge in which the developing device according to an embodiment of the present invention is built.

FIG. 37 illustrates an image formation apparatus to which has been applied the developing device according to the present embodiment of the present invention, and FIG. 38 illustrates a processing cartridge (denoted by symbol PCB for ease of description) for a photosensitive member. For the apparatus shown in FIG. 37, that described in the embodiment corresponding to the third object according to the present invention will be used with some of the reference numerals changed.

The feature of the embodiment shown in FIG. 38 is in having a configuration for preventing scattering of developing agent, which enters the housing 3006H of the developing device 3006B (see FIG. 39) following passing the developing region DP, outside of the developing device 3006B. Description will be made below regarding this configuration.

In FIG. 38, the housing 3006H of the developing device 3006B (see FIG. 39) is provided with an opening 3006P1 (see FIG. 39) at the wall facing the developing sleeve 3006B1, which faces the tip portion of the magnetic brush carried on the developing sleeve 3006B1 which has passed through the developing region DP following visualizing processing.

Figure 39:
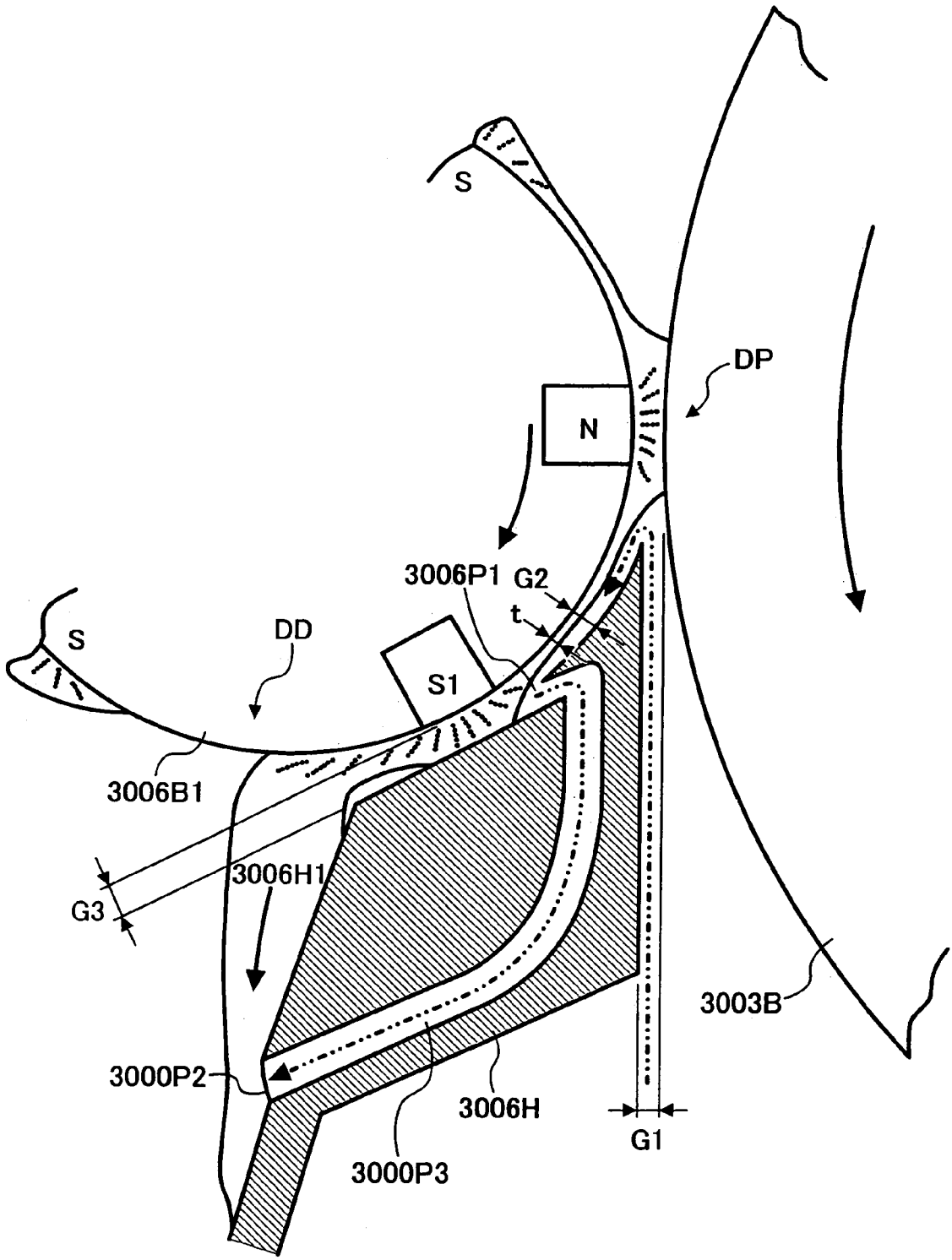
FIG. 39 is a partial enlarged diagram for describing the primary components of the developing device illustrated in FIG. 26.
Figure 40:
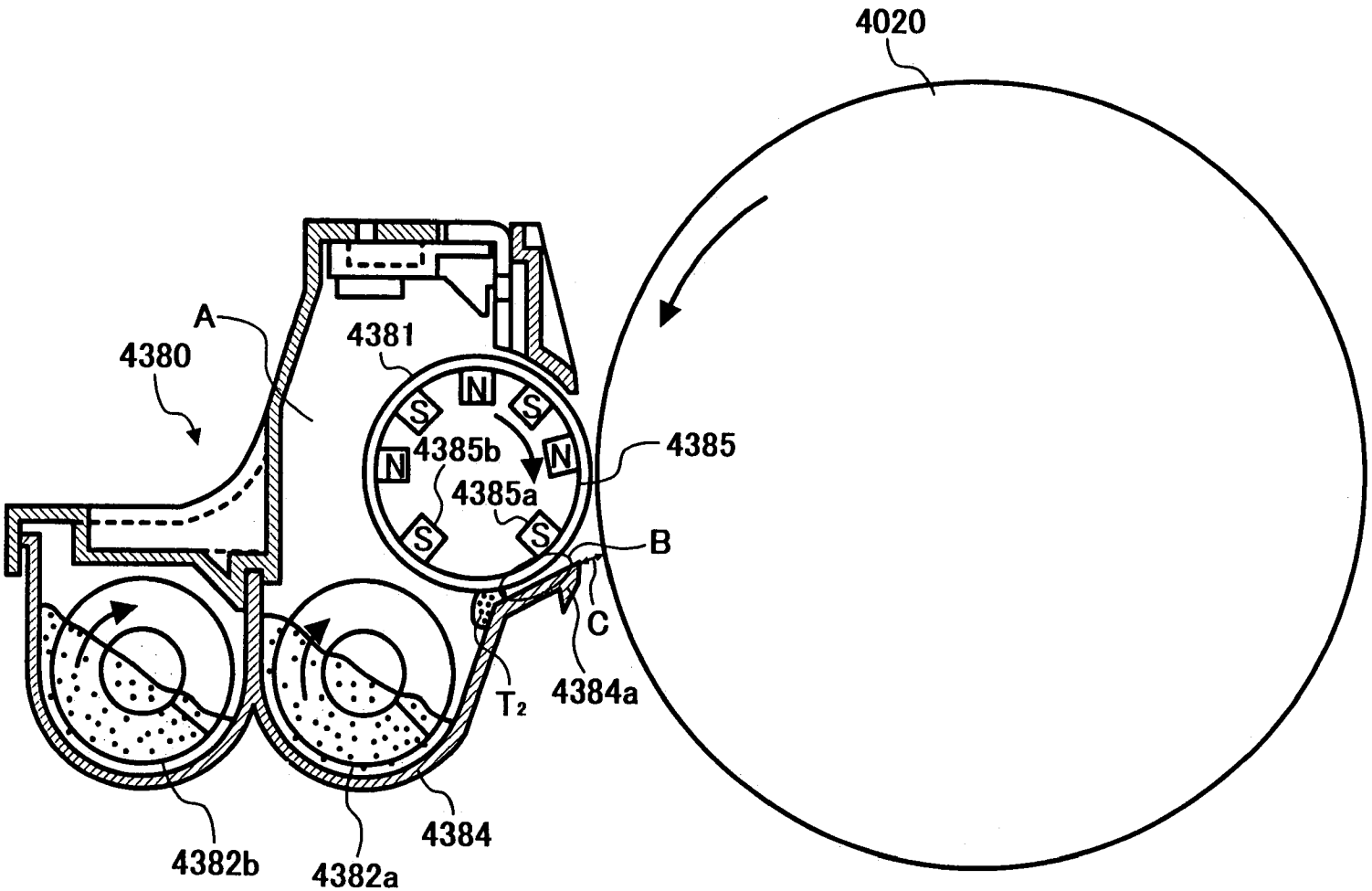
FIG. 40 RELATED ART
FIG. 40 is a schematic configuration diagram illustrating an example of a conventional developing device.
Figure 41:
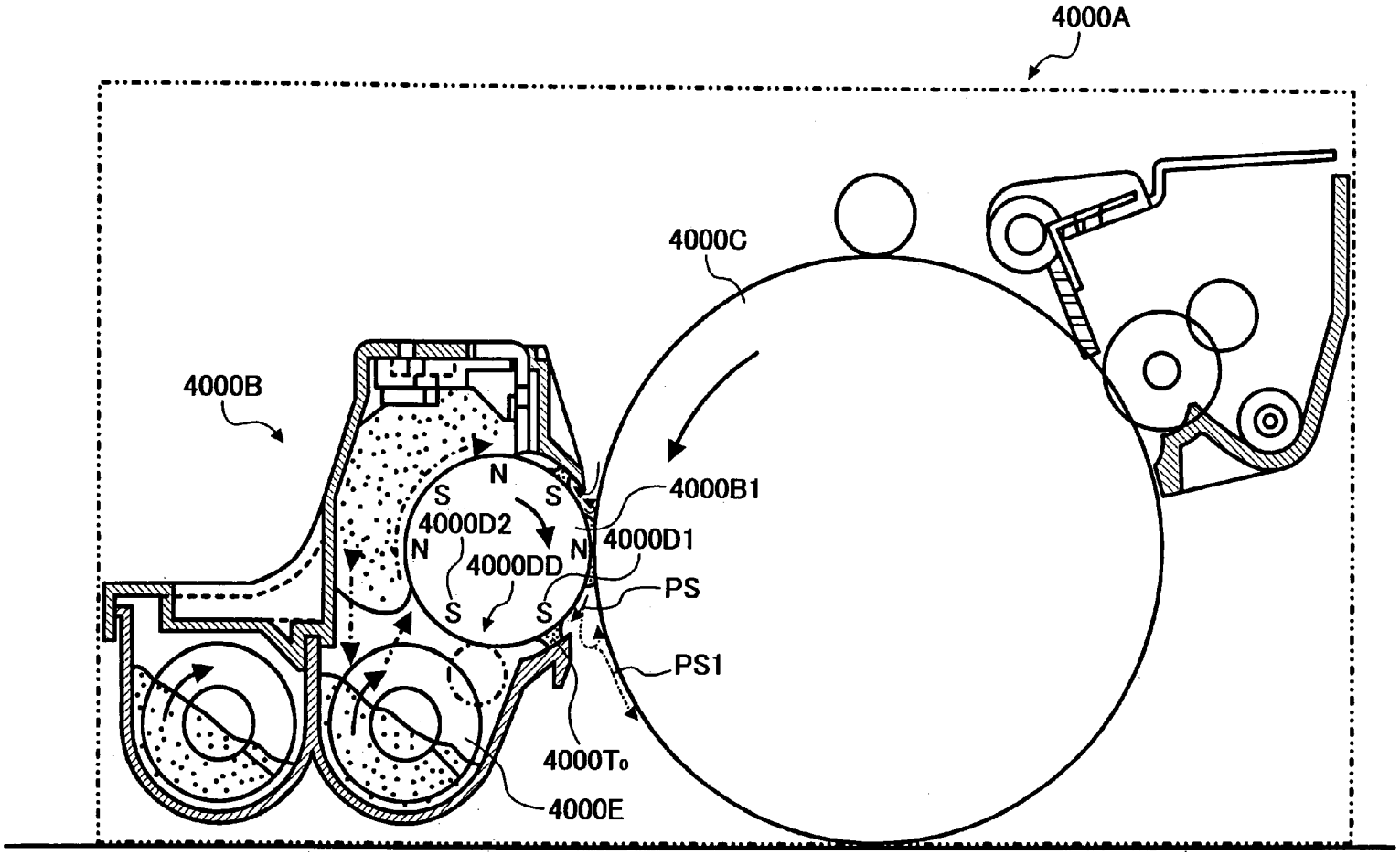
FIG. 41 RELATED ART
FIG. 41 is a model diagram illustrating the configuration of a conventional developing device.
Figure 42:
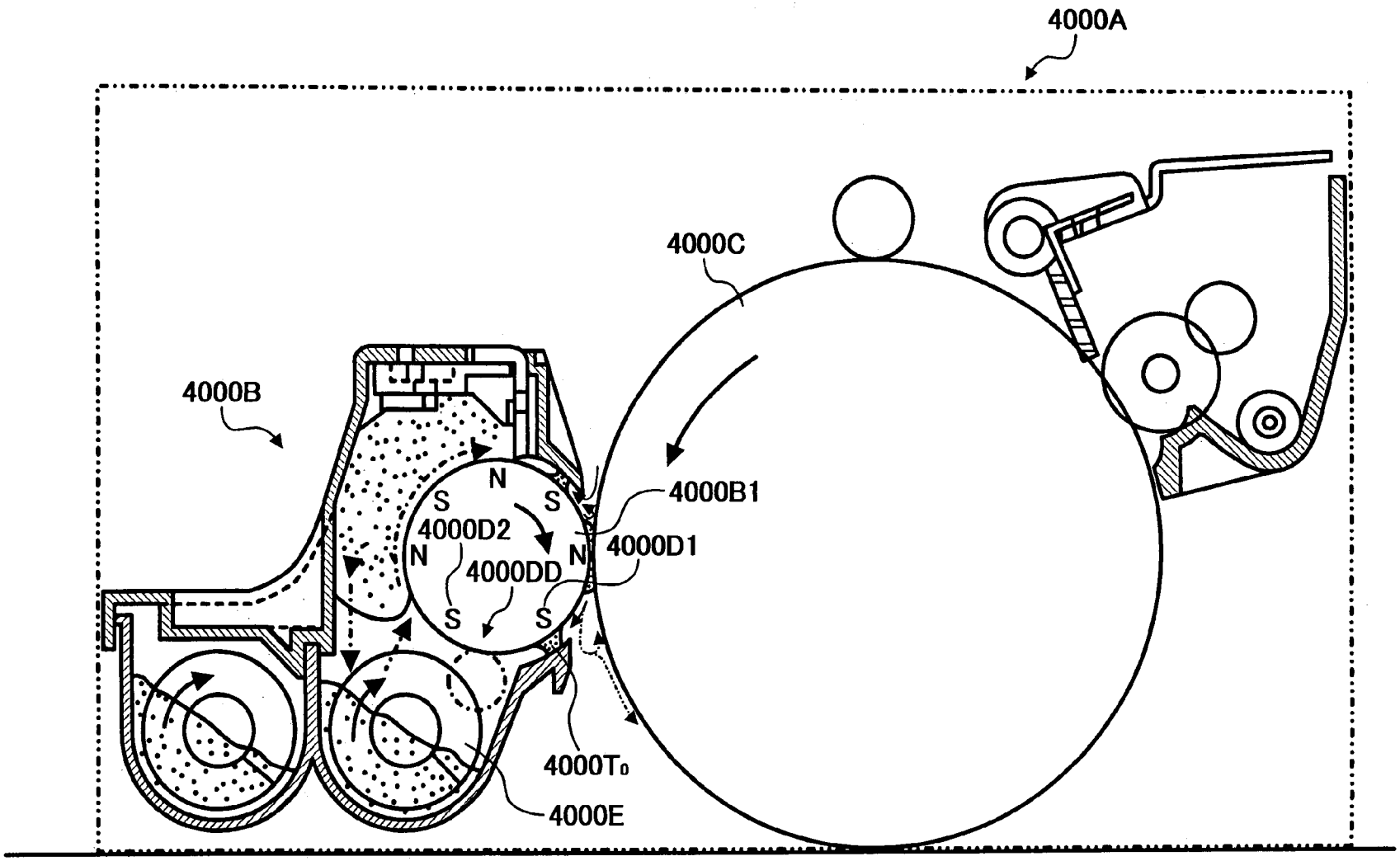
FIG. 42 RELATED ART
FIG. 42 is a model diagram describing the problems occurring with the conventional developing device.
Figure 43:
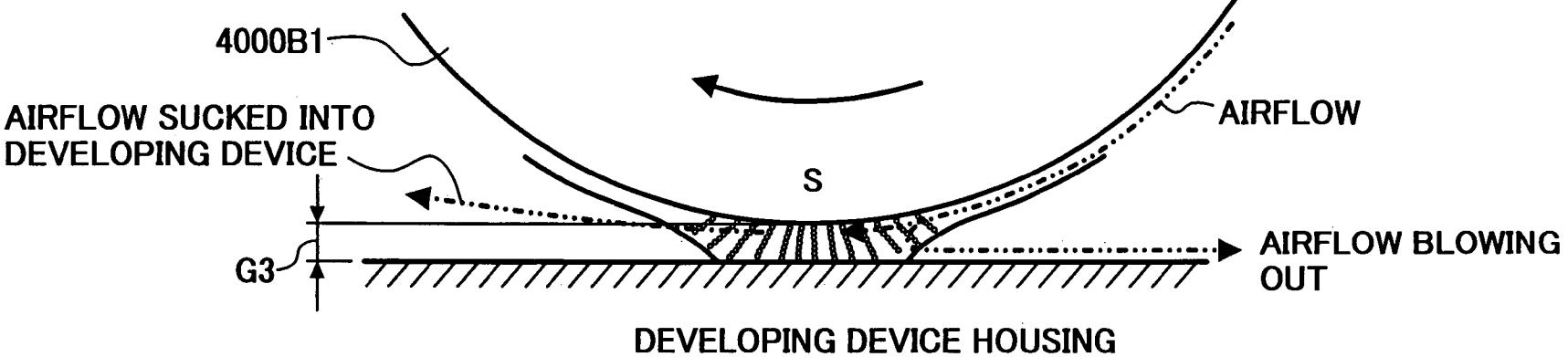
FIG. 43 RELATED ART
FIG. 43 is a model diagram describing the behavior of developing agent in the developing device shown in FIG. 42.

As shown in FIG. 39, the opening 3006P1 is provided between the entrance where the developing agent carried on the developing sleeve 3006B1 which has passed through the developing region DP enters the housing 3006H, and the placement position of a magnetic pole (denoted by symbol S1 in FIG. 39 for ease of description) which is one of the transporting magnetic poles disposed within the developing sleeve 3006B1 and the adjacent magnetic poles making up the developing-agent-dropping repelling magnetic field formation region DD, and which is adjacent to the developing main pole making up the developing region DP. That is to say, the opening 3006P1 is positioned in the upstream side in the direction of movement of the developing sleeve 3006B1 from one magnetic pole (S1) for forming a repelling magnetic field downstream from the developing main pole in the direction of movement of the developing sleeve 3006B1.

Suction force acts upon the opening 3006P1, and as a configuration to that end, is arranged to communicate within the developing device, or though unshown, outside the developing device.

With the embodiment shown in FIG. 39, a configuration is illustrated wherein the opening 3006P1 communicates within the developing device 3006B, and with this configuration, communication is made by a detour path 3006P3 having an opening 3006P2 on the wall face (position denoted by the symbol 3006H1 in FIG. 39) of the housing 3006H equivalent to the position where the developing agent, which has peeled off of the developing sleeve at the developing-agent-dropping repelling magnetic field formation region DD within the developing device 3006B, flows.

The opening 3006P1 provided at the side facing the tip of the magnetic brush carried on the developing sleeve 3006B1 is provided for collecting the toner at the tip of the magnetic brush. That is to say, the magnetic brush carried on the developing sleeve 3006B1 which has passes through the developing region DP makes the downstream side in the direction of motion to have a negative pressure tendency due to the pumping actions generated at the time of moving as to the facing wall face of the housing 3006H. Accordingly, the tip of the magnetic brush colliding with the wall of the housing 3006H gives way under the shock force, and a portion of the toner contained in the magnetic brush moves toward the entrance of the housing 3006H due to the negative pressure tendency, readily scatters outside of the developing device 3006B.

With the present embodiment, the opening 3006P1 is provided in order to collect the toner which would scatter due to such a phenomenon. The following is a description of the setting conditions of the opening 3006P1.

First, the opening 3006P1 is formed longer than the length of the developing sleeve 3006B1 in the axial direction, provided upstream in the direction of movement of the developing agent from the position of the repelling magnetic field formation magnetic pole (S1) which is the position where the magnetic brush bristles the highest, and further provided at a position wherein the developing agent can be taken in, in a direction opposite to the direction of movement of the developing sleeve 3006B1.

In the example shown in FIG. 39, in order to set a position where the developing agent can be taken in, a relation is established wherein the relations G2<G3 and G1>G2−t are satisfied, wherein G1 represents the gap between the entrance where the magnetic brush enters the housing 3006H and the photosensitive member 3003B, G2 represents the gap between the developing sleeve 3006B1 and the wall face of the housing 3006H at the stage prior to the magnetic brush passing through the opening 3006P1, G3 represents the gap between the developing sleeve 3006B1 and the housing at the position where the developing agent has passed the opening 3006P1, and further, t represents the layer thickness of the magnetic brush carried on the developing sleeve 3006B1 at the stage prior to reaching the developing-agent-dropping repelling magnetic field formation region DD.

Due to these setting conditions, the opening 3006P1 is provided so as to be capable of taking in the developing agent in a direction opposite to the direction of motion of the developing sleeve 3006B1, at a step portion formed in front of the repelling magnetic field formation magnetic pole (S1), as shown in FIG. 39.

Due to the above-described correlation of the gaps, the position where the opening 3006P1 is set is equivalent to the position where the developing agent attempting to move in the direction opposite to the moving direction of the developing sleeve 3006B1 based on the negative pressure tendency is dammed up, whereby the tip of the magnetic brush is easily taken in the developing agent.

Note that a case wherein the equality is established in the relation between the gaps represented by the symbols G1, G2, and G3, indicates a state with no step, and in this case, a so-called pit form is employed wherein the opening 3006P1 suctions and pulls in the developing agent at the tip of the magnetic brush.

On the other hand, the detour path 3006P which has the opening 3006P1 as one end thereof, has a great area as to the opening 3006P1. Accordingly, the developing agent which has entered the opening 3006P1 is subjected to greater negative pressure inclination due to reduction in pressure in the detour path which is a greater area than the opening 3006P1, so suctioning actions are strengthened. Consequently, the efficiency of forcibly suctioning scattered toner, occurring upon the magnetic brush carried by the developing sleeve 3006B1 past the developing region DP colliding with the wall face of the housing 3006H and collapsing, can be improved.

In the detour path 3006P3, a magnetic shield member DM (see FIG. 38) is provided near the opening 3006P2 at the wall face 3006H1 side of the housing 3006H, equivalent to the position where the developing agent peeled off flows. Accordingly, the effects of the magnetic lines of force from the repelling magnetic field formation magnetic pole S1 can be prevented from reaching within the detour 3006P1, so deterioration in recovery efficiency can be prevented by not obstructing the movement of developing agent moving through the detour path P3.

Due to the present embodiment having such a configuration, the developing agent within the magnetic brush carried on the developing sleeve 3006B1 past the developing region DP enters from the entrance in the housing 3006H of the developing device 3006B, and moves within the housing 3006H facing the developing sleeve 3006B1.

The tip of magnetic brush which has entered the housing 3006H collapses upon colliding with the wall face of the housing 3006H facing the developing sleeve 3006B1, and the developing agent contained in the tip thereof scatters rearward in the direction of movement which is the negative pressure tendency portion, due to the pumping action of the developing agent which occurs in the process of moving to that point.

The portion where the collapsing of the tip of the magnetic brush is most marked is the position facing the repelling magnetic field formation magnetic pole S1 where the brush bristles the greatest. Accordingly, while the developing agent in the magnetic brush colliding with the wall face of the housing 3006H facing the magnetic pole S1 scatters rearward in the direction of movement, the opening 3006P1 having suctioning action is provided behind this, so the developing agent is taken into the opening 3006P1 and collected.

The developing agent collected by the opening 3006P1 is discharged into the developing device 3006B through the detour path 3006P3 due to the negative pressure tendency owing to the lowered pressure generated at the opening 3006P2 of the detour path 3006P3. Particularly, in the event of using the above-described relation of gaps, the developing agent which will scatter can be smoothly taken in and collected since the opening 3006P1 is disposed at the step portion where developing agent which will scatter can be dammed up.

Note that, with the housing 3006H of the developing device 3006B, the configuration of the embodiment shown in FIG. 39 comprises a humidity-adjusted air channel 3006S1 (see FIG. 38) for allowing air, of which the humidity has been adjusted (humidity-adjusted air), to flow toward the position where the developing agent carried on the developing sleeve 3006B1 past the developing region DP enters the housing 3006H, so that the humidity-adjusted air can be taken in using the negative pressure due to the pumping of the developing agent.

The humidity-adjusted air is supplied to around the developing region DP, whereby deterioration of developing efficiency due to change in charging properties of the developing agent can be prevented. In addition, the humidity-adjusted air can be supplied to not only around the developing region DP, but also to around the photosensitive member 3003B through the developing region DP in the direction of movement of the photosensitive member 3003B. Accordingly, a humidity-adjusted air channel is formed by providing a predetermined gap over a range following where the perimeter of the photosensitive member 3003B moves past the developing region DP which is a portion of the housing of the developing device 3006B, of a shape such that the humidity-adjusted air can move over the surface thereof according to movement of the photosensitive member 3003B. Preliminary supply of circulation of humidity-adjusted air greatly contributes to promoting stability of charging properties of the toner used in the developing device, in the event that a compound toner which is readily affected by humidity is used.

Also, as for a configuration yielding suctioning actions with regard to the opening 3006P1, an arrangement may be made wherein, as shown in FIG. 39, and channel 3006S2 is provided with one opening at a position in the rotation direction for a screw member 3006B2 used for stirring and mixing the developing agent where the pressure is positive and the other opening at a position where the pressure is negative due to the rotations of the developing sleeve 3006B1, with a pipe PP being provided as a channel for communicating between the channel 3006S2 and a cleaning device (not shown).

Due to such a configuration, increase of pressure within the developing device 3006B can be prevented using the pressure form generated by a rotating member provided within the cleaning device, which can be further used as a source for generating suctioning negative pressure to the opening 3006P1.

Numerous additional modifications and variations of the present invention are possible in light of the above teachings. It is therefore to be understood that within the scope of the appended claims, the present invention may be practiced otherwise than as specifically described herein.

What is claimed is:

1. A developing device, comprising:

a developing agent carrying member which faces a latent image carrying member and rotates in a direction such that the portion thereof facing said latent image carrying member rotates in the same direction as said latent image carrying member at that position, while carrying on the surface thereof a developing agent containing magnetic particles;

a casing which forms a developing agent storing space therein for storing developing agent, and has an opening whereby a portion of the surface of said developing agent carrying member in the direction of rotation of said developing agent carrying member is made to face said latent image carrying member;

a developing agent restricting member disposed within said casing, upstream, in the direction of rotation of said developing agent carrying member, of a developing region where said developing agent carrying member and said latent image carrying member face one another, such that a gap is formed between said developing agent restricting member and said developing agent carrying member, so as to restrict the amount of developing agent supplied to said developing region; whereby developing is performed by bringing the developing agent on the surface of said developing agent carrying member with said latent image carrying member at said developing region;

magnetic field generating means for generating a magnetic field such that said developing agent is made to form a magnetic brush so as to close off the space between the surface of said developing agent carrying member and the inner wall of said casing at least one time while said developing agent being carried by the surface of said developing agent carrying member is being carried from said gap to said developing region; and a gas exhaust path for exhausting gas, in an upstream space defined by the surface of said developing agent carrying member and the inner wall of said casing upstream in the rotational direction of said developing agent carrying member from said developing region, into the inner space of a device or member employing a structure whereby developing agent existing therein is prevented from scattering within an image formation apparatus, at a position downstream in the rotational direction of said developing agent carrying member from a brush formation position where said developing agent forms a magnetic brush due to said magnetic field generating means.

2. The developing device according to claim 1, wherein an opening of said gas exhaust path is formed in said upstream space so that gas within said upstream space is exhausted from the end portion of said upstream space in the direction of the rotational axis of said developing agent carrying member.

3. The developing device according to claim 2, wherein two of said gas exhaust paths are provided, and wherein openings of said gas exhaust paths are each formed in said upstream space so that gas within said upstream space is exhausted, via said gas exhaust paths, from both end portions of said upstream space in the direction of the rotational axis of said developing agent carrying member.

4. The developing device according to any one of claims 1 through 3, wherein a negative pressure space, adjacent to said developing agent restricting member in the downstream direction of rotation of said developing agent carrying member, is used as said inner space.

5. A developing device comprising:

a latent image carrying member; and a developing device for developing latent images on said latent image carrying member;

wherein a developing device according to any one of claims 1 through 3 is used as said developing device.

6. A developing device comprising:

a latent image carrying member;

a developing device for developing latent images on said latent image carrying member; and a cleaning device which recovers developing agent adhering to a member to be cleaned;

wherein a developing device according to any one of claims 1 through 3 is used as said developing device;

and wherein inner space of said cleaning device for storing developing agent collected by said cleaning device is used as said inner space.

7. A developing device, comprising:

a developing agent carrying member which faces a latent image carrying member and rotates in a direction such that the portion thereof facing said latent image carrying member rotates in the same direction as said latent image carrying member at that position, while carrying on the surface thereof a developing agent; and a casing which forms an inner space therein for storing developing agent, and has an opening whereby a portion of the surface of said developing agent carrying member in the direction of rotation of said developing agent carrying member is made to face said latent image carrying member;

wherein said developing device is configured such that external air is capable of flowing in toward the inner space of said casing, through an inlet gap formed between the edge portion of said opening positioned at the downstream side in the direction of rotation of said developing agent carrying member and the surface of said latent image carrying member;

and further comprising a second opening, formed at an inner wall portion of said casing, further upstream in the direction of rotation of said developing agent carrying member from the position where developing agent closes off part or all of the channel space between the surface of said developing agent carrying member and the inner wall of said casing, which can serve as a channel for external air flowing into the inner space of said casing through said inlet gap; and a gas exhaust path connected to said second opening for exhausting gas within said channel space to a developing agent scattering-prevention space through said second opening.

8. The developing device according to claim 7, further comprising suction means for suctioning gas from the end portion of said gas exhaust path of said developing agent scattering-prevention space.

9. The developing device according to claim 8, further comprising a developing agent restricting member for restricting the amount of developing agent carried on the surface of said developing agent carrying member in order to adjust the amount of developing agent transported to said developing region, said developing agent restricting member being positioned facing the surface of said developing agent carrying member with a predetermined gap therebetween at a position further upstream from said developing region in the direction of rotation of said developing agent carrying member, wherein a negative pressure space, adjacent to said developing agent restricting member in the downstream direction of rotation of said developing agent carrying member, is used as said suction means.

10. The developing device according to either of claims 8 or 9, wherein the inner space of said casing is configured so as to be in a generally airtight space, with said inner space being used as said developing agent scattering-prevention space, and with gas within said inner space being suctioned by said suction means.

11. The developing device according to claim 10, further comprising a preventing member disposed in the upstream direction of flow of said developing agent of said opening, for preventing passage of developing agent flowing in said inner space through said opening, around the opening of said gas exhaust path opened into said inner space.

12. A developing device, comprising:

a developing agent carrying member which faces a latent image carrying member and rotates in a direction such that the portion thereof facing said latent image carrying member rotates in the same direction as said latent image carrying member at that position, while carrying on the surface thereof a developing agent; and a casing which forms an inner space therein for storing developing agent, and has an opening whereby a portion of the surface of said developing agent carrying member in the direction of rotation of said developing agent carrying member is made to face said latent image carrying member;

wherein said developing device is configured such that external air is capable of flowing in toward the inner space of said casing, through an inlet gap formed between the edge portion of said opening positioned at the downstream side in the direction of rotation of said developing agent carrying member and the surface of said latent image carrying member;

and further comprising a second opening, formed at an inner wall portion of said casing, further upstream in the direction of rotation of said developing agent carrying member from the position where developing agent closes off part or all of the channel space between the surface of said developing agent carrying member and the inner wall of said casing, which can serve as a channel for external air flowing into the inner space of said casing through said inlet gap;

and a gas exhaust path connected to said second opening for exhausting gas within said channel space outside of said developing device through said second opening; and a filter member disposed in said gas exhaust path.

13. A developing device, comprising:

a developing agent carrying member which faces a latent image carrying member and rotates in a direction such that the portion thereof facing said latent image carrying member rotates in the same direction as said latent image carrying member at that position, while carrying on the surface thereof a developing agent;

a casing which forms an inner space therein for storing developing agent, and has an opening whereby a portion of the surface of said developing agent carrying member in the direction of rotation of said developing agent carrying member is made to face said latent image carrying member; and a transporting member for transporting developing agent in the inner space of said casing, in the direction of rotation of said developing agent carrying member;

wherein said developing device is configured such that external air is capable of flowing in toward the inner space of said casing, through an inlet gap formed between the edge portion of said opening positioned at the downstream side in the direction of rotation of said developing agent carrying member and the surface of said latent image carrying member, due to an airflow passing through the channel space between said developing agent carrying member and said transporting member;

and further comprising a shielding member for shielding developing agent transported by said transporting member, from the airflow passing through said channel gap.

14. A developing device according to claim 13, further comprising a developing agent restricting member for restricting the amount of developing agent carried on the surface of said developing agent carrying member in order to adjust the amount of developing agent transported to said developing region, said developing agent restricting member being positioned facing the surface of said developing agent carrying member with a predetermined gap therebetween at a position further upstream from said developing region in the direction of rotation of said developing agent carrying member, wherein a negative pressure space, adjacent to said developing agent restricting member in the downstream direction of rotation of said developing agent carrying member, and the inner space of said casing, are made to communicate, so as to generate an airflow passing through said channel gap.

15. The developing device according to either of claims 13 or 14, further comprising:

two transporting screws as said transporting member, which transport the developing agent in mutually opposite direction along the rotation axis direction of said developing agent carrying member, by fins fixed on the rotating axes of said transporting screws extending in the rotation axis direction of said developing agent carrying member; and moving paths provided at both ends regions in the rotation axis direction of said two transporting screws, whereby developing agent which has reached the transportation ending portion of one transporting screw is moved to the transportation starting portion of the other transporting screw;

wherein said shielding member is disposed so as to shield at least the transporting screw at the side closer to said developing agent carrying member from said airflow.

16. The developing device according to claim 15, wherein, the developing agent moving through, of said moving paths, at least the moving path which moves the developing agent to the transportation starting portion of the transporting screw at the side closer to said developing agent carrying member, is shielded from said airflow by said shielding member.

17. The developing device according to claim 15, further comprising, on the face of said shielding member which faces said transporting screw, a flexible member which comes into contact with the perimeter of the fin of said transporting screw.

18. The developing device according to claim 15, further comprising a suction opening for suction means for suctioning gas, said suction opening provided on the inner wall portion of the casing near to the channel space between the transporting screw closer to said developing agent carrying member and said developing agent carrying member.

19. The developing device according to claim 15, further comprising airflow generating means for generating an airflow which passes through the channel space Between the transporting screw closer to said developing agent carrying member and said developing agent carrying member, and passes through the perimeter region of the transporting screw not closer to said developing agent carrying member.

20. The developing device according to any of the claims 7, 8, 9, 12, 13 and 14, further comprising gas supplying means for supplying gas to said inlet gap, for enhancing conditions within the inner space of said casing so as to be suitable for toner charging properties.

21. An image formation apparatus comprising:

a latent image carrying member; and a developing device for developing latent images on said latent image carrying member;

wherein the developing device according to any of the claims 7, 8, 9, 12, 13 and 14 is used as said developing device.

22. A process cartridge configured so as to be detachable mounted to the main unit of the image formation apparatus according to claim 21, wherein at least said latent image carrying member and said developing agent carrying member are configured integrally.

23. A developing device comprising:

a developing sleeve capable of forming a magnetic brush, disposed facing a latent image carrying member and disposed within housing which is almost airtight except for the portion where said developing sleeve faces said latent image carrying member, in order to effect processing for visualizing electrostatic latent images formed on said latent image carrying member; and a screw member which transports developing agent toward said developing sleeve while stirring said developing agent;

wherein a communicating portion is provided which has a starting end portion and an ending end portion at a positive pressure portion and a negative pressure portion emerging at the upstream and downstream of the magnetic brush carried by said developing sleeve in the direction of movement thereof, thereby causing airflow between said positive pressure portion and negative pressure portion.

24. The developing device according to claim 23, wherein a starting end opening is formed in the developing agent transporting path at a developing agent drawing-up starting side where the developing agent is drawn up by said screw member toward said developing sleeve, and wherein an ending end opening has an exhaust channel, provided behind a layer thickness restricting member for restricting the thickness of said developing agent in front of a position where said developing sleeve faces said latent image carrying member, as a flowing portion for air.

25. The developing device according to claim 24, wherein said starting end opening has a shape which widens from the upper portion thereof toward the lower portion thereof in the direction in which developing agent drawn up toward the developing sleeve falls, and has an opening formed at the widened portion.

26. The developing device according to either of claims 24 or 25, wherein a plurality of said starting openings are provided in the axial direction of said developing sleeve, with each of said starting end openings being connected with said ending end opening such that pressure distribution in the axial direction of said developing sleeve is uniform.

27. The developing device according to claim 26, wherein said starting end openings positioned at the outer sides in the axial direction of said developing sleeve are connected to an ending end opening positioned at the center side of in the axial direction of said developing sleeve.

28. A developing device comprising:

a developing sleeve capable of forming a magnetic brush, disposed facing a latent image carrying member and disposed within housing which is almost airtight except for the portion where said developing sleeve faces said latent image carrying member, in order to effect processing for visualizing electrostatic latent images formed on said latent image carrying member; and a screw member which transports developing agent toward said developing sleeve while stirring said developing agent;

wherein a communicating portion is provided which has a starting end portion and an ending end portion at a positive pressure portion and a negative pressure portion emerging at the upstream and downstream of the magnetic brush carried by said developing sleeve in the direction of movement thereof, with said start end portion being provided near a repelling magnetic field formation region for causing developing agent to fall which is provided on said developing sleeve, and with said ending end portion communicating with said starting end portion being provided behind a layer thickness restricting portion for restricting the thickness of said developing agent in front of a position where said developing sleeve facing said latent image carrying member, thereby causing airflow between said positive pressure portion and negative pressure portion.

29. The developing device according to claim 28, wherein a channel whereby said starting end portion and said ending end portion communicate, has the starting end portion thereof connected to the end side in the axial direction of said developing sleeve, and the ending end portion thereof connected to center side in the axial direction of said developing sleeve.

30. The developing device according to either of claim 23 or claim 28, further comprising a channel for communication between near a repelling magnetic field formation region for causing developing agent to fall which is provided on said developing sleeve, and the ambient atmosphere, wherein said channel is configured so as to be capable of opening and closing.

31. The developing device according to any one of claims 23, 24, 25, 28 and 29, wherein the gap as to said latent image carrying member at a position past said developing position in the direction of movement of said developing sleeve in said housing is smaller than the gap at said developing position.

32. The developing device according to either of claim 23 or claim 28, further comprising a circulation chamber for permitting circulation of air at a position past said developing position in the direction of movement of said developing sleeve in said housing.

33. The developing device according to claim 32, wherein said circulation chamber communicates with a channel for communication between near a repelling magnetic field formation region for causing developing agent to fall which is provided on said developing sleeve, and the ambient atmosphere, wherein said channel is configured so as to be capable of opening and closing.

34. A process cartridge using the developing device according to any one of claims 23, 24, 25, 28 and 29.

35. The process cartridge according to claim 34, wherein the channel for communication between near a repelling magnetic field formation region for causing developing agent to fall which is provided on said developing device, and the ambient atmosphere, is closed at the time of mounting or detaching said process cartridge.

36. The process cartridge according to claim 35, wherein the channel for communication between near a repelling magnetic field formation region for causing developing agent to fall which is provided on said developing device, and the ambient atmosphere, is closed at the time of standby for developing processing.

37. An image formation apparatus using the process cartridge of claim 34.

38. An image formation apparatus using the developing device according to any one of the claims 23, 24, 25, 28 and 29.

39. A developing device, comprising:

a developing sleeve capable of forming a magnetic brush, disposed facing a latent image carrying member and disposed within a housing which is almost airtight except for the portion where said developing sleeve faces said latent image carrying member, in order to effect processing for visualizing electrostatic latent images formed on said latent image carrying member, the developing sleeve having at least two fixed magnets radially arranged inside the developing sleeve;

wherein an opening, formed in a wall face of said housing facing said developing sleeve, faces the leading edge of the developing agent carried by said developing sleeve following the processing for visualizing the electrostatic latent images, the opening being located between adjacent magnets, and suctioning force acts upon said opening.

40. The developing device according to claim 38, wherein said opening is provided between an entrance of said housing where the developing agent carried by said developing sleeve begins to enter said housing following finishing the processing for visualizing the electrostatic latent images, and a position where a transporting magnetic pole provided to said developing sleeve is disposed.

41. The developing device according to either of claims 38 or 39, wherein said opening is positioned upstream in the direction of movement of said developing sleeve for a magnetic pole positioned downstream from a developing primary magnetic pole facing said latent image carrying member.

42. The developing device according to any one of claims 39 through 40, wherein said opening communicating with the inside of said developing device, or with the outside.

43. The developing device according to claim 42, wherein said opening is positioned at one end of a detour path communicating with a position at which the developing agent carried by said developing sleeve is scraped off of said developing sleeve and flows within said developing device.

44. The developing device according to any one of claims 39 through 40, wherein the expression $$G2\#G3$$

holds, wherein

G2 represents the gap between said developing sleeve and the wall face of said housing at a position prior to the developing agent passing said opening facing said developing sleeve, and G3 represents the gap between said developing sleeve and the wall face of said housing at a position following the developing agent passing said opening facing said developing sleeve.

45. The developing device according to any one of claims 39 through 40, wherein the expression $$G1>G2-t$$

holds, wherein

G1 represents the gap between the entrance of said housing where the developing agent enters and said latent image carrying member, G2 represents the gap between said developing sleeve and the wall face of said housing at a position prior to the developing agent passing said opening facing said developing sleeve, and t represents the thickness of the layer of developing agent carried by said developing sleeve which has passed the developing region.

46. The image formation apparatus using the developing device according to any one of claims 39 through 40.

47. A developing device, comprising:

a developing sleeve capable of forming a magnetic brush, disposed facing a latent image carrying member and disposed within a housing which is almost airtight except for the portion where said developing sleeve faces said latent image carrying member, in order to effect processing for visualizing electrostatic latent images formed on said latent image carrying member, the developing sleeve having at least two fixed magnets radially arranged inside the developing sleeve;

wherein an opening, formed in a wall face of said housing facing said developing sleeve, faces the leading edge of the developing agent carried by said developing sleeve following the processing for visualizing the electrostatic latent images, the opening being located between adjacent magnets and said opening has a length in the longitudinal direction set longer than the length of said developing sleeve in the axial direction.

48. The developing device according to claim 47, wherein said opening is provided between an entrance of said housing where the developing agent carried by said developing sleeve begins to enter said housing following finishing the processing for visualizing the electrostatic latent images, and a position where a transporting magnetic pole provided to said developing sleeve is disposed.

49. A developing device, comprising:

a developing sleeve capable of forming a magnetic brush, disposed facing a latent image carrying member and disposed within a housing which is almost airtight except for the portion where said developing sleeve faces said latent image carrying member, in order to effect processing for visualizing electrostatic latent images formed on said latent image carrying member, the developing sleeve having at least two fixed magnets radially arranged inside the developing sleeve;

wherein an opening, formed in a wall face of said housing facing said developing sleeve, faces the leading edge of the developing agent carried by said developing sleeve following the processing for visualizing the electrostatic latent images, the opening being located between adjacent magnets and said opening is provided so as to be capable of taking in the developing agent carried by said developing sleeve in a direction opposite to the direction of motion of said developing sleeve.

50. The developing device according to claim 49, wherein said opening is provided between an entrance of said housing where the developing agent carried by said developing sleeve begins to enter said housing following finishing the processing for visualizing the electrostatic latent images, and a position where a transporting magnetic pole provided to said developing sleeve is disposed.

51. A developing device, comprising:

a developing sleeve capable of forming a magnetic brush, disposed facing a latent image carrying member and disposed within a housing which is almost airtight except for the portion where said developing sleeve faces said latent image carrying member, in order to effect processing for visualizing electrostatic latent images formed on said latent image carrying member, the developing sleeve having at least two fixed magnets radially arranged inside the developing sleeve;

wherein an opening, formed in a wall face of said housing facing said developing sleeve, faces the leading edge of the developing agent earned by said developing sleeve following the processing for visualizing the electrostatic latent images, the opening being located between adjacent magnets, communicating with the inside of said developing device, or with the outside, and positioned at one end of a detour path communicating with a position at which the developing agent carried by said developing sleeve is scraped off of said developing sleeve and flows within said developing device, wherein said detour path has a greater area at a channel portion communicating with the inside of said developing device, than the area of said opening.

52. The developing device according to claim 51, wherein said opening is provided between an entrance of said housing where the developing agent carried by said developing sleeve begins to enter said housing following finishing the processing for visualizing the electrostatic latent images, and a position where a transporting magnetic pole provided to said developing sleeve is disposed.

53. A developing device, comprising:

a developing sleeve capable of forming a magnetic brush, disposed facing a latent image carrying member and disposed within a housing which is almost airtight except for the portion where said developing sleeve faces said latent image carrying member, in order to effect processing for visualizing electrostatic latent images formed on said latent image carrying member, the developing sleeve having at least two fixed magnets radially arranged inside the developing sleeve;

wherein an opening, formed in a wall face of said housing facing said developing sleeve, faces the leading edge of the developing agent carried by said developing sleeve following the processing for visualizing the electrostatic latent images, the opening being located between adjacent magnets, communicating with the inside of said developing device, or with the outside, and positioned at one end of a detour path communicating with a position at which the developing agent carried by said developing sleeve is scraped off of said developing sleeve and flows within said developing device, a magnetic shield member in a channel portion of said detour path communicating with the inside of said developing device.

54. The developing device according to claim 53, wherein said opening is provided between an entrance of said housing where the developing agent carried by said developing sleeve begins to enter said housing following finishing the processing for visualizing the electrostatic latent images, and a position where a transporting magnetic pole provided to said developing sleeve is disposed.

55. A developing device, comprising:

a developing sleeve capable of forming a magnetic brush, disposed facing a latent image carrying member and disposed within a housing which is almost airtight except for the portion where said developing sleeve faces said latent image carrying member, in order to effect processing for visualizing electrostatic latent images formed on said latent image carrying member, the developing sleeve having at least two fixed magnets radially arranged inside the developing sleeve;

wherein an opening, formed in a wall face of said housing facing said developing sleeve, faces the leading edge of the developing agent carried by said developing sleeve following the processing for visualizing the electrostatic latent images, the opening being located between adjacent magnets, wherein the expression $$G1\#G2-t$$

holds, wherein

G1 represents the gap between the entrance of said housing where the developing agent enters and said latent image carrying member, G2 represents the gap between said developing sleeve and the wall face of said housing at a position prior to the developing agent passing said opening facing said developing sleeve, and t represents the thickness of the layer of developing agent carried by said developing sleeve which has passed the developing region.

56. The developing device according to claim 55, wherein said opening is provided between an entrance of said housing where the developing agent carried by said developing sleeve begins to enter said housing following finishing the processing for visualizing the electrostatic latent images, and a position where a transporting magnetic pole provided to said developing sleeve is disposed.

57. A developing device, comprising:

a developing sleeve capable of forming a magnetic brush, disposed facing a latent image carrying member and disposed within a housing which is almost airtight except for the portion where said developing sleeve faces said latent image carrying member, in order to effect processing for visualizing electrostatic latent images formed on said latent image carrying member, the developing sleeve having at least two fixed magnets radially arranged inside the developing sleeve;

wherein an opening, formed in a wall face of said housing facing said developing sleeve, faces the leading edge of the developing agent carried by said developing sleeve following the processing for visualizing the electrostatic latent images, the opening being located between adjacent magnets, wherein the expression $$G2<G3$$

holds, wherein

G2 represents the gap between said developing sleeve and the wall face of said housing at a position prior to the developing agent passing said opening facing said developing sleeve, and G3 represents the gap between said developing sleeve and the wall face of said housing at a position following the developing agent passing said opening facing said developing sleeve.

58. The developing device according to claim 57, wherein said opening is provided between an entrance of said housing where the developing agent carried by said developing sleeve begins to enter said housing following finishing the processing for visualizing the electrostatic latent images, and a position where a transporting magnetic pole provided to said developing sleeve is disposed.

* * * * *

UNITED STATES PATENT AND TRADEMARK OFFICE

CERTIFICATE OF CORRECTION

PATENT NO. : 7,103,298 B2
APPLICATION NO. : 10/780773
DATED : September 5, 2006
INVENTOR(S) : Osamu Satoh It is certified that error appears in the above-identified patent and that said Letters Patent is hereby corrected as shown below:

In Column 58, line 14, (Claim 44): Change "G2 # G3" to --G2 ≤ G3--.

In Column 60, line 39, (Claim 55): Change "G1 # G2 - t" to --G1 ≤ G2 - t--.

Signed and Sealed this

Thirtieth Day of January, 2007

JON W. DUDAS
*Director of the United States Patent and Trademark Office*